US010092789B2

(12) United States Patent
Bailar

(10) Patent No.: US 10,092,789 B2
(45) Date of Patent: Oct. 9, 2018

(54) EXERCISE DEVICE HAVING DAMPED OSCILLATING FOOT PLATFORMS

(71) Applicant: Benjamin F. Bailar, Philadelphia, PA (US)

(72) Inventor: Benjamin F. Bailar, Philadelphia, PA (US)

( * ) Notice: Subject to any disclaimer, the term of this patent is extended or adjusted under 35 U.S.C. 154(b) by 0 days.

(21) Appl. No.: 15/089,636

(22) Filed: Apr. 4, 2016

(65) Prior Publication Data

US 2016/0296791 A1 Oct. 13, 2016

Related U.S. Application Data

(60) Provisional application No. 62/144,501, filed on Apr. 8, 2015.

(51) Int. Cl.
*A63B 69/18* (2006.01)
*A63B 21/008* (2006.01)
(Continued)

(52) U.S. Cl.
CPC ..... *A63B 21/0087* (2013.01); *A63B 21/4045* (2015.10); *A63B 23/0494* (2013.01); *A63B 23/08* (2013.01); *A63B 21/00065* (2013.01); *A63B 21/0088* (2013.01); *A63B 21/00181* (2013.01); *A63B 21/023* (2013.01);
(Continued)

(58) Field of Classification Search
CPC ..... A63B 21/0087; A63B 21/4045; A63B 23/0494; A63B 23/08; A63B 21/00181; A63B 21/00065; A63B 21/4034; A63B 22/20; A63B 21/0618; A63B 2208/0233; A63B 21/023; A63B 21/0552; A63B 21/028; A63B 21/027; A63B 2209/02; A63B 21/00
See application file for complete search history.

(56) References Cited

U.S. PATENT DOCUMENTS 2,683,060 A 7/1954 Wise
3,589,720 A * 6/1971 Agamian ..... A63B 21/012 310/69

(Continued)

OTHER PUBLICATIONS

Singletracks, "Wrench Force Micro Mini Pump," 2008, retrieved electronically on Jun. 9, 2016 from <<http://www.singletracks.com/bike-reviews/Pumps/Wrench-Force-Micro-Mini-Pump_646>>.

(Continued)

*Primary Examiner* — Garrett Atkinson
(74) *Attorney, Agent, or Firm* — FisherBroyles, LLP

(57) ABSTRACT

An exercise device including two foot platforms riding on elongated rails for longitudinal motion relative thereto. The platforms are directly connected to each other by one or more elastic elements. One or more dampers are installed substantially parallel with the elastic elements to oppose the energy return of the elastic elements. When the two platforms are side-by-side, the elastic elements and dampers run in a substantially crosswise direction. A seated user may place feet on the platforms and move his/her feet and lower legs back and forth in a scissoring motion to move the platforms in opposition directions along the rails. In so doing, the user overcomes the resistance of the elastic elements and dampers connecting the platforms. This provides the user with exercise and its accompanying benefits.

28 Claims, 64 Drawing Sheets

(51) Int. Cl.

| | |
|---|---|
| ***A63B 23/04*** | (2006.01) |
| ***A63B 23/08*** | (2006.01) |
| *A63B 21/02* | (2006.01) |
| *A63B 21/04* | (2006.01) |
| *A63B 21/055* | (2006.01) |
| *A63B 21/06* | (2006.01) |
| *A63B 22/20* | (2006.01) |
| *A63B 21/00* | (2006.01) |

(52) U.S. Cl.

CPC ..... *A63B 21/027* (2013.01); *A63B 21/028* (2013.01); *A63B 21/0414* (2013.01); *A63B 21/0552* (2013.01); *A63B 21/0618* (2013.01); *A63B 21/4034* (2015.10); *A63B 22/20* (2013.01); *A63B 2208/0233* (2013.01); *A63B 2209/02* (2013.01)

(56) References Cited

U.S. PATENT DOCUMENTS 3,746,338 A * 7/1973 Proctor ..... A63B 21/063 482/101
4,111,417 A * 9/1978 Gardner ..... A63B 21/05 482/128
4,483,532 A 11/1984 Sparks
4,541,627 A * 9/1985 MacLean ..... A63B 22/0076 482/112
4,650,184 A * 3/1987 Brebner ..... A63B 69/18 482/71
4,695,050 A * 9/1987 Smith ..... A63B 22/0076 482/73
4,709,918 A * 12/1987 Grinblat ..... A63B 21/012 482/118
4,756,523 A * 7/1988 Rasmussen ..... A63B 22/0076 188/67
4,865,317 A * 9/1989 Hickey ..... A63B 21/05 482/126
4,915,377 A * 4/1990 Malnke ..... A63B 21/06 482/138
5,051,073 A 9/1991 Newbold
5,064,189 A * 11/1991 Shiuh-Shinn ..... A63B 21/027 482/128
5,066,005 A * 11/1991 Luecke ..... A63B 21/0552 482/130
5,072,929 A * 12/1991 Peterson ..... A63B 22/0076 310/105
5,108,093 A * 4/1992 Watterson ..... A63B 22/0012 482/112
5,165,876 A 11/1992 Wang
5,279,531 A * 1/1994 Jen-Huey ..... A63B 23/0417 482/51
5,295,935 A * 3/1994 Wang ..... A63B 21/0552 482/123
5,472,392 A * 12/1995 Haan ..... A63B 21/015 188/78
5,503,609 A * 4/1996 Bull ..... A63B 21/154 482/51
5,807,210 A * 9/1998 Devlin ..... A63B 22/0056 482/146
5,807,212 A 9/1998 Nelson
6,071,217 A * 6/2000 Barnett ..... A63B 21/0552 482/121
6,280,366 B1 * 8/2001 Hsieh ..... A63B 22/0012 482/130
6,440,045 B1 * 8/2002 Gaston ..... A63B 21/012 482/140
6,527,685 B2 * 3/2003 Endelman ..... A63B 21/023 482/121
6,634,996 B2 * 10/2003 Jacobsen ..... A63B 21/068 482/135
6,786,850 B2 * 9/2004 Nizamuddin ..... A63B 21/157 482/51
6,817,968 B2 * 11/2004 Galbraith ..... A63B 21/0552 482/121
6,981,932 B1 * 1/2006 Huang ..... A63B 21/00072 482/121
7,090,621 B2 * 8/2006 Loane ..... A63B 21/0552 482/51
7,108,643 B2 * 9/2006 Wilson ..... A63B 23/12 482/141
7,294,098 B2 * 11/2007 Barnard ..... A63B 22/0007 482/121
7,419,459 B2 * 9/2008 Van Straaten ..... A63B 22/14 482/146
7,438,673 B1 * 10/2008 Jones ..... A63B 22/203 482/51
7,654,941 B2 * 2/2010 Lacher ..... A63B 69/004 482/135
7,803,095 B1 * 9/2010 LaGree ..... A63B 22/0089 482/121
7,806,805 B2 * 10/2010 Barufka ..... A63B 5/00 482/121
7,901,338 B2 * 3/2011 Gerschefske ..... A63B 5/00 482/121
7,951,050 B2 5/2011 Raumann
7,967,736 B2 * 6/2011 D'Silva ..... A63B 21/055 122/123
8,430,800 B2 * 4/2013 Nolan ..... A63B 21/023 482/121
8,500,611 B2 * 8/2013 Hoffman ..... A63B 21/055 482/123
8,641,585 B2 * 2/2014 LaGree ..... A63B 21/023 482/92
8,721,511 B2 * 5/2014 Endelman ..... A63B 21/156 482/121
8,834,332 B2 * 9/2014 Campanaro ..... A63B 21/00072 482/131
8,894,551 B2 * 11/2014 Kerdjoudj ..... A63B 21/018 482/70
8,944,970 B2 2/2015 Raumann
8,961,373 B2 * 2/2015 Halver ..... A63B 21/157 482/51
9,022,909 B2 * 5/2015 Kermath ..... A63B 21/00018 482/133
9,072,931 B2 * 7/2015 Lagree ..... A63B 22/0089
9,079,071 B2 * 7/2015 Allain ..... A63B 21/4045
9,180,332 B1 * 11/2015 Tenorio ..... A63B 21/0557
9,283,422 B2 * 3/2016 Lagree ..... A63B 21/0552
9,289,645 B2 * 3/2016 Masterson ..... A63B 21/156
9,393,454 B2 * 7/2016 Lagree ..... A63B 21/025
9,415,253 B2 * 8/2016 Lagree ..... A63B 23/03516
9,579,555 B2 * 2/2017 Lagree ..... A63B 71/0054
9,604,095 B1 * 3/2017 Lagree ..... A63B 21/4035
9,630,056 B2 * 4/2017 Rao ..... A63B 71/0054
9,789,354 B2 * 10/2017 Lagree ..... A63B 22/0023
2001/0036885 A1 11/2001 Castellot
2002/0058573 A1 * 5/2002 Endelman ..... A63B 21/023 482/142
2004/0009849 A1 * 1/2004 Galbraith ..... A63B 21/0552 482/72
2005/0215401 A1 * 9/2005 Wilson ..... A63B 23/12 482/141
2006/0252616 A1 * 11/2006 Gerschefske ..... A63B 5/00 482/142
2008/0287263 A1 * 11/2008 Cheng ..... A63B 21/0087 482/9
2009/0017993 A1 * 1/2009 Khanicheh ..... A63B 21/0056 482/49
2011/0003666 A1 * 1/2011 Raumann ..... A63B 22/0015 482/79
2011/0152036 A1 * 6/2011 Halver ..... A63B 21/157 482/51
2012/0244998 A1 * 9/2012 Rao ..... A63B 71/0054 482/70

(56) References Cited

U.S. PATENT DOCUMENTS

| | | | | |
|---|---|---|---|---|
| 2014/0148316 | A1* | 5/2014 | Tsuchio | A63B 21/0087 482/112 |
| 2015/0065311 | A1* | 3/2015 | Rao | A63B 71/0054 482/70 |
| 2015/0246258 | A1* | 9/2015 | Hockridge | A63B 21/0628 482/99 |

OTHER PUBLICATIONS

Wheel and Wheel, "Wrench Force Micro Mini Pump," no date but admitted as prior art, retrieved on Jun. 9, 2016 from <http://wheelandheel.com/product/wrench-force-micro-mini-pump-2869.htm>.

Bicycle Man, LLC, "XTerra Fitness SB 540r Magnetic ECB Magnetic Recumbent Exercise Bikes," retrieved on Jul. 14, 2016, pp. 1-2, retrieved from <http://www.bicycleman.com/recumbent-exercise-bikes/magnetic-resistance-recumbent.htm>.

Wikipedia, "Eddy Current," Jul. 4, 2016, pp. 1-10, retrieved from <https://en.wikipedia.org/wiki/Eddy_current.

* cited by examiner

EXERCISE DEVICE HAVING DAMPED OSCILLATING FOOT PLATFORMS

CROSS-REFERENCE TO RELATED APPLICATION

This application claims the benefit of priority under 35 U.S.C. 119(e) to U.S. Provisional Patent Application No. 62/144,501, filed Apr. 8, 2015, the entire disclosure of which is hereby incorporated herein by reference.

FIELD OF THE INVENTION

The present invention relates generally to exercise equipment, and more particularly to a compact device for exercising the muscles of the legs while the user is in a seated position.

BACKGROUND

In the modern age many people spend much of their time sitting. They sit at a desk working on a computer, sit on a couch watching TV, sit and read, etc. Consequently, a device that provides exercise while seated is desirable. Ideally, such a device does not unduly distract the user from a primary activity, e.g., working, watching, reading, etc.

One commercially-available device for providing exercise while seated is a pedal exerciser. These devices are basically just the pedals and resistance mechanism of an exercise bicycle without the frame, seat, handle bars, etc. Consequently, the device is usually used by placing it on the floor at the user's feet while they sit on standalone seating. Changing the resistance of a pedal exerciser, however, generally requires a conscious effort by the user. For instance, it may involve turning a knob, pushing "up" or "down" buttons, etc. Alternatively, pedal exercisers that use an electromagnetic resistance mechanism may be programmable. The disadvantage to such an arrangement is that changes in the resistance level may be out of synch with the user's fatigue level.

Furthermore, a pedal exerciser generally provides resistance only while pushing out against the pedals. Consequently, the device primarily exercises only the user's quadriceps and related muscles.

Another result of this arrangement is that using a pedal exerciser usually requires the user to push against a standalone seat with their back. Consequently, using a pedal exerciser, particularly with any sort of vigor, can cause the seat and/or the exerciser to move around. This is particularly problematic for rolling chairs. Also, because the user applies force to the pedals towards the top of each stroke, the exerciser can be unstable. These issues can be mitigated somewhat by using more of a downward (as opposed to outward) force on the pedals. However, this is a somewhat unnatural motion.

In addition, using a pedal exerciser causes considerable vertical movement of the knees. Consequently, although they are often marketed as a way to stay active while seated at a desk or table, pedal exercisers can be awkward, difficult, and sometimes impossible to use under such circumstances.

In addition, pedal exercisers are fairly large and bulky. Consequently, if left under a desk or table when not in use, a pedal exerciser will tend to get in the way of a person's feet and legs during normal desk use. Their bulk can also make them inconvenient to store, transport, etc.

Miniature elliptical trainers are also marketed as a way to exercise while sitting on standalone seating. The primary advantage of a "mini" elliptical trainer over a pedal exerciser is the reduced up and down movement of the knees. This assumes the trainer is used with balls of the feet over the cranks (opposite the way it's normally used when standing up). Even then, however, the heels are at or near the height of the crank axle which can still cause knee clearance issues when using the trainer while seated at a table or desk.

Also, because of the combination of cranks and generally horizontal foot platforms, mini-elliptical trainers tend to encourage more of a downward (as opposed to outward) force. As mentioned above, this can somewhat mitigate push-back against the seat and instability of the trainer. However, it's similarly a somewhat unnatural motion. In addition, a mini elliptical trainer still has the resistance and bulk issues discussed above.

There have been recent attempts to address some of the above shortcomings. For instance, U.S. Published Patent Application No. 2001/0036885 for a "Compact Shuffle Leg Exerciser" describes two platforms, one for each foot, riding on parallel rails within a frame. The user then sits on a standalone seat and with their feet on the platforms moves their feet and lower legs back and forth in a scissor-type motion. This eliminates the up-and-down movement of the knees and significantly reduces the bulk of the device. However, the device described still has some shortcomings.

In the application referenced above, one of the ways resistance to movement of the foot platforms is provided is by a screw-type mechanism that increases the friction between the platforms and the rails. As with pedal and elliptical exercisers of a non-programmable variety, this requires manual adjustment of the resistance. It also can cause considerable wear and tear on the device.

Furthermore, the force to move the foot platforms forward and backward results in an equal but opposing force against the user's seat. As with pedal and elliptical exercisers, these opposing forces tend to cause the seat and/or exercise device to move around during use.

The application referenced above also provides for resistance to movement of the foot platforms by connecting them to the frame via elastic elements (see FIG. 14 of the application referenced above). However, because the frame is anchoring the elastic elements, this arrangement has the same tendency to cause the seat and/or exercise device to move around during use.

In addition, to allow for sufficient travel of the foot platforms, the elastic elements must have a fairly long relaxed length. This is also important to maximize the longevity of the elastic elements. Consequently, the device must be sized or otherwise designed to accommodate this length, though this issue isn't addressed in the above application.

Furthermore, the elastic elements connecting the foot platforms to the frame run in a lengthwise direction, i.e. parallel with the rails. Consequently, the force they exert in a lengthwise direction tends to increase and decrease at a steady rate. This isn't an issue when pushing or pulling only, i.e. when only working against elastic elements connected to one end or the other of the frame. However, moving one's feet and lower legs back and forth in a scissor-type motion involves repeatedly alternating between pushing against one set of elastic elements, i.e. those connecting the foot platforms to the end of the device closest to the user, then having those same elements pull one's feet and lower legs back toward the middle of the device, immediately followed by pulling against another set of elastic elements, i.e. those connecting the platforms to the end of the device furthest from the user, then having those same elements pull one's feet forward toward the middle of the device. Consequently, having the force exerted by the elastic elements increase and decrease at a steady rate tends to lead to an uneven motion as the user scissors their feet and lower legs back and forth.

U.S. Pat. No. 8,500,611 for a "Dual Track Exercise Device" describes a device that's similar in construction to that described in U.S. Published Patent Application No. 2001/0036885. However, it's larger in size and generally geared more towards a range of targeted exercises. This device is marketed by Balanced Body, Inc. as the CoreAlign.

U.S. Pat. No. 7,951,050 for an "Apparatus for Aerobic Leg Exercise of a Seated User" describes a device that's also similar in construction to that described in U.S. Published Patent Application No. 2001/0036885. However, it eschews any type of resistance mechanism. Rather, it is designed for "non-resistive movement" as opposed to exercise per se.

U.S. Pat. No. 5,807,212 for a "Leg Exerciser Particularly Adapted for Use Under Desks" describes a device with "pedals" configured to move in a linear fashion. Various mechanisms oriented parallel to the movement of the pedals are proposed to provide resistance. However, because of this orientation, the resistance increases in a rather steep linear fashion. Furthermore, the device provides resistance only while pushing out against the pedals. Consequently, the device exercises only the quadriceps and related muscles. Among other things, this focus on the quadriceps causes particularly pronounced pushback against the seat. The patent referenced above addresses this drawback by including an anchor system to connect the user's chair to the exercise device. The anchor system also helps mitigate any instability caused by having the pedals well above the base. However, this adds to the expense and bulk of the device. It also makes set-up of the device more elaborate, thereby making the device less convenient to move from place to place.

SUMMARY

The present invention provides an oscillating exercise device. In one embodiment, the device comprises: a rigid frame extending in a longitudinal direction, and defining a pair of adjacent and longitudinally-extending raceways; a pair of platforms supported on the frame, each of said pair of platforms being supported for translational movement within a respective one of said pair of raceways; at least one resilient member having first and second ends, the first end being joined to one of said pair of platforms, and the second end being joined to the other of said pair of platforms to resist translational movement of said pair of platforms; and at least one damper having first and second ends, the first end being joined to one of said pair of platforms, and the second end being joined to the other of said pair of platforms to resist resiling of said resilient member.

Thus, the exercise device includes two foot platforms riding on two sets of elongated rails extending longitudinally, e.g., in a substantially parallel configuration. The platforms and rails are designed to minimize lateral movement of the platforms. The platforms are directly connected to each other by one or more elastic elements. One or more dampers are installed roughly parallel with the elastic elements to oppose the energy return of the elastic elements. When the two platforms are side-by-side, the elastic elements and dampers run in a substantially crosswise direction.

The device is placed on the floor at the feet of a seated user. With feet placed on the platforms, the user then scissors his/her feet and lower legs back and forth. In so doing, the user overcomes the resistance of the elastic elements and dampers connecting the platforms. This provides the user with exercise and its accompanying benefits.

BRIEF DESCRIPTION OF THE DRAWINGS

The present invention will now be described by way of example with reference to the following drawings in which.

DETAILED DESCRIPTION

Figure 1:
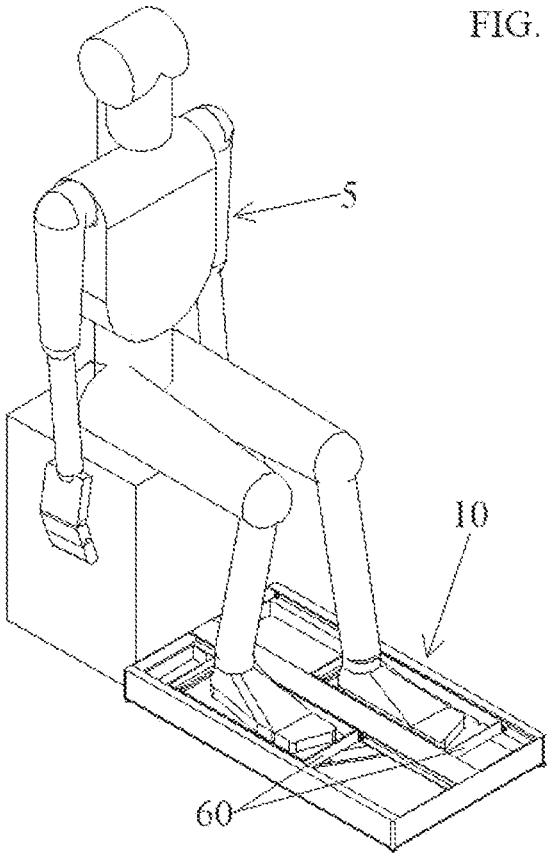
FIG. 1 is an isometric view of the invention in use.

FIG. 1 shows a user 5 seated on standalone seating with the oscillating exercise device 10 on the floor in front of them. The user has his feet on the foot platforms and is in the process of moving his feet and lower legs in a continuous scissor-like motion.

Figure 2:
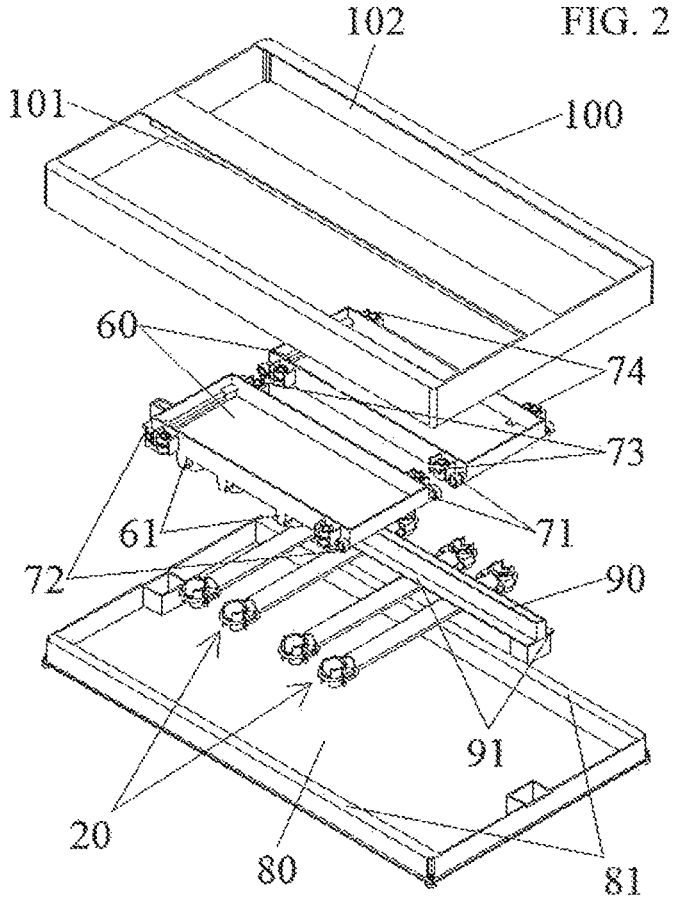
FIG. 2 is an exploded isometric view of the invention.

FIG. 2 is an exploded isometric view of the invention showing the foot platforms 60, bosses 61, and resistance mechanisms 20. Also shown are the inner support bearings 71, outer support bearings 72, inner guide bearings 73, and outer guide bearings 74. Also shown is the middle support 90, middle support horizontal bearing surfaces 91, the lower frame 80, lower frame horizontal bearing surfaces 81, the upper frame 100, one of the inner vertical bearing surfaces 101, and one of the outer vertical bearing surfaces 102.

Figure 3:
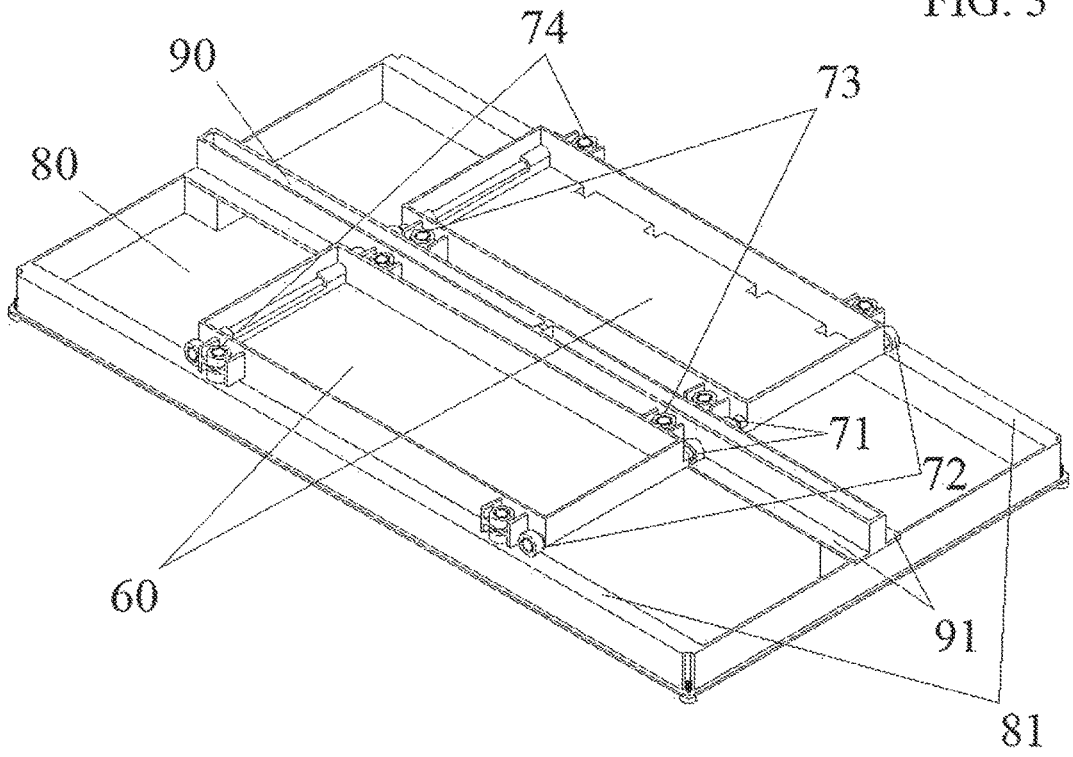
FIG. 3 is an isometric view of the invention with the upper frame removed.

FIG. 3 is an isometric view of the invention with the upper frame removed showing the foot platforms 60, the inner support bearings 71, outer support bearings 72, inner guide bearings 73, and outer guide bearings 74. Also shown are the middle support 90, middle support horizontal bearing surfaces 91, the lower frame 80, and lower frame horizontal bearing surfaces 81.

Figure 4:
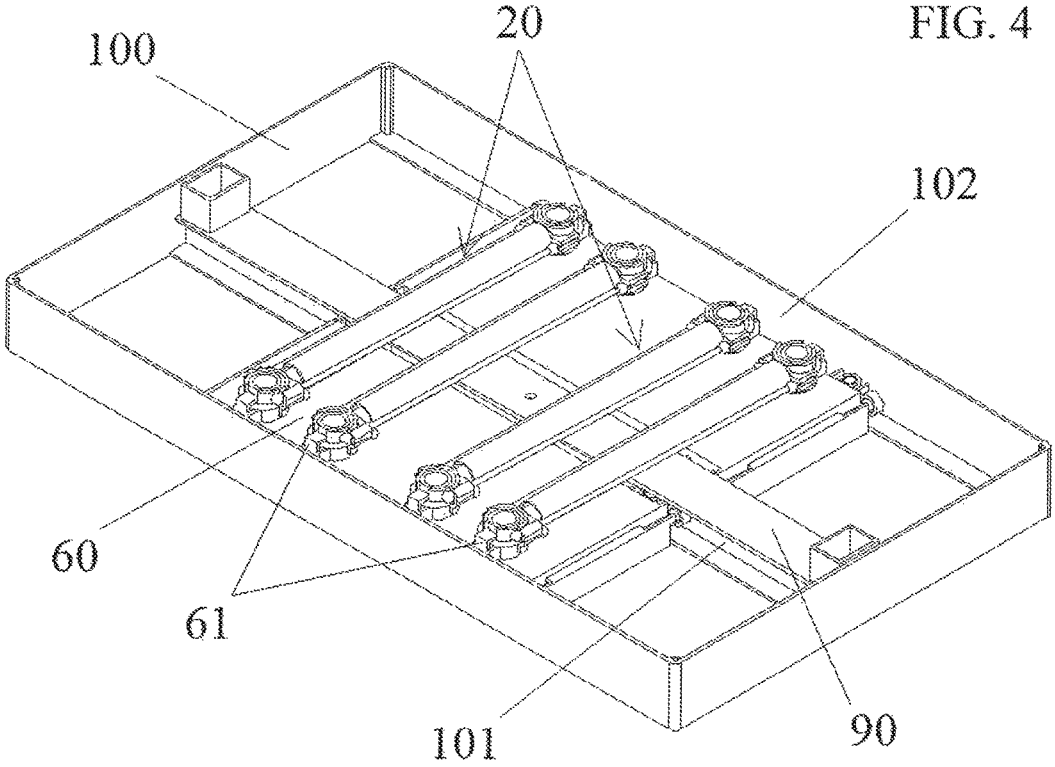
FIG. 4 is an isometric view of the underside of the invention with the lower frame removed.

FIG. 4 is an isometric view of the underside of the invention with the lower frame removed showing the foot platforms 60, bosses 61, and resistance mechanisms 20. Also shown is the upper frame 100, one of the inner vertical bearing surfaces 101, and one of the outer vertical bearing surfaces 102. The middle support 90 is also shown.

Figure 5:
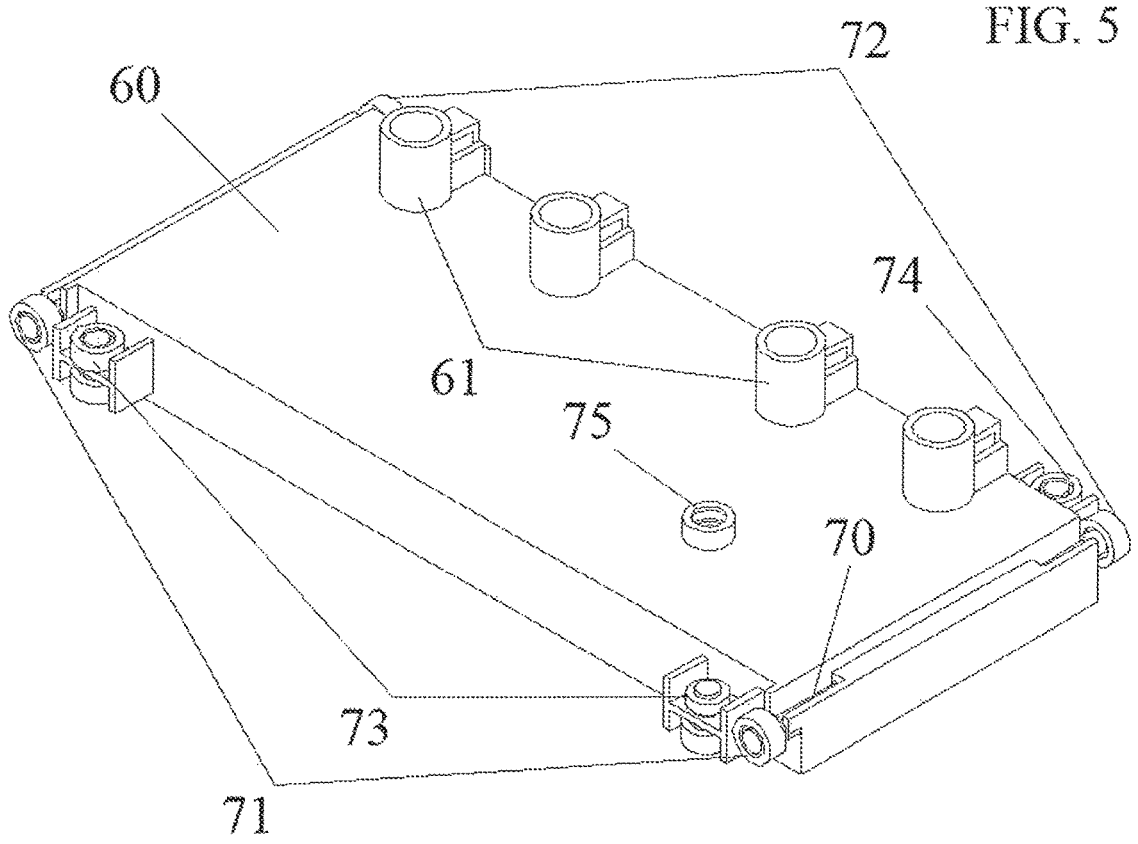
FIG. 5 is an isometric view of the underside of one of the foot platforms.

FIG. 5 is an isometric view of the underside of one of the foot platforms 60 showing the bosses 61, inner support bearings 71, outer support bearings 72, inner guide bearings 73, and outer guide bearings 74. Also shown is one of the axles 70 and one of the sheaths 75.

Figure 6:
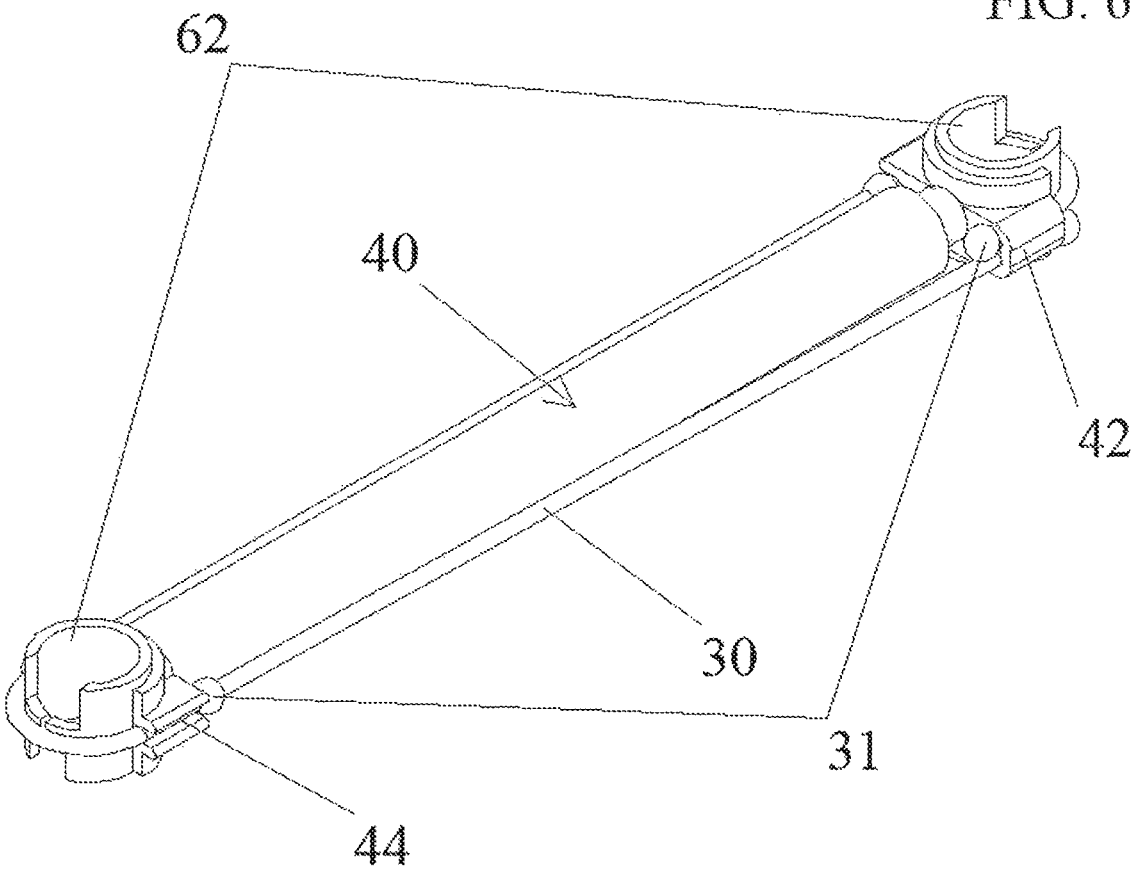
FIG. 6 is an isometric view of one of the resistance mechanisms.

FIG. 6 is an isometric view of one of the resistance mechanisms 20 showing shock cord 30, shock cord stops 31, a dashpot 40, inner tube end piece 42, outer tube end piece 44, and boss sleeves 62.

Figure 7:
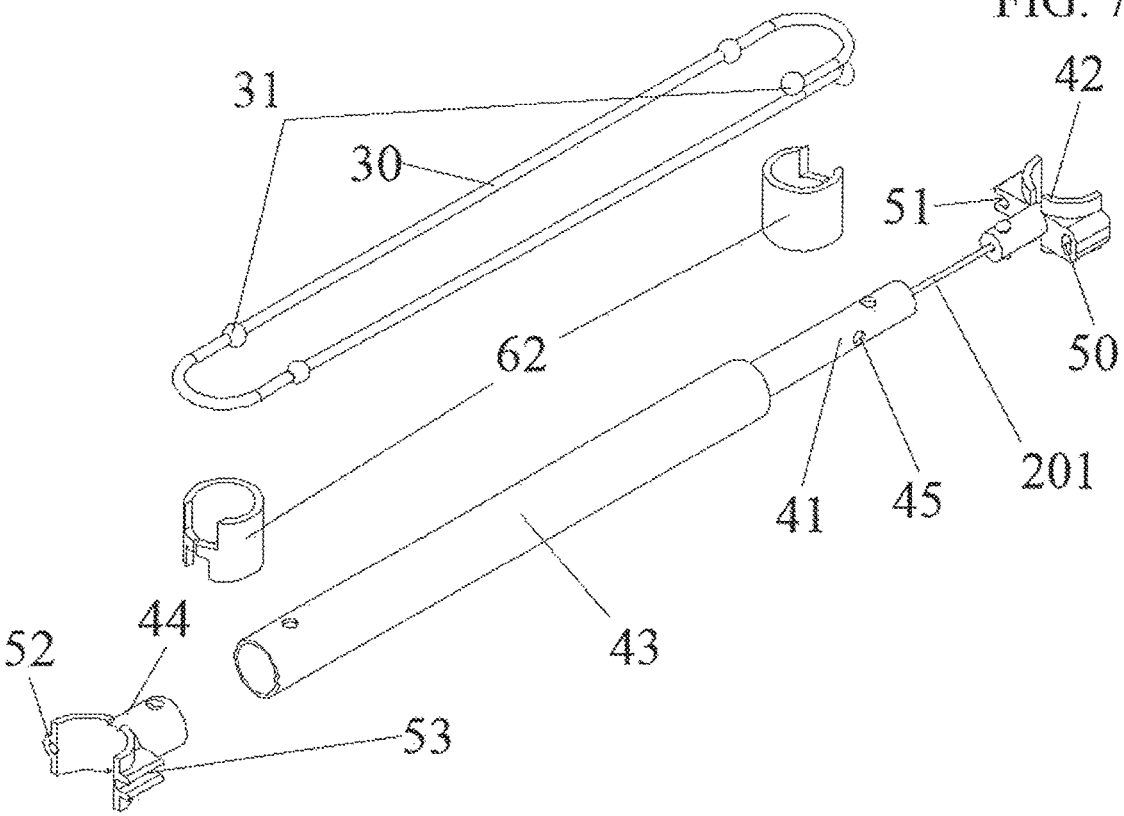
FIG. 7 is an exploded isometric view of one of the resistance mechanisms.

FIG. 7 is an exploded isometric view of one of the resistance mechanisms 20 showing shock cord 30, shock cord stops 31, an inner tube 41, an inner tube end piece 42, an inner tube end piece elongated hole 50, an inner tube end piece notch 51, an outer tube 43, an outer tube end piece 44, an outer tube end piece hole 52, an outer tube end piece notch 53, and boss sleeves 62. Also shown are an inner tube air inlet 45 and a strand of valve shock cord 201.

Figure 8:
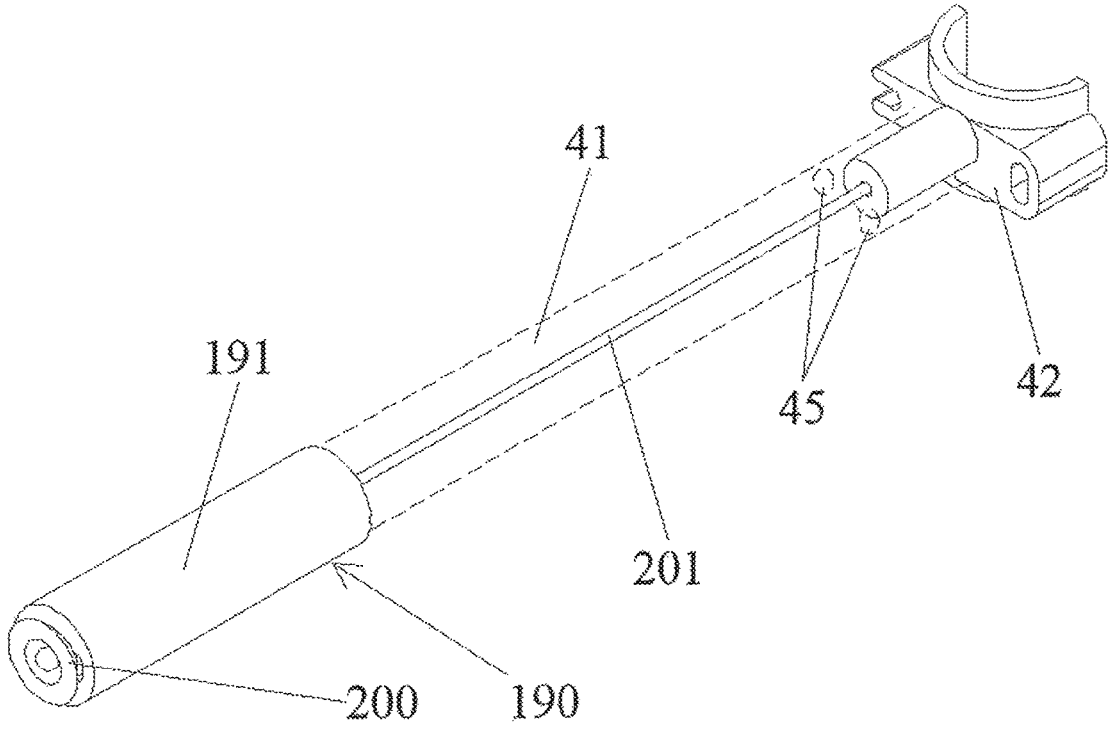
FIG. 8 is an isometric view of one of the valves and associated inner tube (dashed line)

FIG. 8 is an isometric view of one of the valves 190 and associated inner tube 41 (dashed line) showing the valve body 191, conical valve member 200, valve shock cord 201, inner tube air inlets 45, and inner tube end piece 42.

Figure 9:
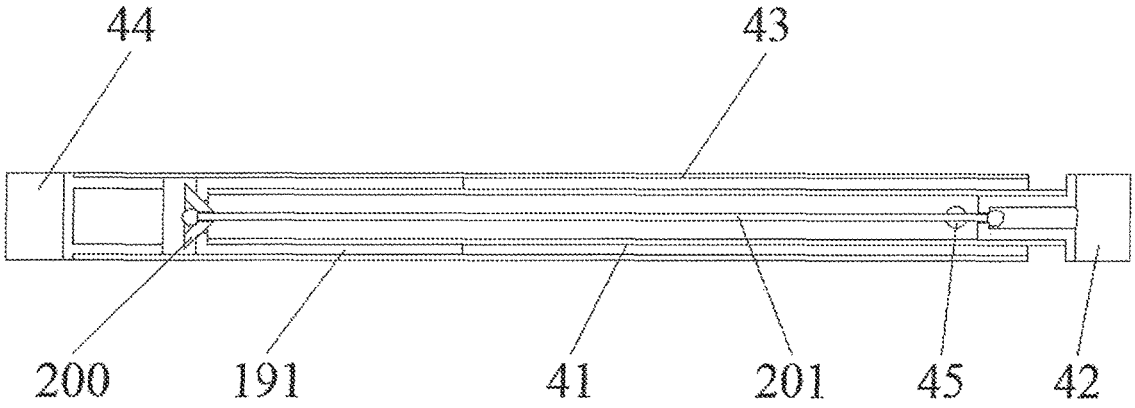
FIG. 9 is a sectional view of one of the valves and associated dashpots.

FIG. 9 is a sectional view of one of the valves and associated dashpots showing the valve body 191, conical valve member 200, valve shock cord 201, one of the inner tube air inlets 45, inner tube 41, inner tube end piece 42, outer tube 43, and outer tube end piece 44.

Figure 10A:
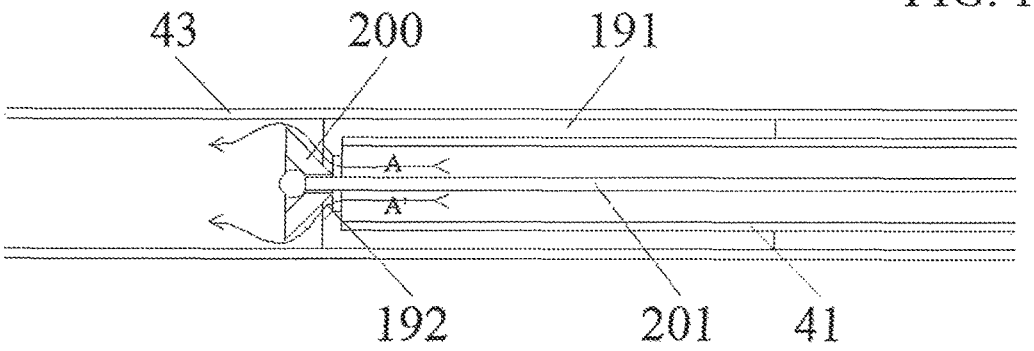
FIG. 10A is an enlarged sectional view of one of the valves in an open position.

FIG. 10A is a sectional view of one of the valves in an open position showing the valve body 191, valve opening 192, conical valve member 200, valve shock cord 201, inner tube 41, and outer tube 43. Also shown are lines A and A' which show the path of the air as it flows into the outer tube.

Figure 10B:
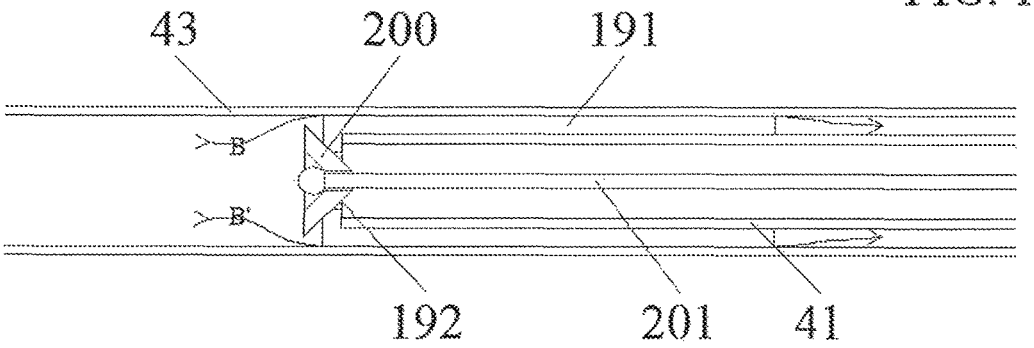
FIG. 10B is an enlarged sectional view of one of the valves in a closed position.

FIG. 10B is a sectional view of one of the valves in a closed position showing the valve body 191, valve opening 192, conical valve member 200, valve shock cord 201, inner tube 41, and outer tube 43. Also shown are lines B and B' which show the path of the air flow as it flows out of the outer tube.

Figure 11:
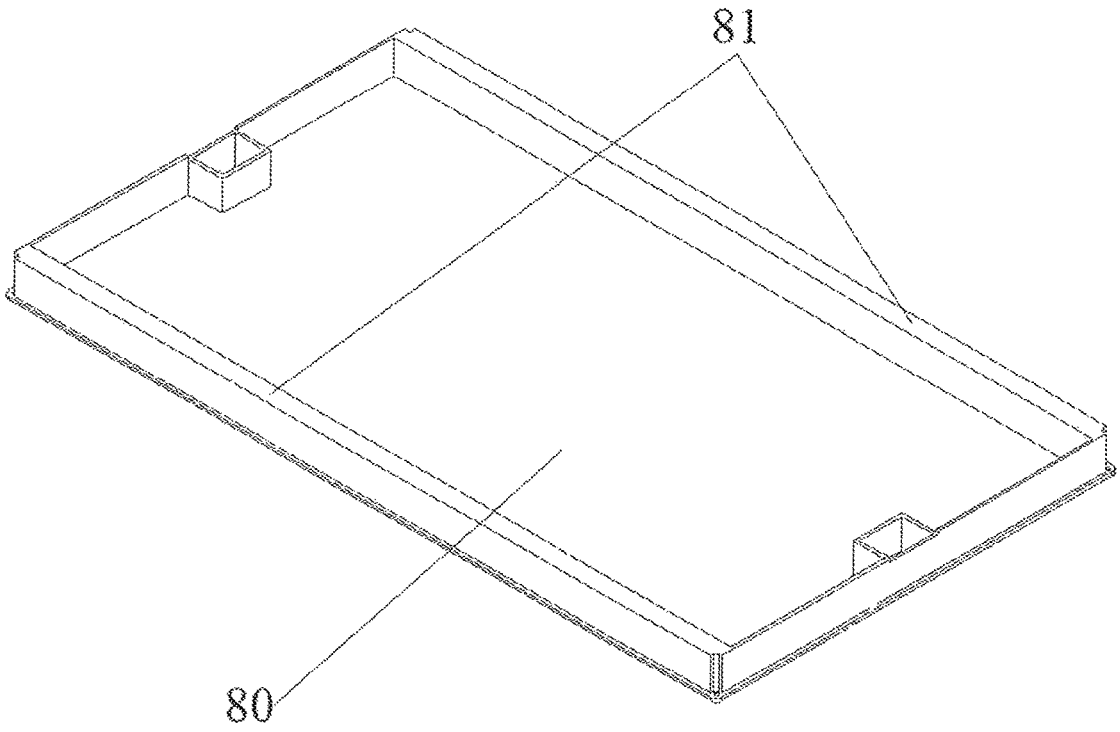
FIG. 11 is an isometric view of the lower frame.

FIG. 11 is an isometric view of the lower frame 80 showing the lower frame horizontal bearing surfaces 81.

Figure 12:
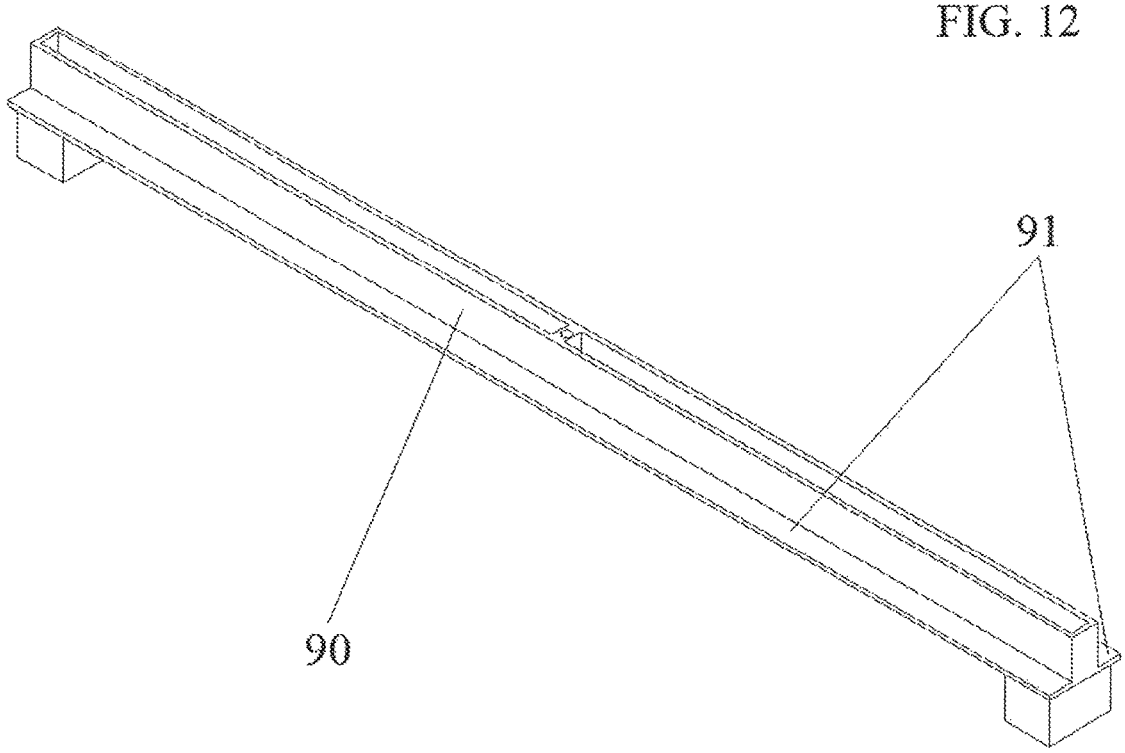
FIG. 12 is an isometric view of the middle support.

FIG. 12 is an isometric view of the middle support 90 showing the middle support horizontal bearing surfaces 91.

Figure 13:
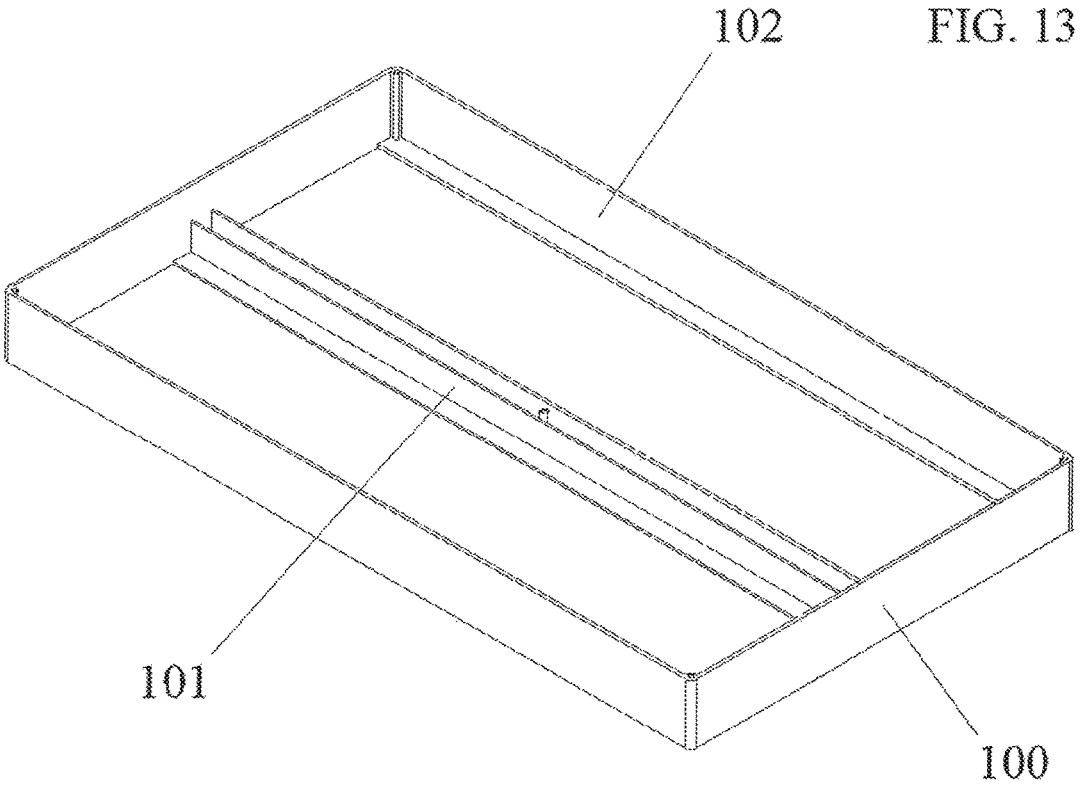
FIG. 13 is an isometric view of the underside of the upper frame.

FIG. 13 is an isometric view of the underside of the upper frame 100 showing one of the inner vertical bearing surfaces 101 and one of the outer vertical bearing surfaces 102.

FIGS. 14 through 22A represent stages in a continuous scissor-like movement of the user's legs.

Figure 14:
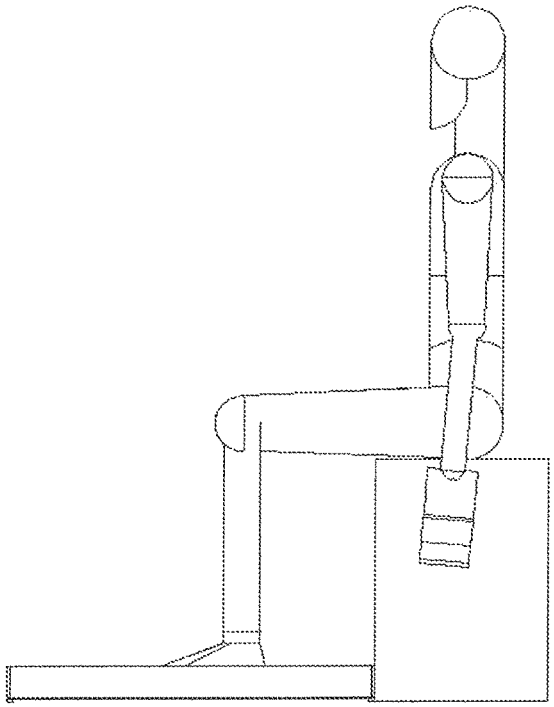
FIG. 14 is a side view of the invention in use with the foot platforms side-by-side.

FIG. 14 shows the user with his leg muscles in a generally relaxed state. Consequently the foot platforms are pulled alongside one another by the elasticity of the shock cord.

Figure 14A:
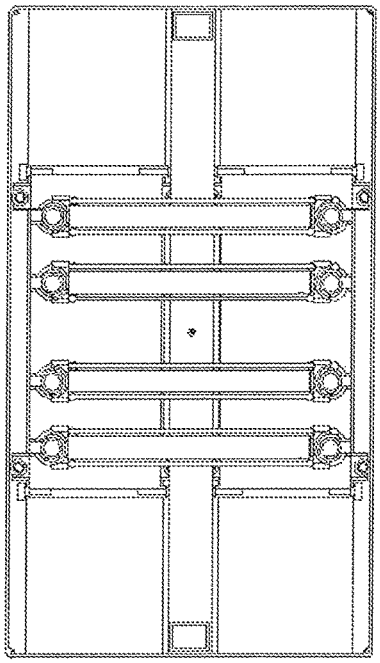
FIG. 14A is a view of the underside of the invention as shown in FIG. 14 with the lower frame removed.

FIG. 14A shows the foot platforms pulled alongside one another and the substantially crosswise orientation of the shock cord and dashpots. From the user's perspective, the side of the device farthest from the figure is the left side whereas that nearest the figure is the right side.

Figure 15:
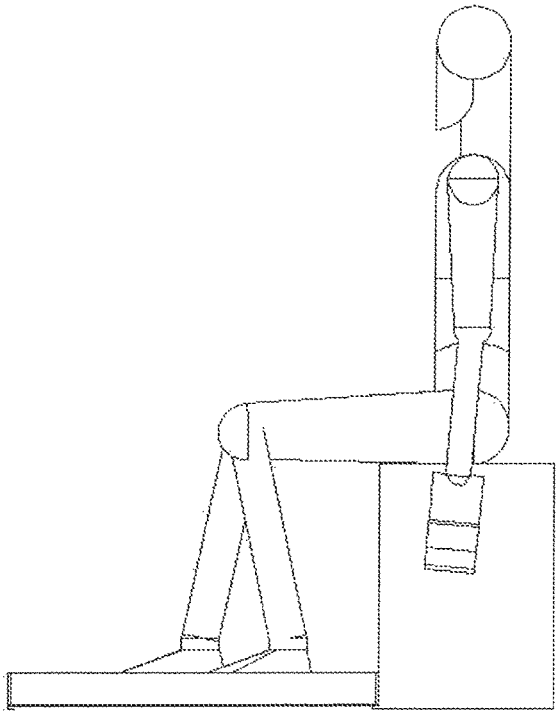
FIG. 15 is a side view of the invention in use with the user forcing the platforms partially apart, showing the right foot in front of the left foot.

FIG. 15 shows the user contracting his right quadriceps and related muscles while simultaneously contracting his left hamstrings and related muscles. Consequently, the user pushes the right platform partially outward while pulling the left platform partially inward. This has the effect of partially separating the foot platforms in opposition to the elasticity of the shock cord while also partially extending the dashpots.

Figure 15A:
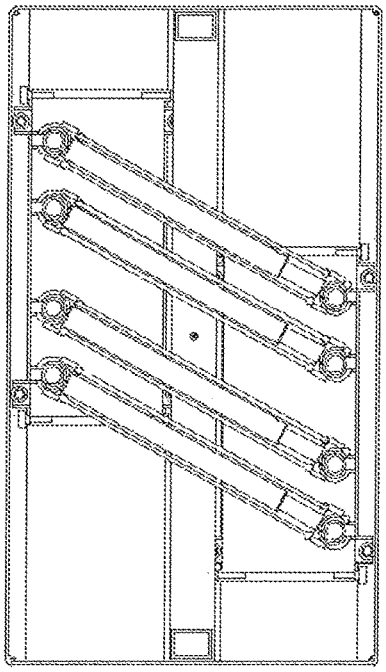
FIG. 15A is a view of the underside of the invention as shown in FIG. 15 with the lower frame removed.

FIG. 15A shows the foot platforms partially separated and the angular orientation of the shock cord and dashpots relative to the direction of travel of the foot platforms. From the user's perspective, the side of the device farthest from the figure is the left side whereas that nearest the figure is the right side.

Figure 16:
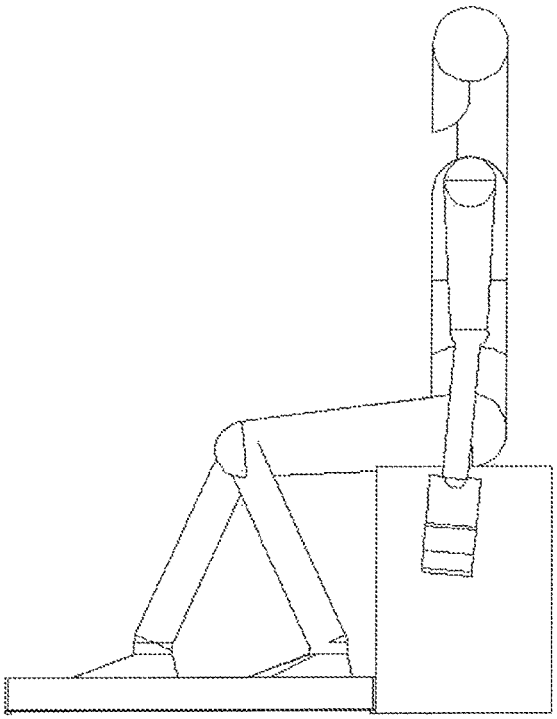
FIG. 16 is a side view of the invention in use with the user forcing the platforms fully apart, showing the right foot in front of the left foot.

FIG. 16 shows the user further contracting his right quadriceps and related muscles while simultaneously further contracting his left hamstrings and related muscles. Consequently, the user pushes the right platform fully outward while pulling the left platform fully inward. This has the effect of fully separating the foot platforms in opposition to the elasticity of the shock cord while also fully extending the dashpots.

Figure 16A:
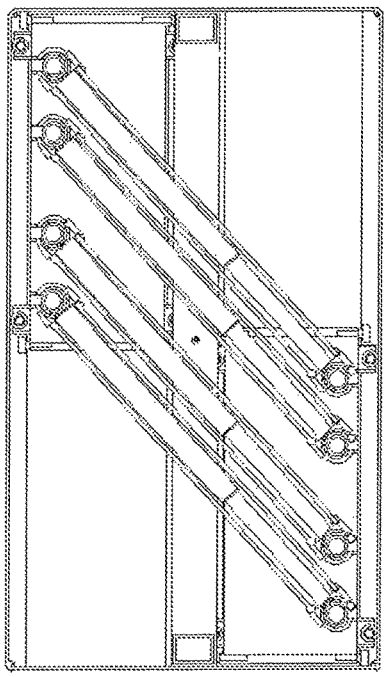
FIG. 16A is a view of the underside of the invention as shown in FIG. 16 with the lower frame removed.

FIG. 16A shows the foot platforms fully separated and the further angular orientation of the shock cord and dashpots relative to the direction of travel of the foot platforms. From the user's perspective, the side of the device farthest from the figure is the left side whereas that nearest the figure is the right side.

Figure 17:
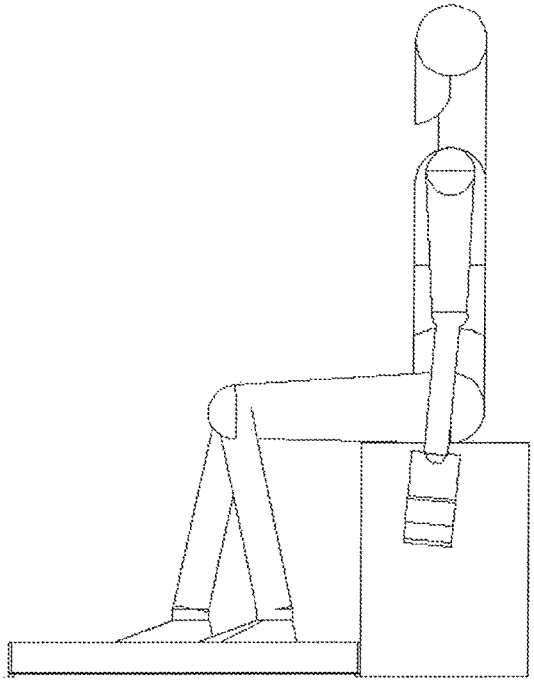
FIG. 17 is a side view of the invention in use with the elastic pulling the platforms partially together, showing the right foot in front of the left foot.

FIG. 17 shows the user partially relaxing his right quadriceps and related muscles while simultaneously partially relaxing his left hamstrings and related muscles. This allows the elasticity of the shock cord to overcome the resistance of the dashpots and pull the foot platforms toward one another until they are again only partially separated.

Figure 17A:
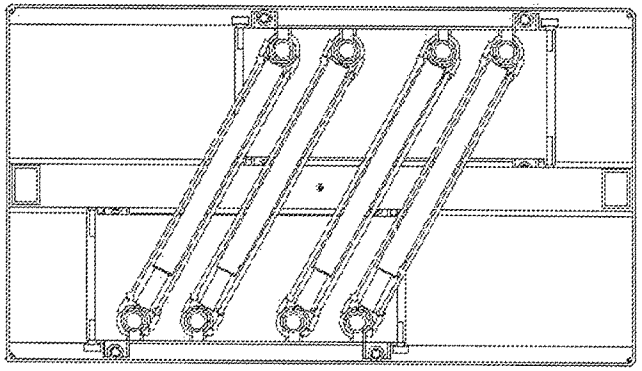
FIG. 17A is a view of the underside of the invention as shown in FIG. 17 with the lower frame removed.

FIG. 17A shows the foot platforms partially separated and the angular orientation of the shock cord and dashpots relative to the direction of travel of the foot platforms. From the user's perspective, the side of the device farthest from the figure is the left side whereas that nearest the figure is the right side.

Figure 18:
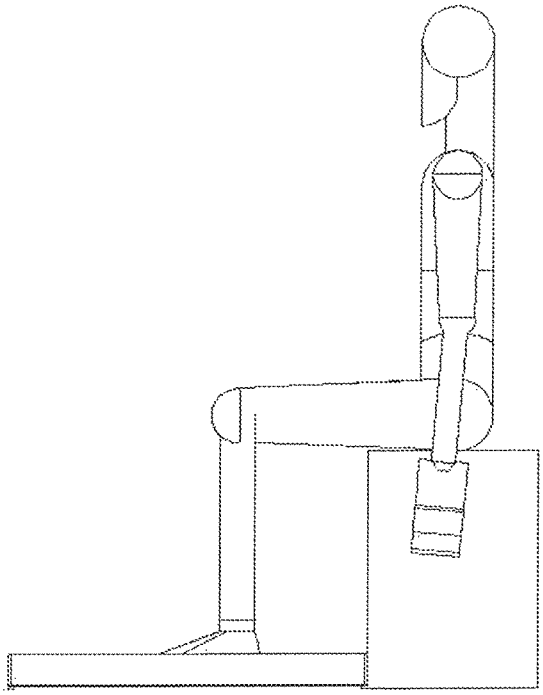
FIG. 18 is a side view of the invention in use with the foot platforms side-by-side.

FIG. 18 shows the user with his leg muscles in a generally relaxed state. Consequently, the foot platforms are pulled alongside one another by the elasticity of the shock cord overcoming the resistance of the dashpots.

Figure 18A:
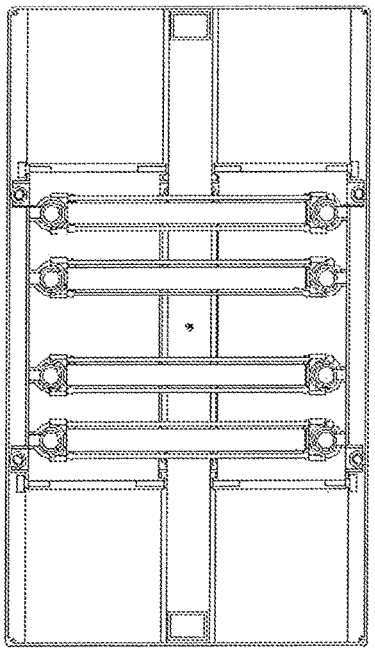
FIG. 18A is a view of the underside of the invention as shown in FIG. 18 with the lower frame removed.

FIG. 18A shows the foot platforms pulled alongside one another and the substantially crosswise orientation of the shock cord and dashpots. From the user's perspective, the side of the device farthest from the figure is the left side whereas that nearest the figure is the right side.

Figure 19:
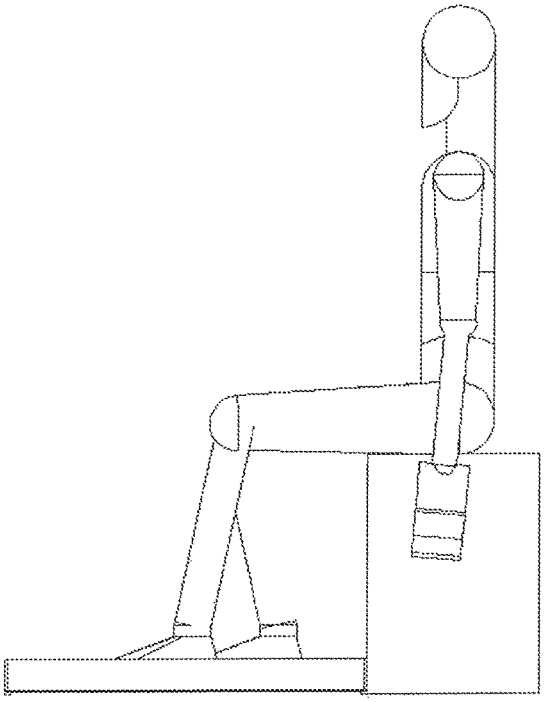
FIG. 19 is a side view of the invention in use with the user forcing the platforms partially apart, showing the left foot in front of the right foot.

FIG. 19 shows the user contracting his left quadriceps and related muscles while simultaneously contracting his right hamstrings and related muscles. Consequently, the user pushes the left platform partially outward while pulling the right platform partially inward. This has the effect of partially separating the foot platforms in opposition to the elasticity of the shock cord while also partially extending the dashpots.

Figure 19A:
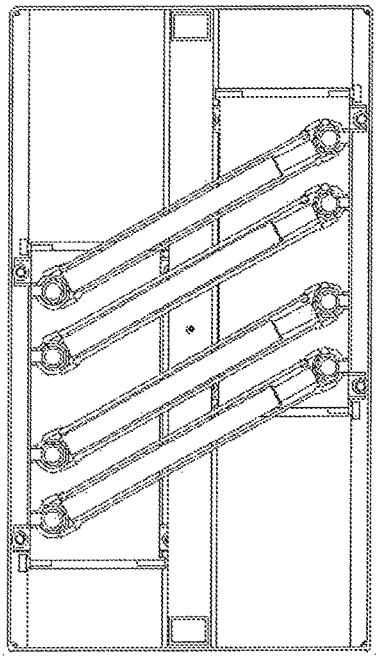
FIG. 19A is a view of the underside of the invention as shown in FIG. 19 with the lower frame removed.

FIG. 19A shows the foot platforms partially separated and the angular orientation of the shock cord and dashpots relative to the direction of travel of the foot platforms. From the user's perspective, the side of the device farthest from the figure is the left side whereas that nearest the figure is the right side.

Figure 20:
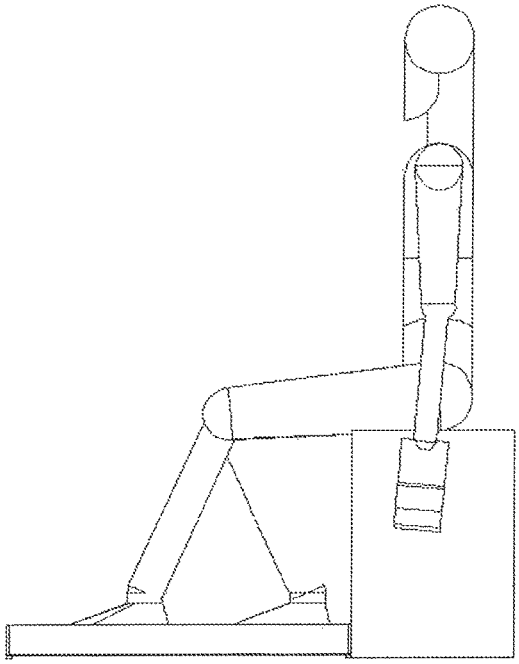
FIG. 20 is a side view of the invention in use with the user forcing the platforms fully apart, showing the left foot in front of the right foot.

FIG. 20 shows the user further contracting his left quadriceps and related muscles while simultaneously further contracting his right hamstrings and related muscles. Consequently, the user pushes the left platform fully outward while pulling the right platform fully inward. This has the effect of fully separating the foot platforms in opposition to the elasticity of the shock cord while also fully extending the dashpots.

Figure 20A:
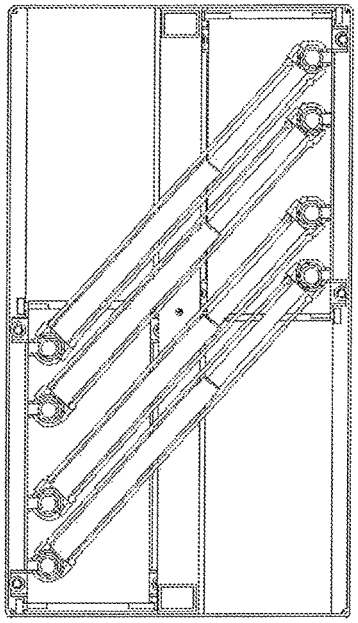
FIG. 20A is a view of the underside of the invention as shown in FIG. 20 with the lower frame removed.

FIG. 20A shows the foot platforms fully separated and the further angular orientation of the shock cord and dashpots relative to the direction of travel of the foot platforms. From the user's perspective, the side of the device farthest from the figure is the left side whereas that nearest the figure is the right side.

Figure 21:
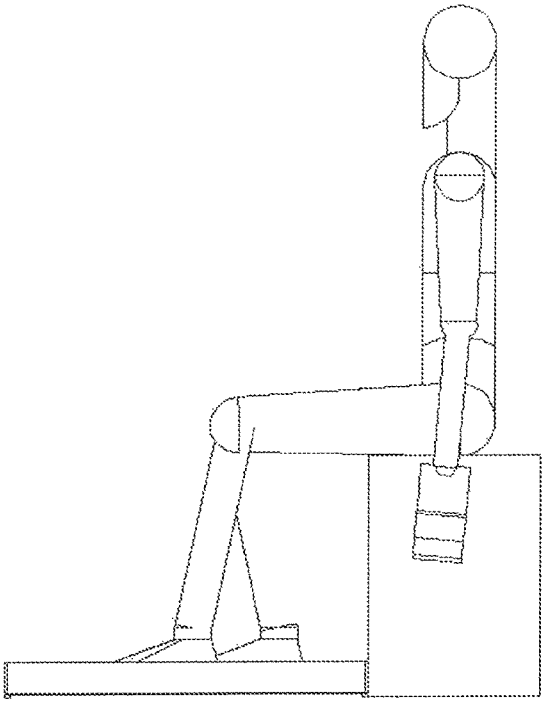
FIG. 21 is a side view of the invention in use with the elastic pulling the platforms partially together, showing the left foot in front of the right foot.

FIG. 21 shows the user partially relaxing his left quadriceps and related muscles while simultaneously partially relaxing his right hamstrings and related muscles. This allows the elasticity of the shock cord to overcome the resistance of the dashpots and pull the foot platforms toward one another until they are again only partially separated.

Figure 21A:
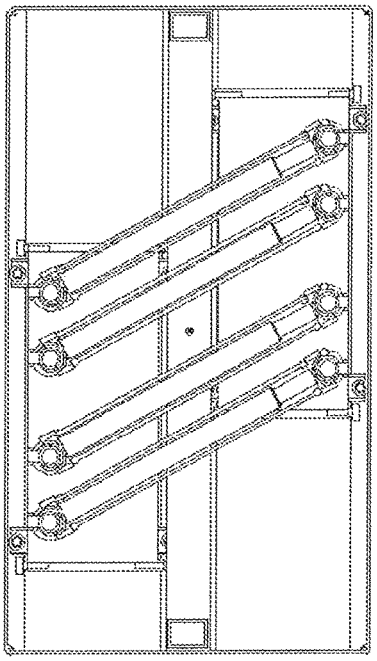
FIG. 21A is a view of the underside of the invention as shown in FIG. 21 with the lower frame removed.

FIG. 21A shows the foot platforms partially separated and the angular orientation of the shock cord and dashpots relative to the direction of travel of the foot platforms. From the user's perspective, the side of the device farthest from the figure is the left side whereas that nearest the figure is the right side.

Figure 22:
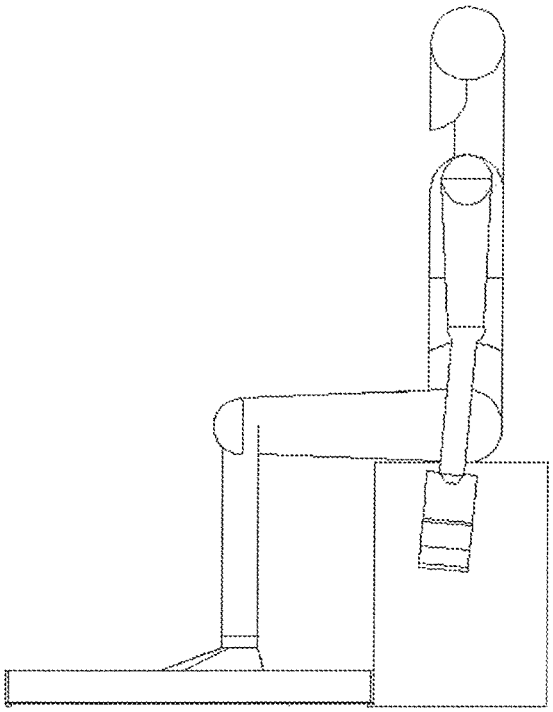
FIG. 22 is a side view of the invention in use with the foot platforms side-by-side.

FIG. 22 shows the user with his leg muscles in a generally relaxed state. Consequently, the foot platforms are pulled alongside one another by the elasticity of the shock cord overcoming the resistance of the dashpots.

Figure 22A:
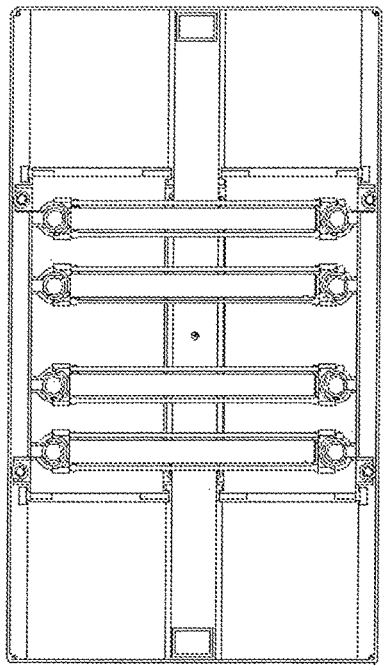
FIG. 22A is a view of the underside of the invention as shown in FIG. 22 with the lower frame removed.

FIG. 22A shows the foot platforms pulled alongside one another and the substantially crosswise orientation of the shock cord and dashpots. From the user's perspective, the side of the device farthest from the figure is the left side whereas that nearest the figure is the right side.

Figure 23:
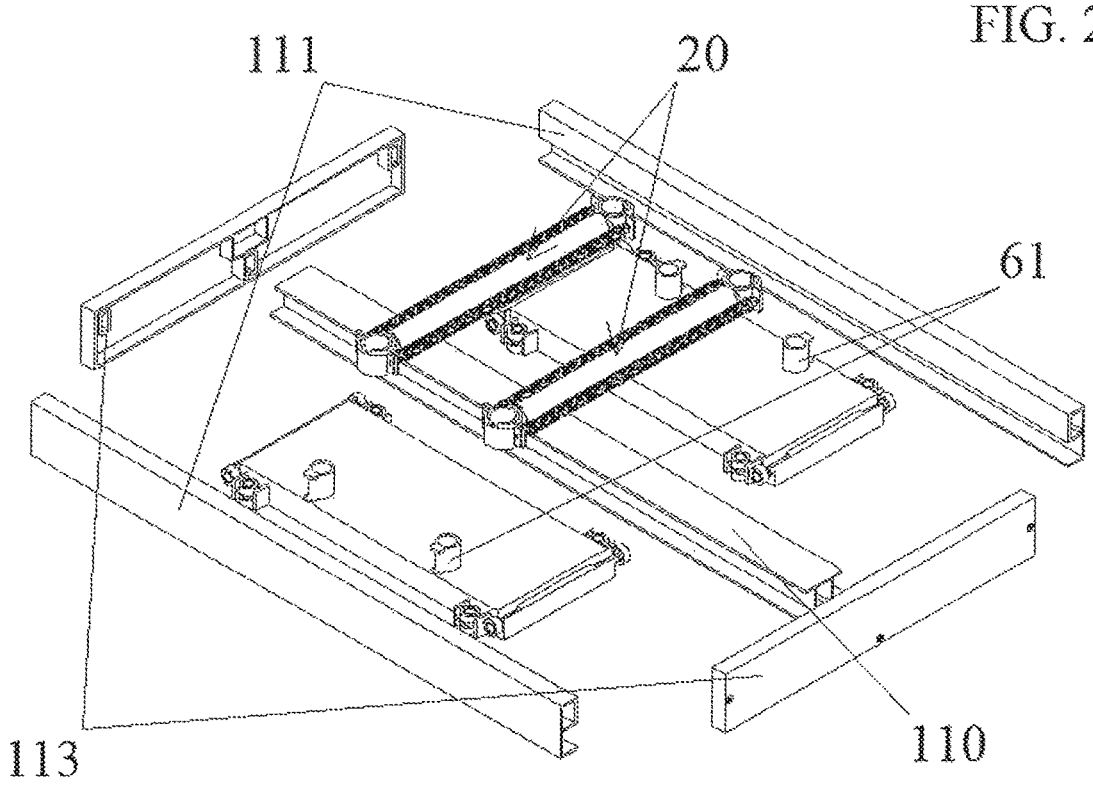
FIG. 23 is an exploded isometric view of the underside of a second embodiment of an exercise device in accordance with the present invention.

FIG. 23 is an exploded isometric view of the underside of a second embodiment of the invention showing an inner rail 110, two outer rails 111, and end supports 113. Also shown are a pair of resistance mechanisms 20 and corresponding bosses 61.

Figure 24:
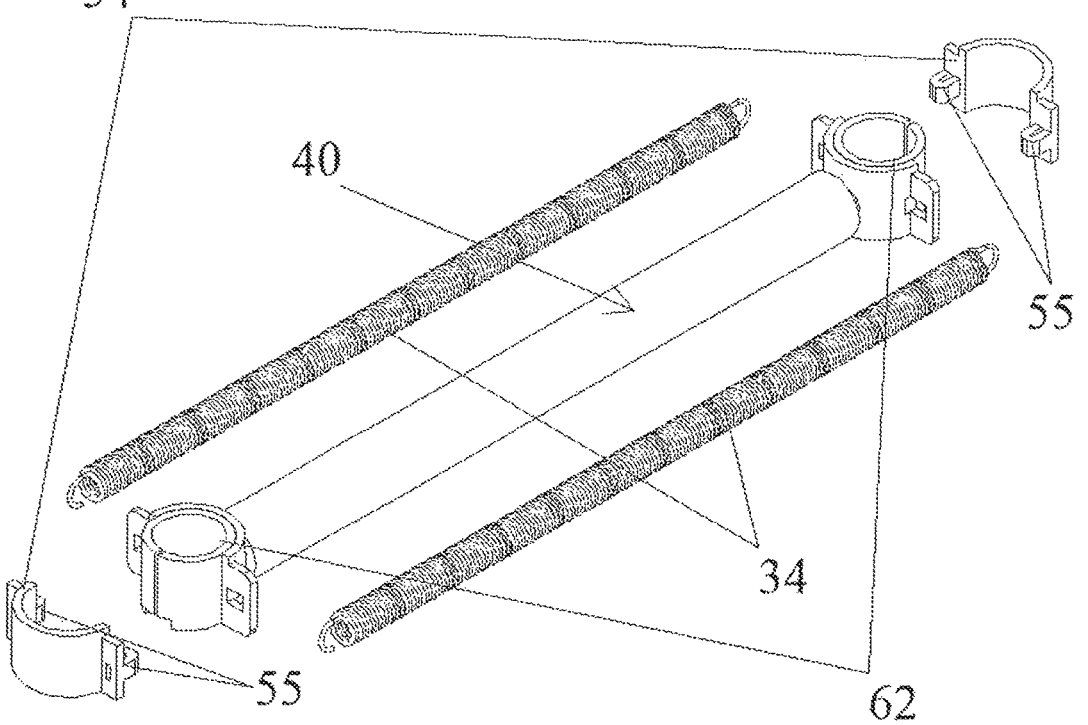
FIG. 24 is a partially exploded isometric view of the resistance mechanism of the exercise device of FIG. 23.

FIG. 24 is a partially exploded isometric view of the resistance mechanism of FIG. 23 showing extension springs 34, a dashpot 40, end piece brackets 54, end piece bracket extensions 55, and boss sleeves 62.

Figure 25:
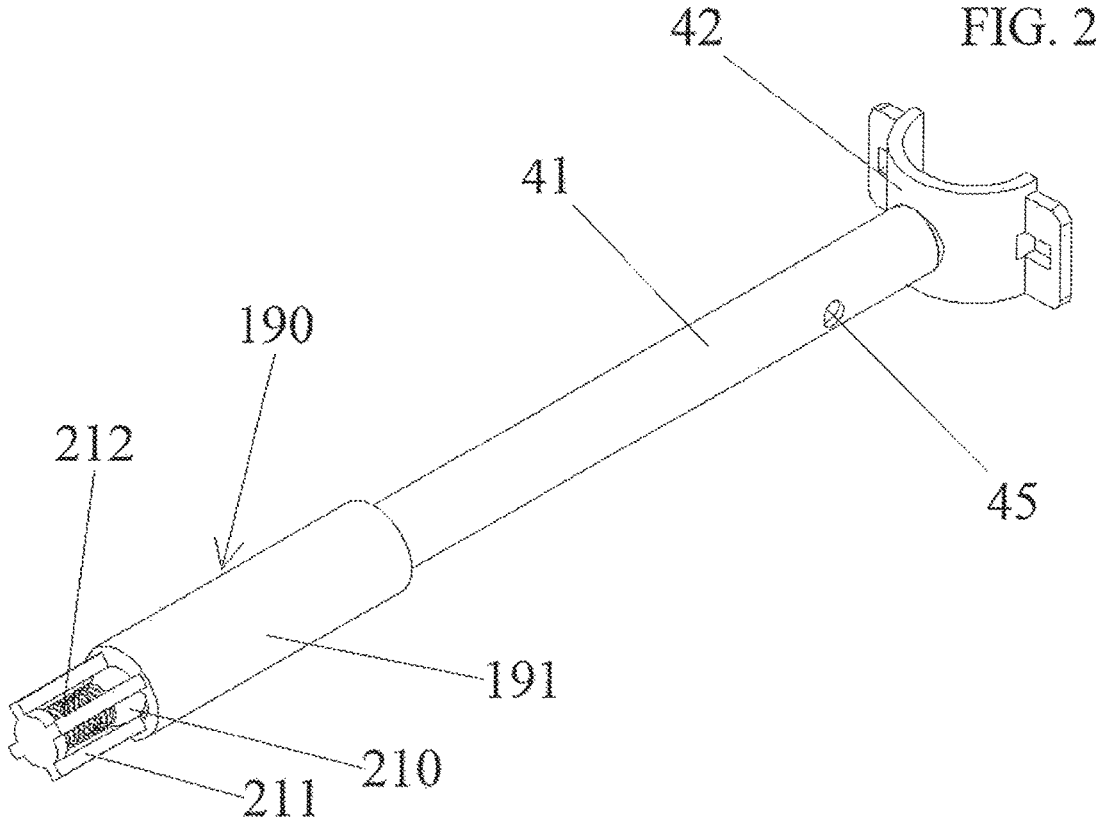
FIG. 25 is an isometric view of one of the valves and associated inner tube of the exercise device of FIG. 23.

FIG. 25 is an isometric view of one of the valves 190 and associated inner tube 41 of the exercise device of FIG. 23 showing the valve body 191, valve body cage 211, spherical valve member 210, compression spring 212, inner tube air inlet 45, and inner tube end piece 43.

Figure 26:
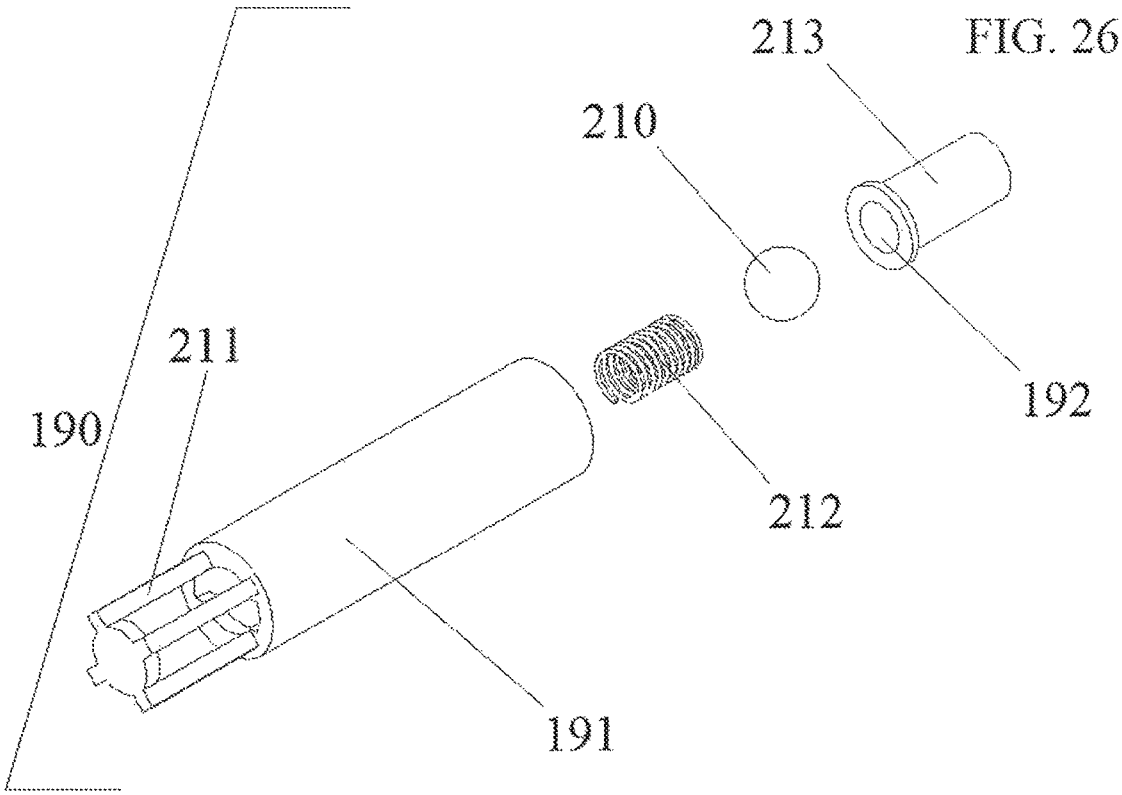
FIG. 26 is an exploded isometric view one of the valves of the exercise device of FIG. 23.

FIG. 26 is an exploded isometric view one of the valves 190 of the exercise device of FIG. 23 showing the valve body 191, valve body cage 211, spherical valve member 210, compression spring 212, valve inner sleeve 213, and valve opening 192.

Figure 27:
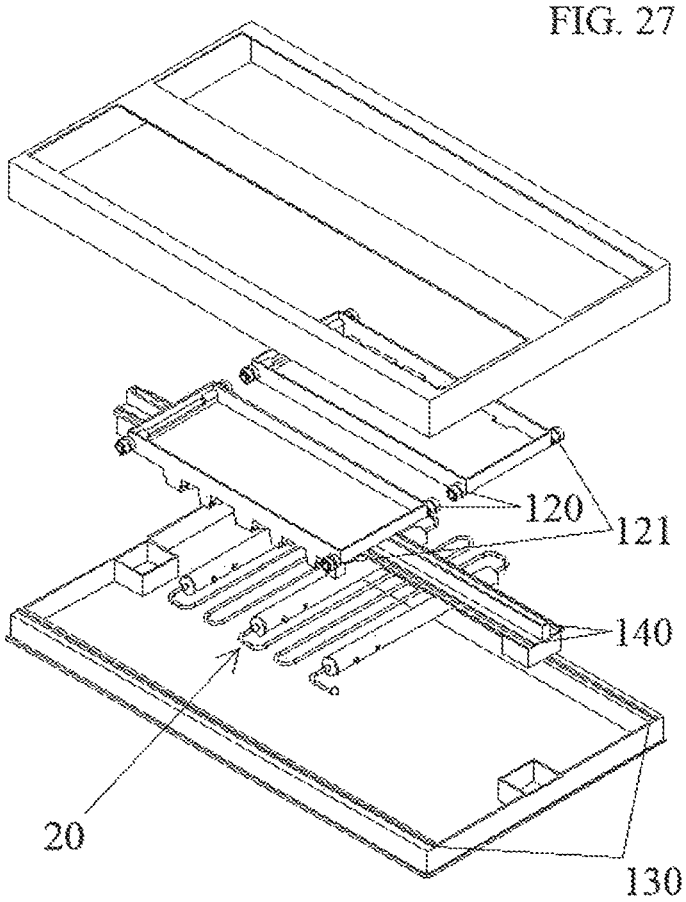
FIG. 27 is an exploded isometric view of a third embodiment of an exercise device in accordance with the present invention.

FIG. 27 is an exploded isometric view of a third embodiment of the invention showing the resistance mechanism 20, inner rollers 120, outer rollers 121, middle support ridges 140, and lower frame ridges 130.

Figure 28:
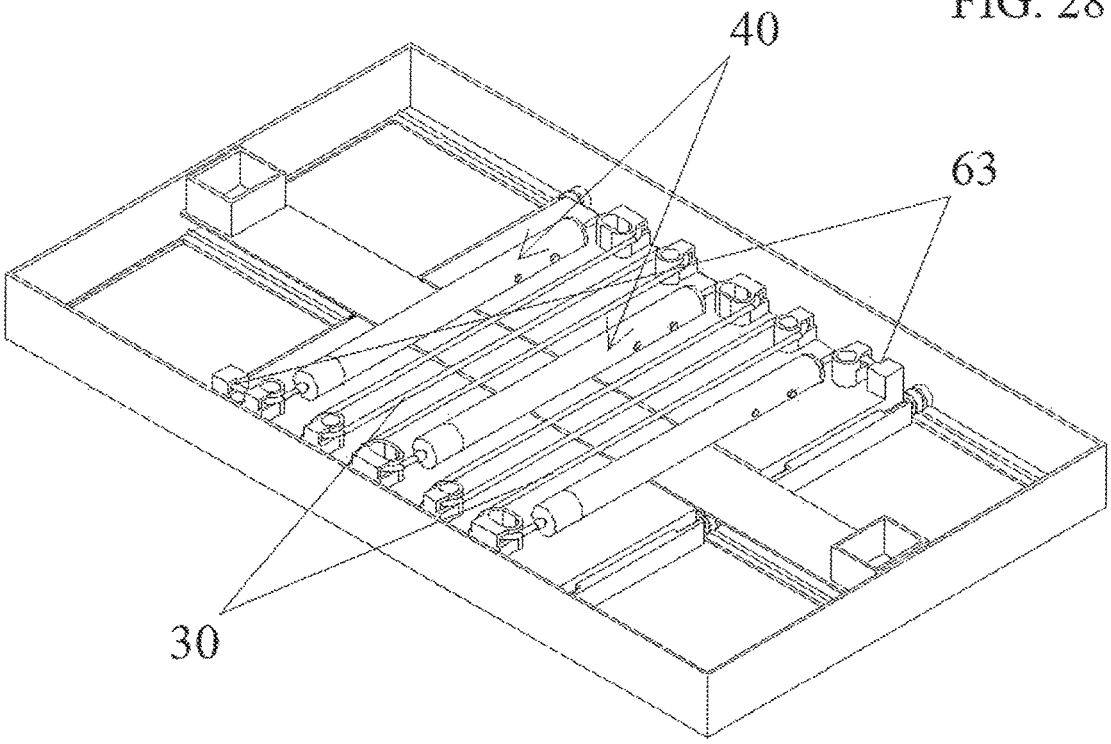
FIG. 28 is an isometric view of the underside of the exercise device of FIG. 27 with the lower frame removed.

FIG. 28 is an isometric view of the underside of the exercise device of FIG. 27 with the lower frame removed showing the shock cord 30, dashpots 40, and shock cord anchor holes 63.

Figure 29:
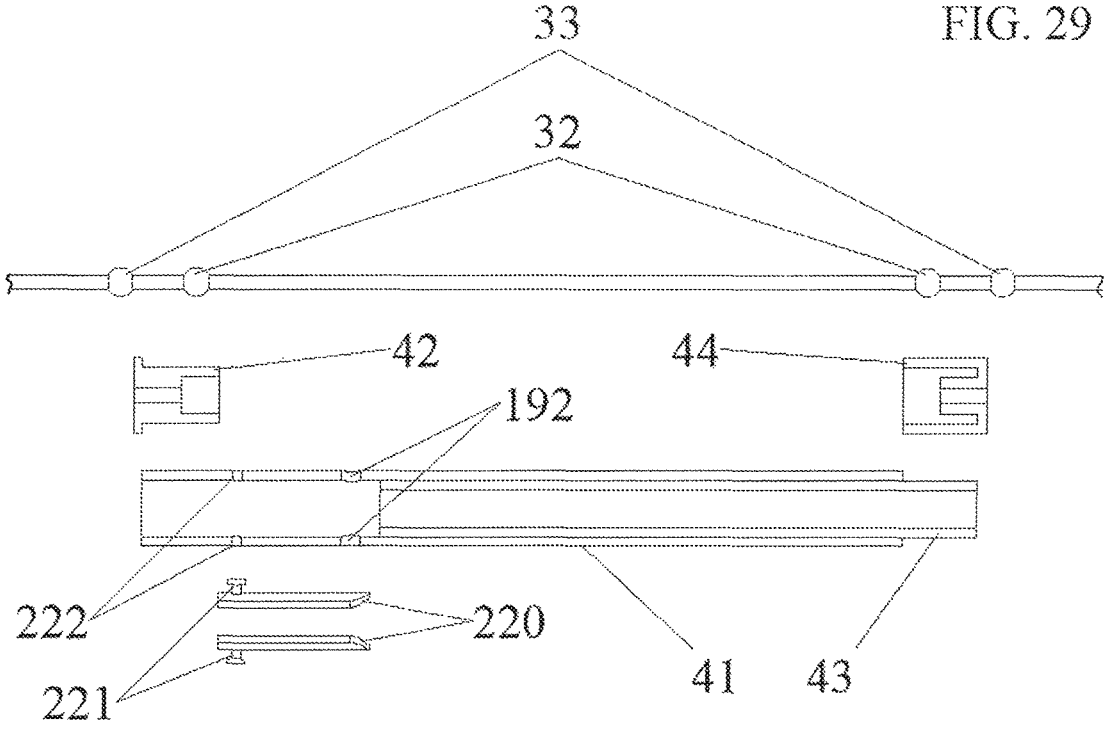
FIG. 29 is an exploded sectional view of one segment of the resistance mechanism of the exercise device of FIG. 27.

FIG. 29 is an exploded sectional view of one segment of the resistance mechanism 20 of the exercise device of FIG. 27, showing shock cord 30, shock cord inner stops 32, shock cord outer stops 33, outer tube 43, inner tube 41, outer tube end piece 44, inner tube end piece 42, flap valves 220, flap valve rivets 221, flap valve rivet holes 222, and valve opening 192.

Figure 30:
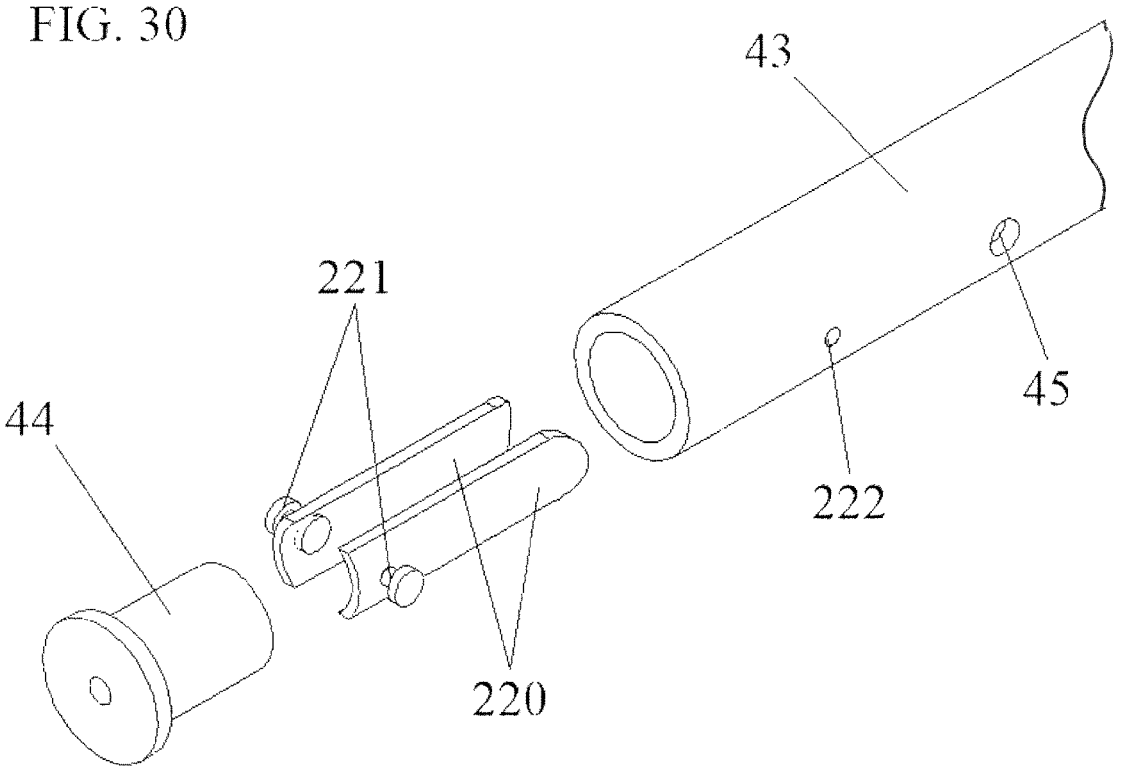
FIG. 30 is an exploded isometric view of two of the flap valves and associated outer tube of the resistance mechanism of the exercise device of FIG. 27.

FIG. 30 is an exploded isometric view of two of the flap valves 220 and associated outer tube 43 of the resistance mechanism of the exercise device of FIG. 27 showing one of the valve openings 192, flap valve rivets 221, one of the flap valve rivet holes 222, and outer tube end piece 44.

Figure 31:
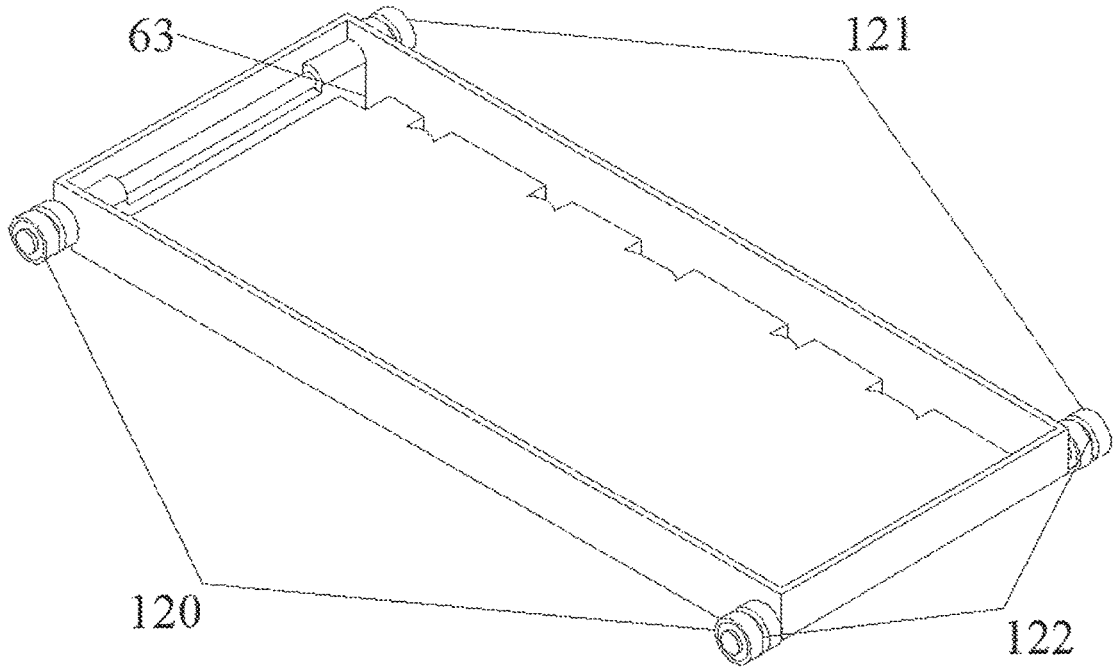
FIG. 31 is an isometric view of one of the foot platforms of the exercise device of FIG. 27.

FIG. 31 is an isometric view of one of the foot platforms of the exercise device of FIG. 27 showing the inner rollers 120, outer rollers 121, grooves 122, and shock cord anchor hole 63.

Figure 32:
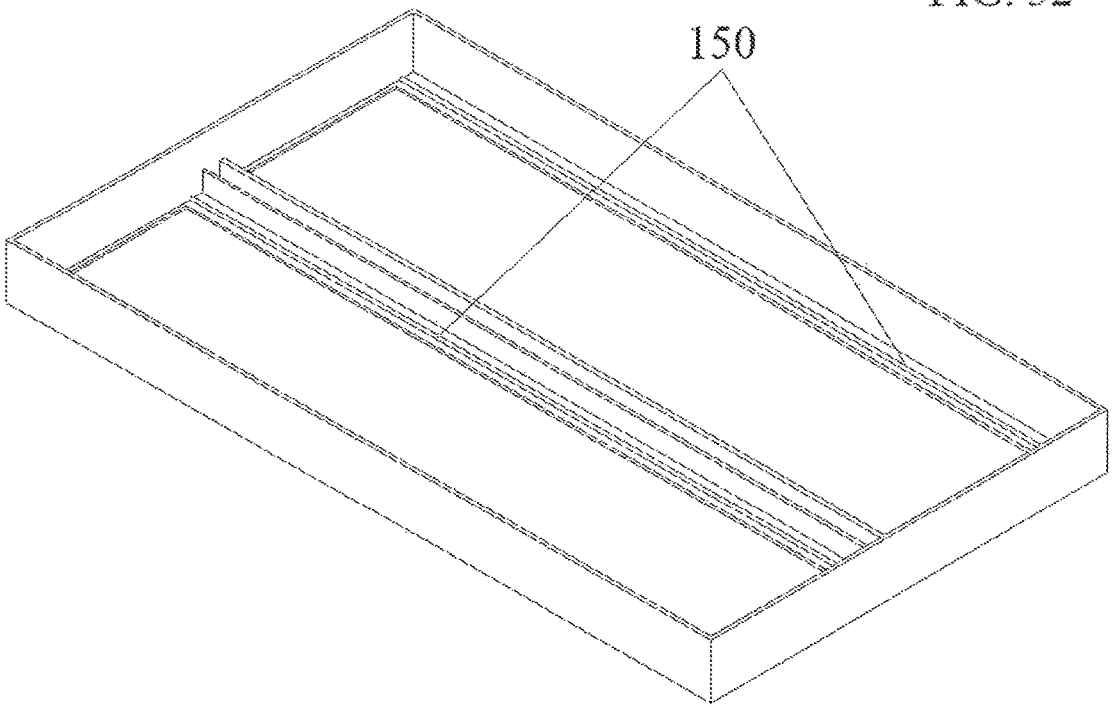
FIG. 32 is an isometric view of the underside of the upper frame of the exercise device of FIG. 27.

FIG. 32 is an isometric view of the underside of the upper frame of the exercise device of FIG. 27 showing the retaining ridges 150.

Figure 33:
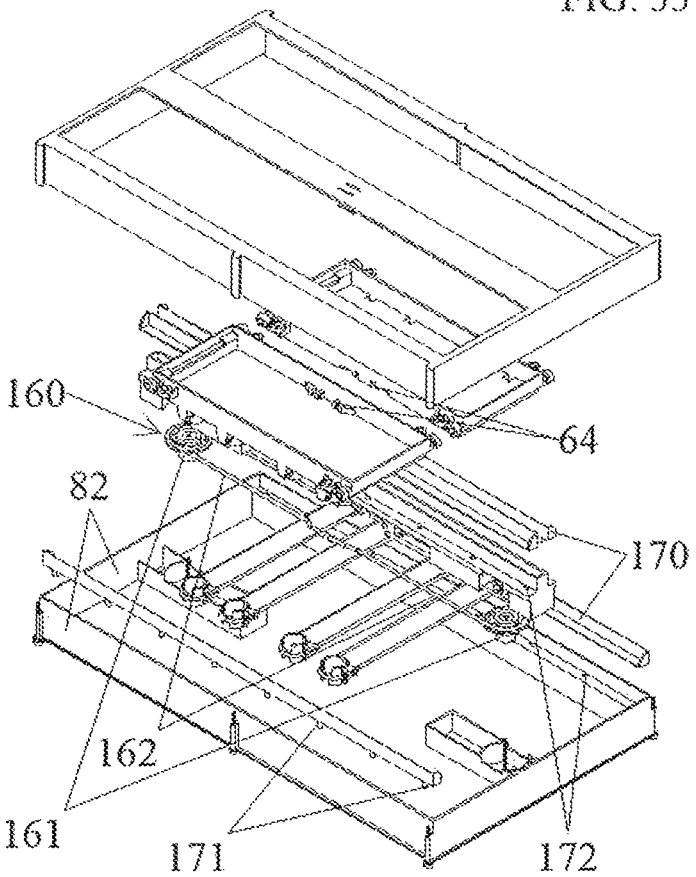
FIG. 33 is an exploded isometric view of a fourth embodiment of an exercise device in accordance with the present invention.

FIG. 33 is an exploded isometric view of a fourth embodiment of the invention showing a pulley assemblage 160, pulleys 161, pulley cords 162, pulley cord anchor holes 64, bearing surface liners 170, bearing surface liner extensions 171, bearing surface liner extension holes 172, and lower frame wall extensions 82.

Figure 34:
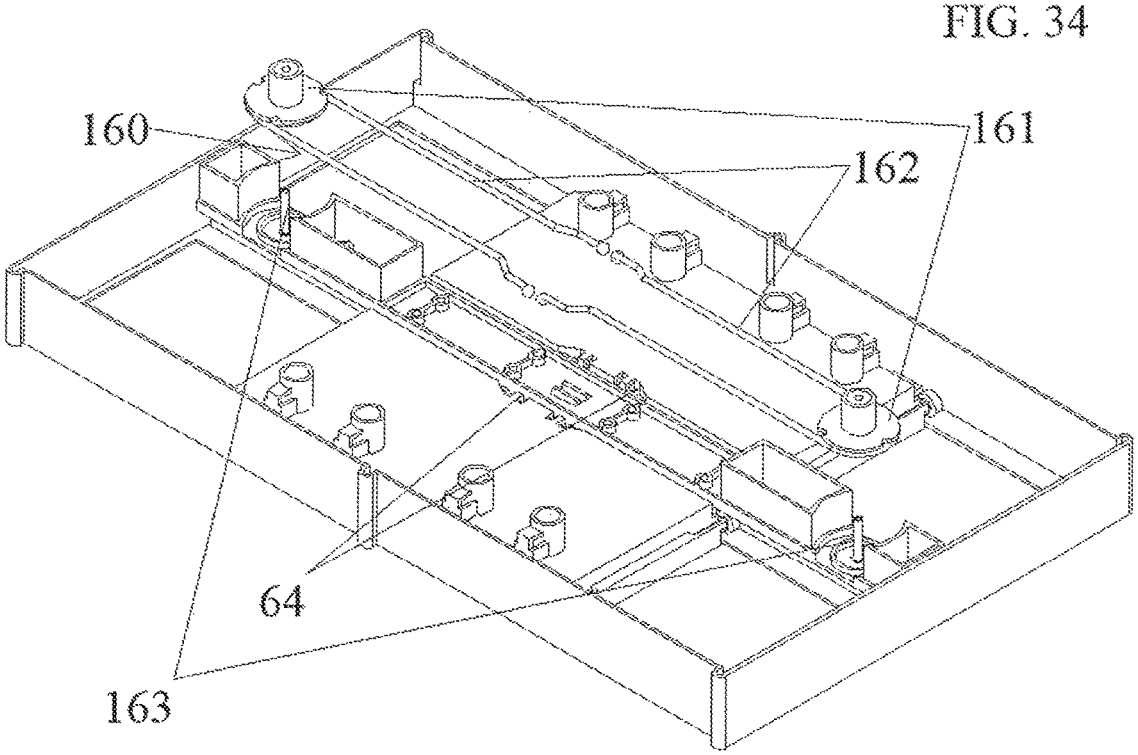
FIG. 34 is a partially exploded isometric view of the underside of the exercise device of FIG. 33 with the lower frame and resistance mechanisms removed.

FIG. 34 is a partially exploded isometric view of the underside of the exercise device of FIG. 33 showing the pulley assemblage 160, pulleys 161, pulley cords 162, pulley cord anchor holes 64, and pulley axles 163.

Figure 35:
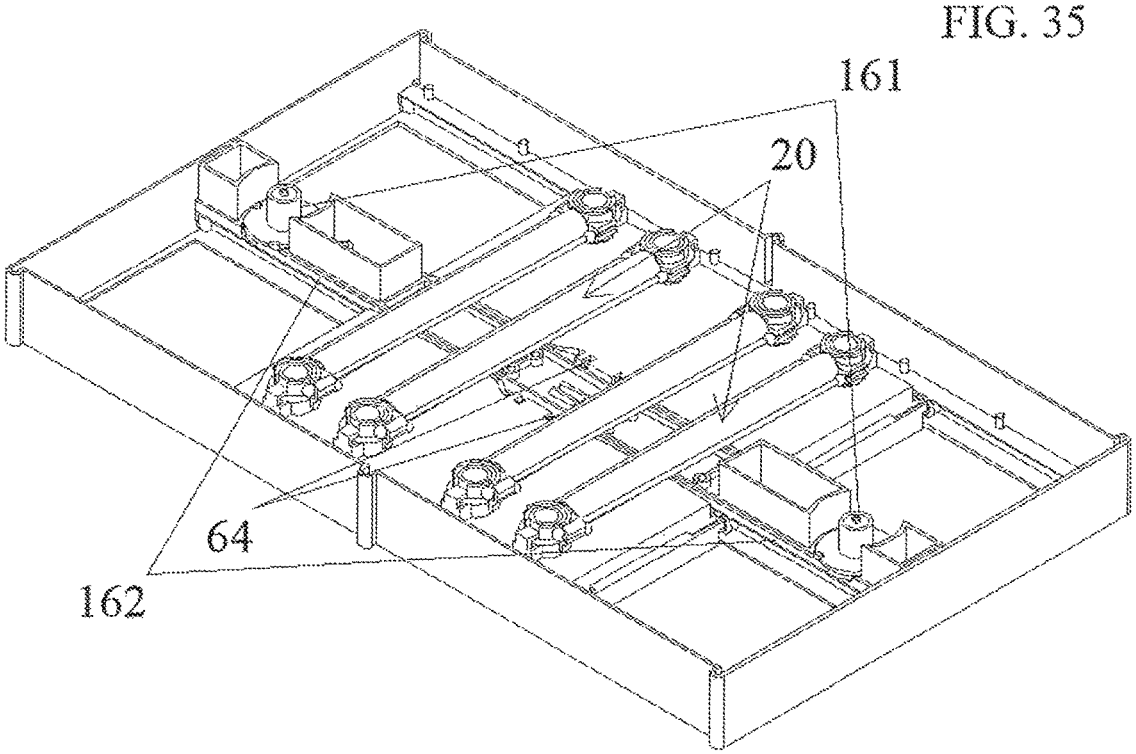
FIG. 35 is an isometric view of the underside of the exercise device of FIG. 33 with the lower frame removed.

FIG. 35 is an isometric view of the underside of the exercise device of FIG. 33 showing the pulleys 161, pulley cords 162, and pulley cord anchor holes 64.

Figure 36:
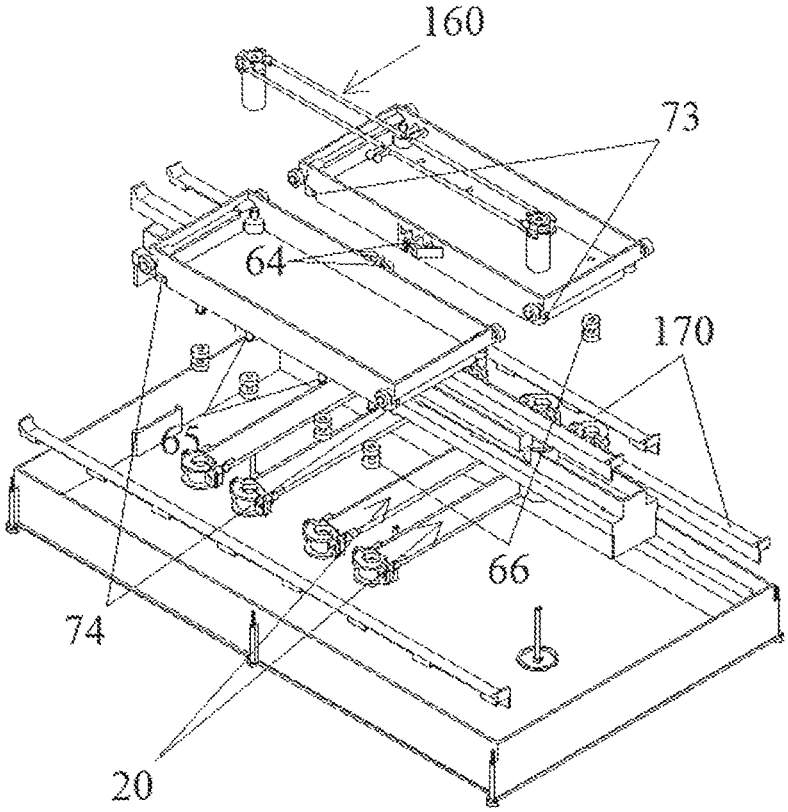
FIG. 36 is an exploded isometric view of a fifth embodiment of an exercise device in accordance with the present invention with the upper frame removed.

FIG. 36 is an exploded isometric view of a fifth embodiment of an exercise device in accordance with the present invention with the upper frame removed showing inner guide bearings 73, outer guide bearings 74, bearing surface liners 170, pulley assembly 160, pulley cord anchor holes 64, resistance mechanisms 20, resistance mechanism axles 65, and resistance mechanism bearings 66.

Figure 37:
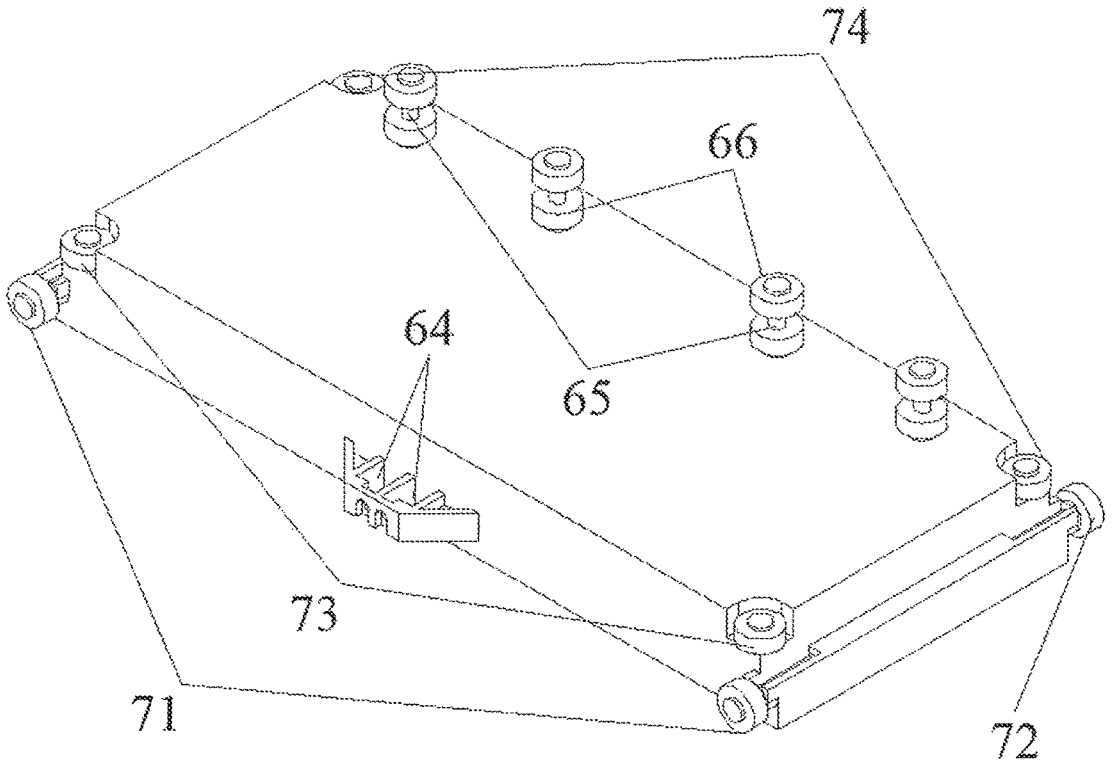
FIG. 37 is an isometric view of the underside of one of the foot platforms of the exercise device of FIG. 36.

FIG. 37 is an isometric view of the underside of the foot platform of the exercise device of FIG. 36 showing inner guide bearings 73, outer guide bearings 74, inner support bearings 71, one outer support bearing 72, pulley cord anchor holes 64, resistance mechanism axles 65, and resistance mechanism bearings 66.

Figure 38:
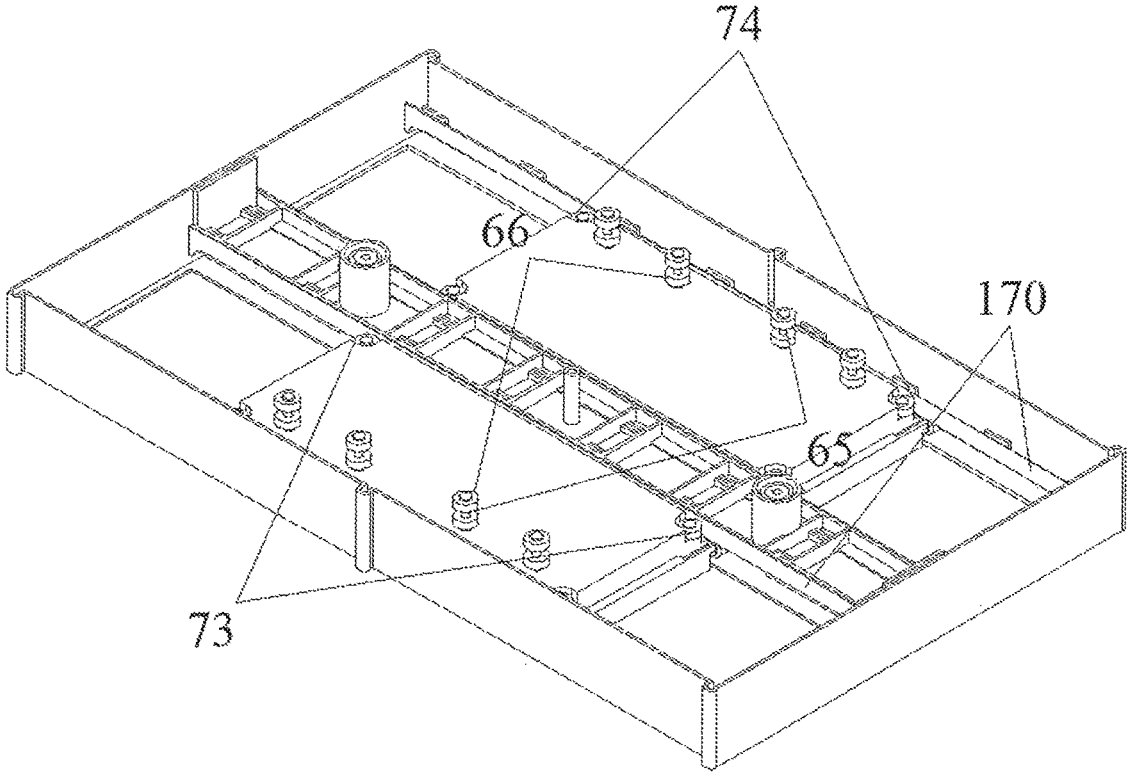
FIG. 38 is an isometric view of the underside of the exercise device of FIG. 36 with the lower frame and resistance mechanisms removed.

FIG. 38 is an isometric view of the underside of the exercise device of FIG. 36 with the lower frame and resistance mechanisms removed showing inner guide bearings 73, outer guide bearings 74, bearing surface liners 170, resistance mechanism axles 65, and resistance mechanism bearings 66.

Figure 39:
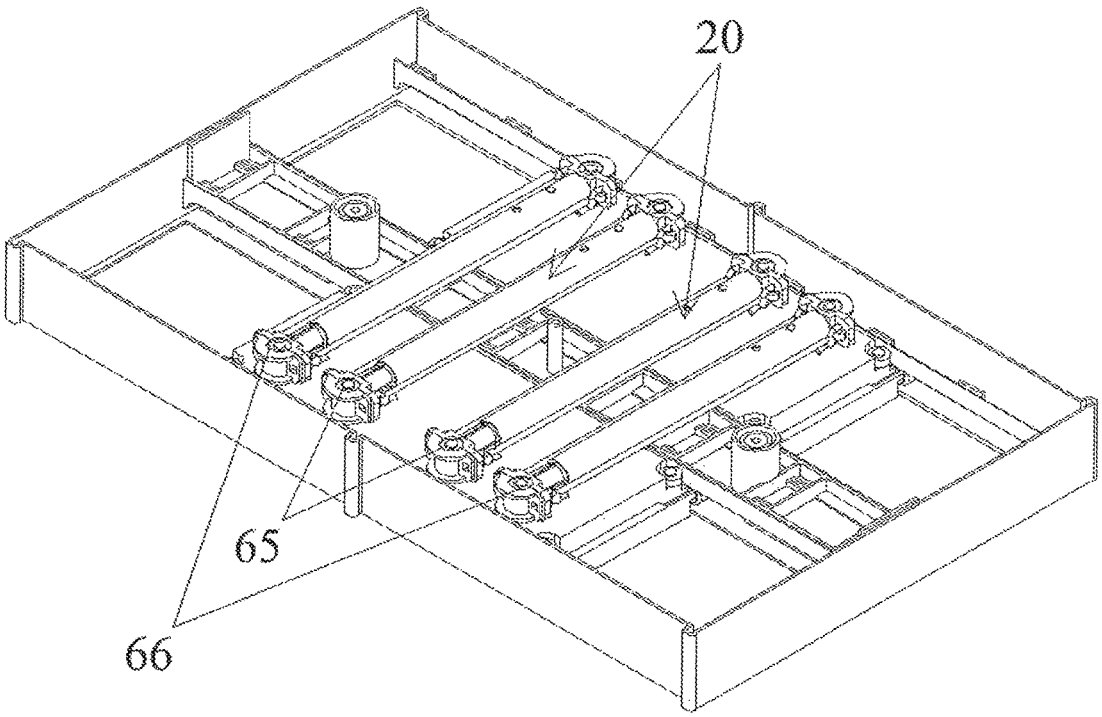
FIG. 39 is an isometric view of the underside of the exercise device of FIG. 36 with the lower frame removed.

FIG. 39 is an isometric view of the underside of the exercise device of FIG. 36 with the lower frame removed showing the resistance mechanisms 20, resistance mechanism axles 65, and resistance mechanism bearings 66.

Figure 40:
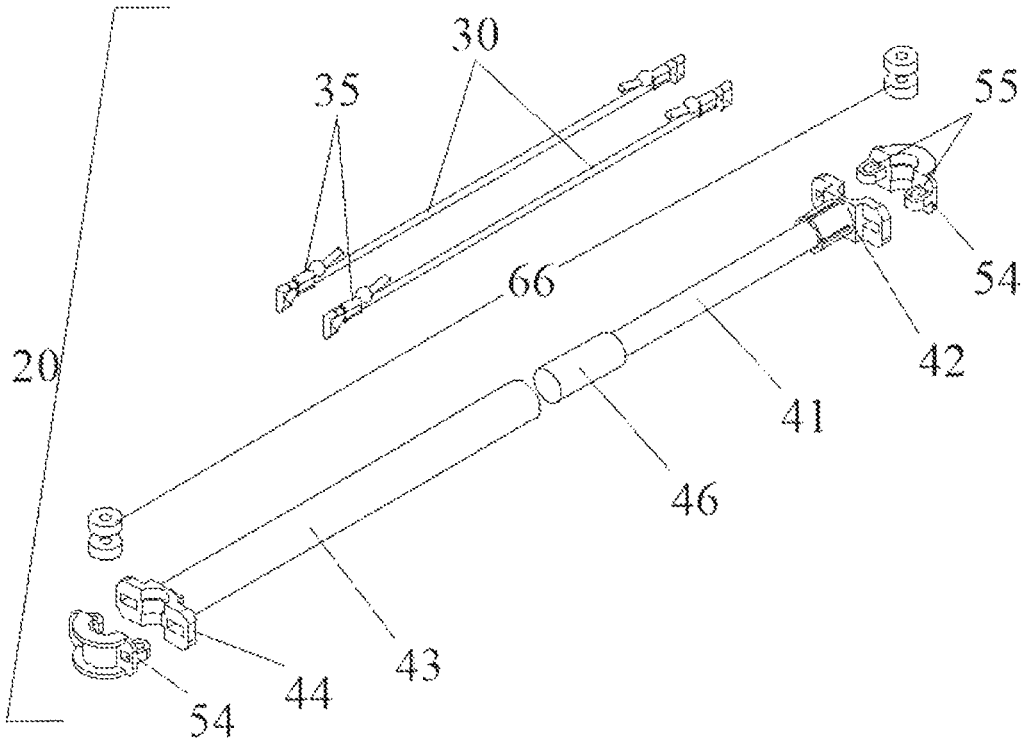
FIG. 40 is an exploded isometric view of one of the resistance mechanisms of the exercise device of FIG. 36.

FIG. 40 is an exploded isometric view of one of the resistance mechanisms 20 of the exercise device of FIG. 36 showing the inner tube 41, outer tube 43, piston 46, outer tube end piece 44, inner tube end piece 42, end piece brackets 54, end piece bracket extensions 55, resistance mechanism bearings 66, shock cord 30, and shock cord sleeves 35.

Figure 41:
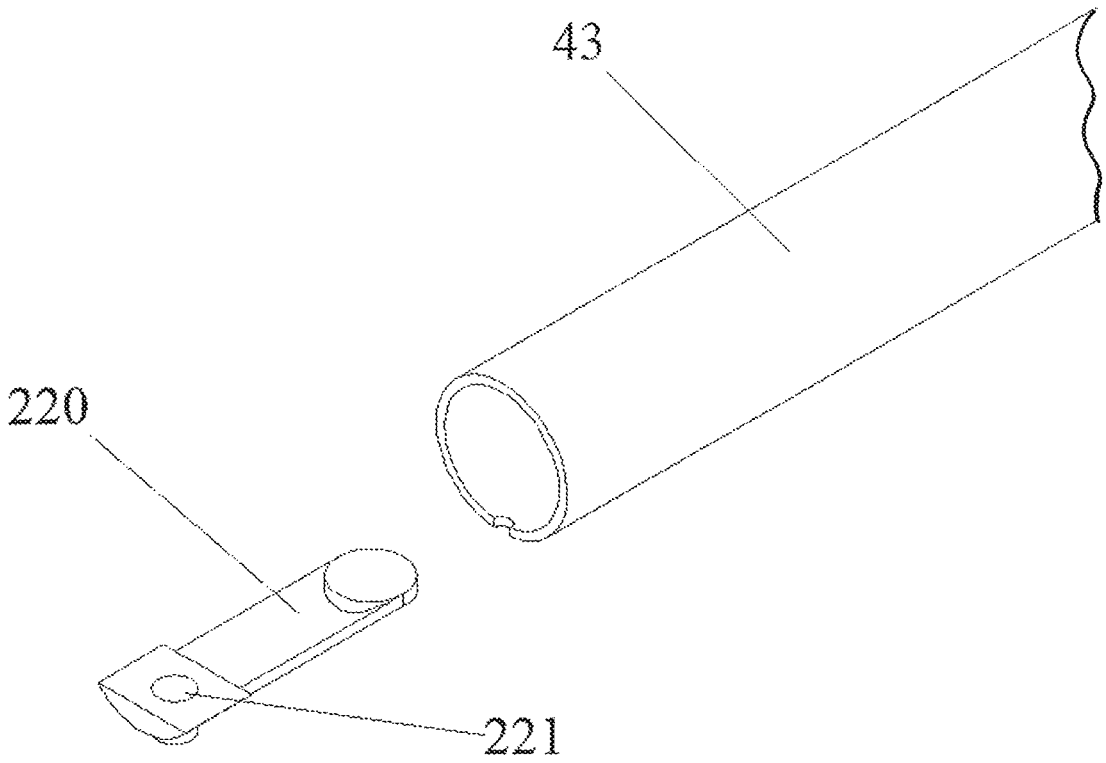
FIG. 41 is an exploded isometric view of one of the flap valves of the exercise device of FIG. 36.

FIG. 41 is an exploded isometric view of one of the flap valves 220 of the exercise device of FIG. 36 showing the outer tube 43 and flap valve rivet 221.

Figure 42:
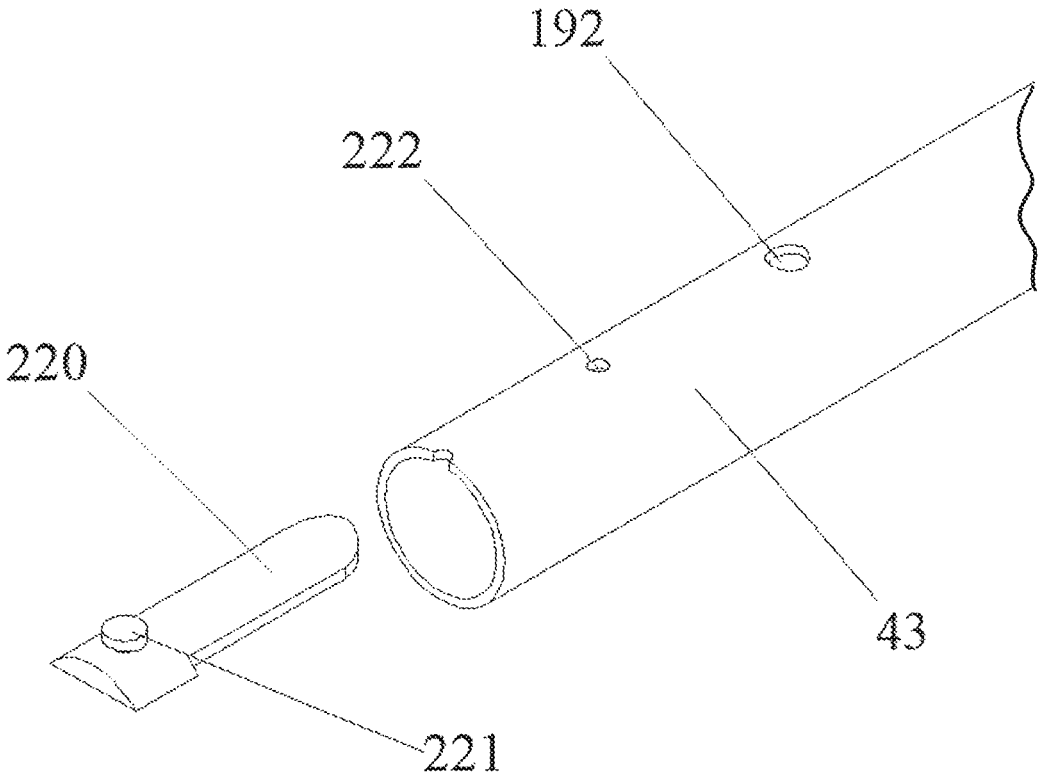
FIG. 42 is an exploded isometric view of the underside of one of the flap valves of the exercise device of FIG. 36.

FIG. 42 is an exploded isometric view of the underside of one of the flap valves 220 of the exercise device of FIG. 36 showing the outer tube 43, flap valve rivet 221, flap valve rivet hole 222, and valve opening 192.

Figure 43:
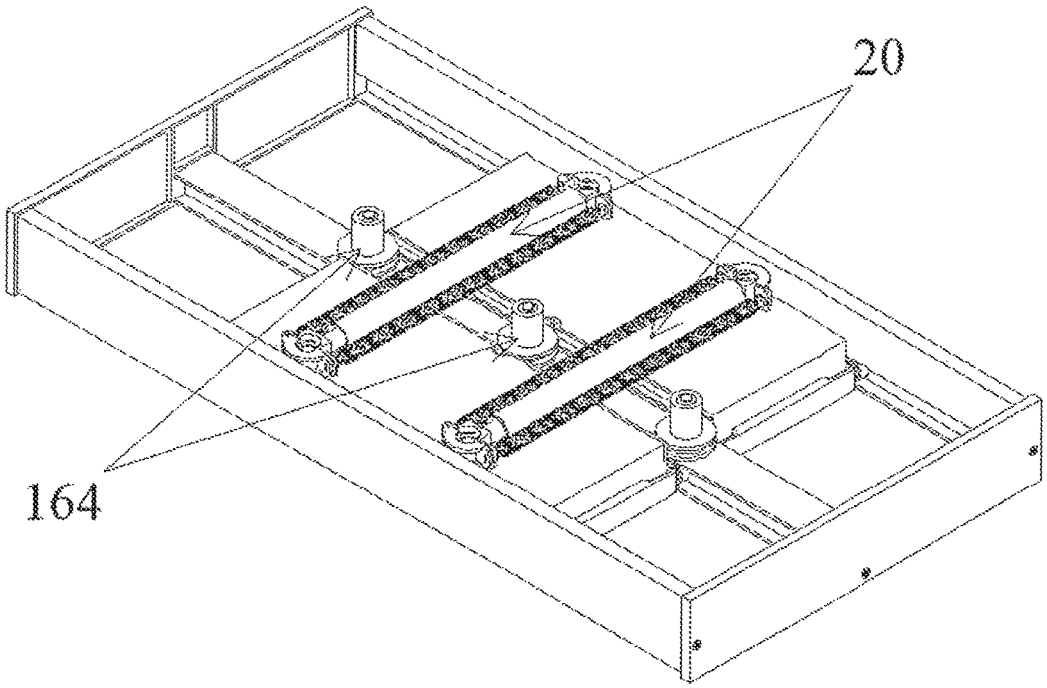
FIG. 43 is an isometric view of the underside of a sixth embodiment of an exercise device in accordance with the present invention.

FIG. 43 is an isometric view of the underside of a sixth embodiment of an exercise device in accordance with the present invention showing pulley/rollers 164 and resistance mechanisms 20.

Figure 44:
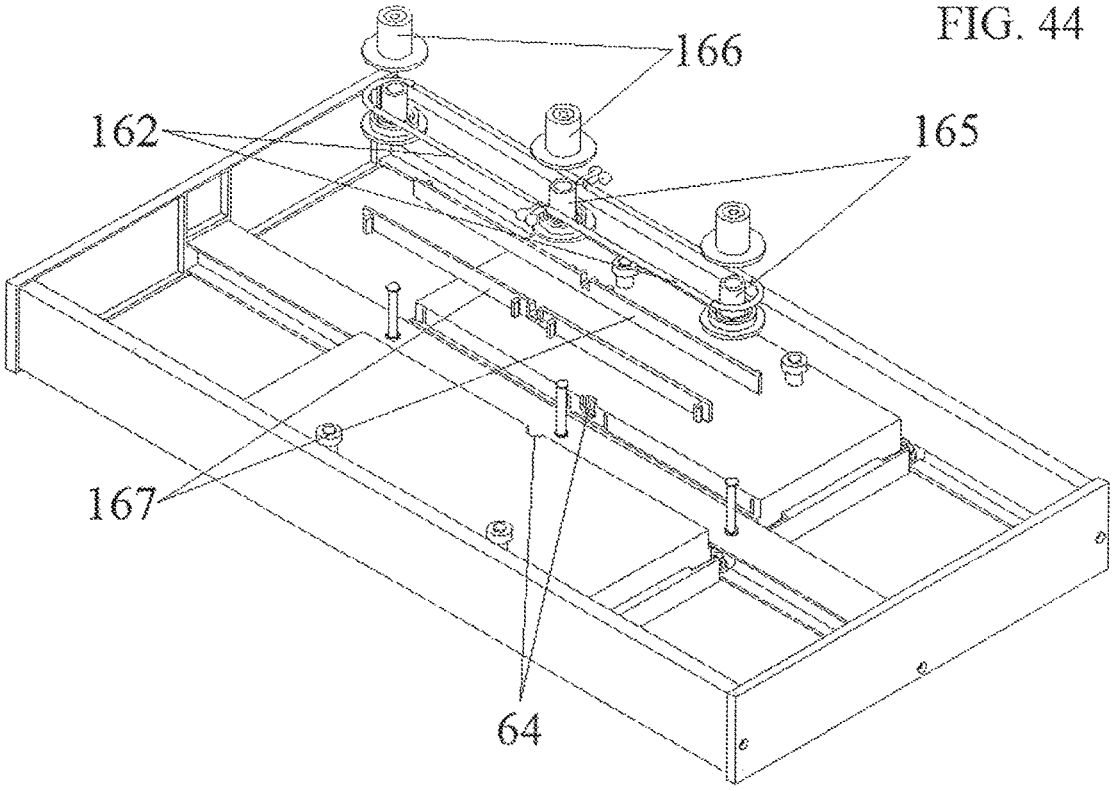
FIG. 44 is an exploded isometric view of the exercise device of FIG. 43 with the resistance mechanisms removed.

FIG. 44 is an exploded isometric view of the underside of the exercise device of FIG. 43 with the resistance mechanisms removed showing the pulley/roller upper halves 165, pulley/roller lower halves 166, pulley cords 162, pulley/roller liners 167, and pulley cord anchor holes 64.

Figure 45:
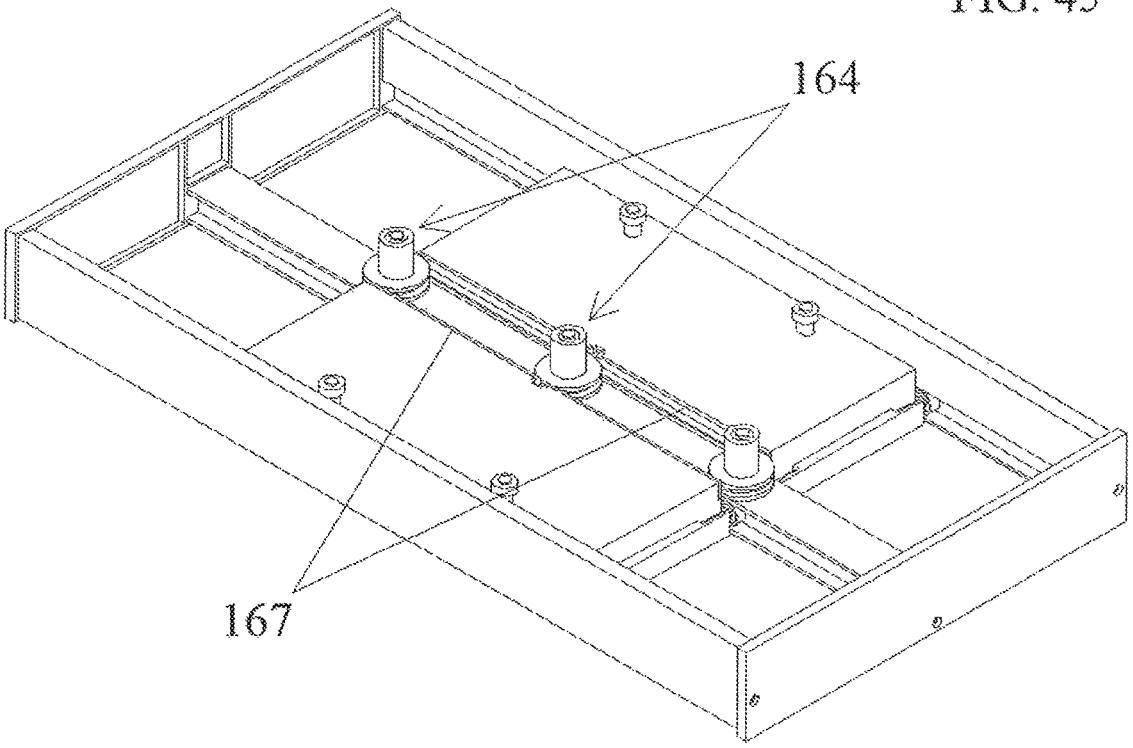
FIG. 45 is a non-exploded isometric view of the exercise device of FIG. 43 with the resistance mechanisms removed.

FIG. 45 is a non-exploded isometric view of the underside of the exercise device of FIG. 43 with the resistance mechanisms removed showing the pulley/rollers 164 and pulley/roller liners 167.

Figure 46:
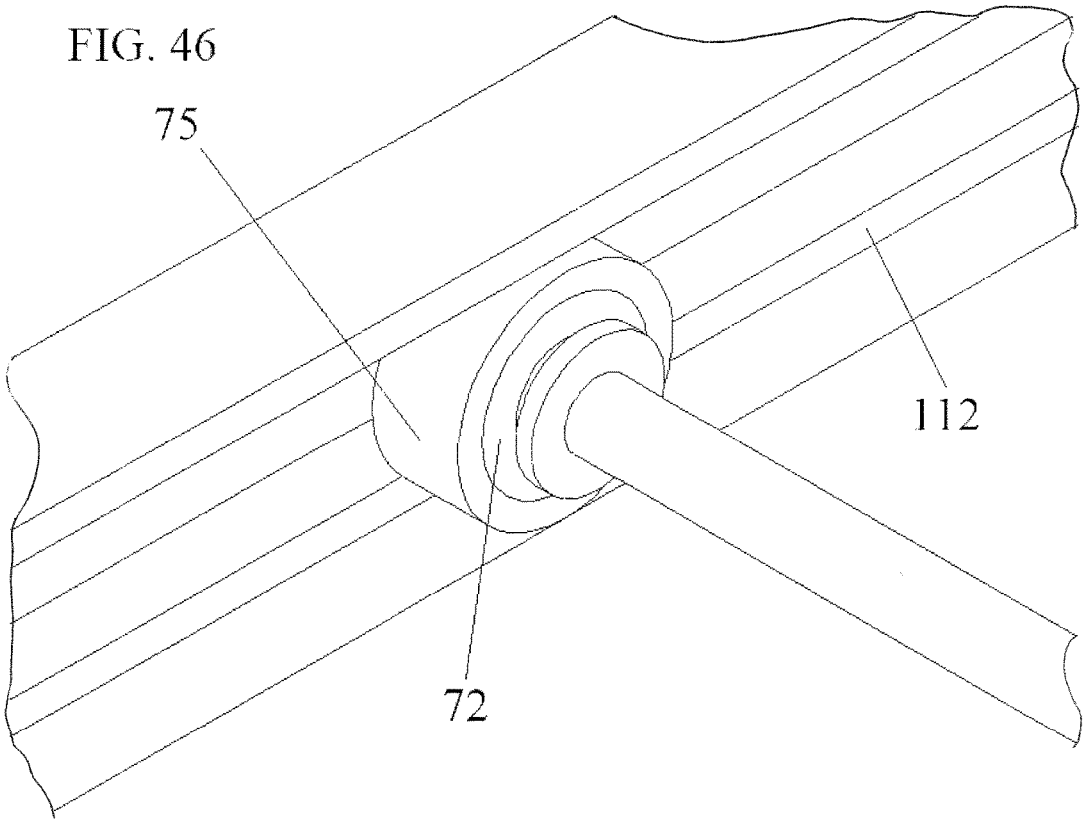
FIG. 46 is a detailed view of one aspect of the exercise device of FIG. 43.

FIG. 46 is a detailed view of the exercise device of FIG. 43 showing a support bearing (in this instance outer) 72, bearing sheath 75, and horizontal bearing surface shelf 112.

Figure 47:
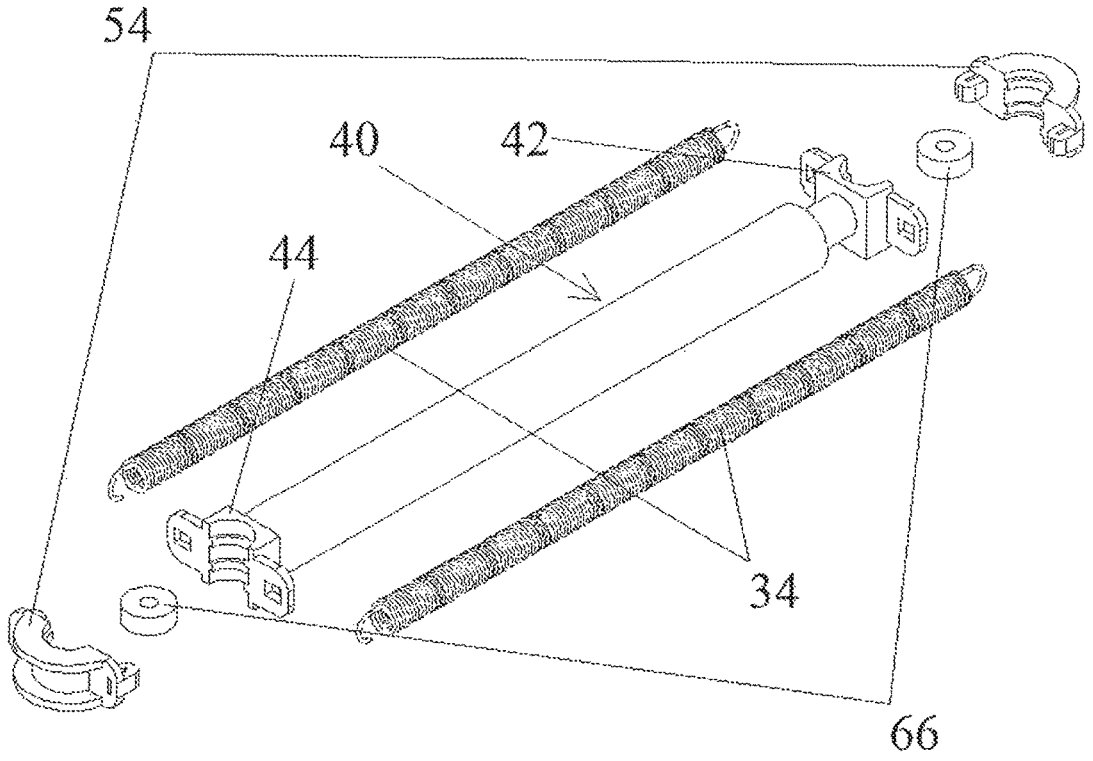
FIG. 47 is an exploded isometric view of one of the resistance mechanisms of the exercise device of FIG. 43.

FIG. 47 is an exploded isometric view of one of the resistance mechanisms of the exercise device of FIG. 43 showing extension springs 34, a dashpot 40, end piece brackets 54, inner tube end piece 42, outer tube end piece 44, and resistance mechanism bearings 66.

Figure 48:
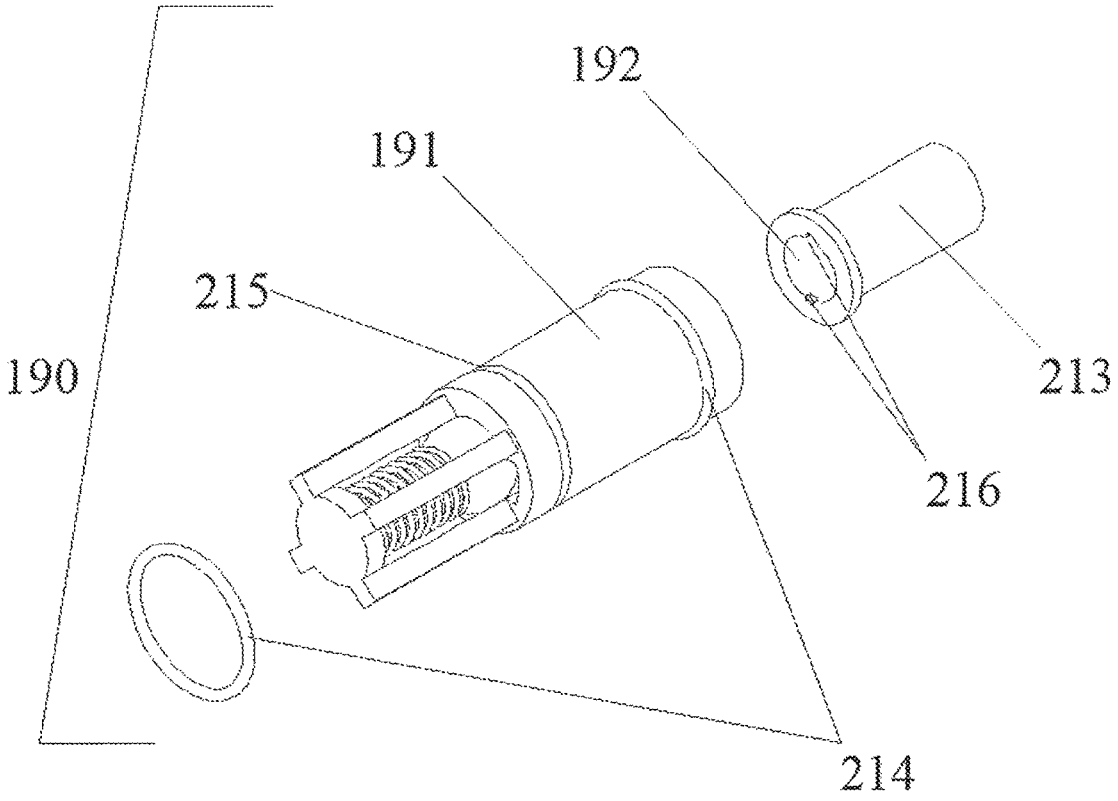
FIG. 48 is a partially exploded view of one of the valves of the exercise device of FIG. 43.

FIG. 48 is a partially-exploded view of one of the valves 190 of the exercise device of FIG. 43 showing the O-rings 214, one of the O-ring grooves 215, the valve body 191, valve inner sleeve 213, valve opening 192, and valve opening air outlets 216.

Figure 49:
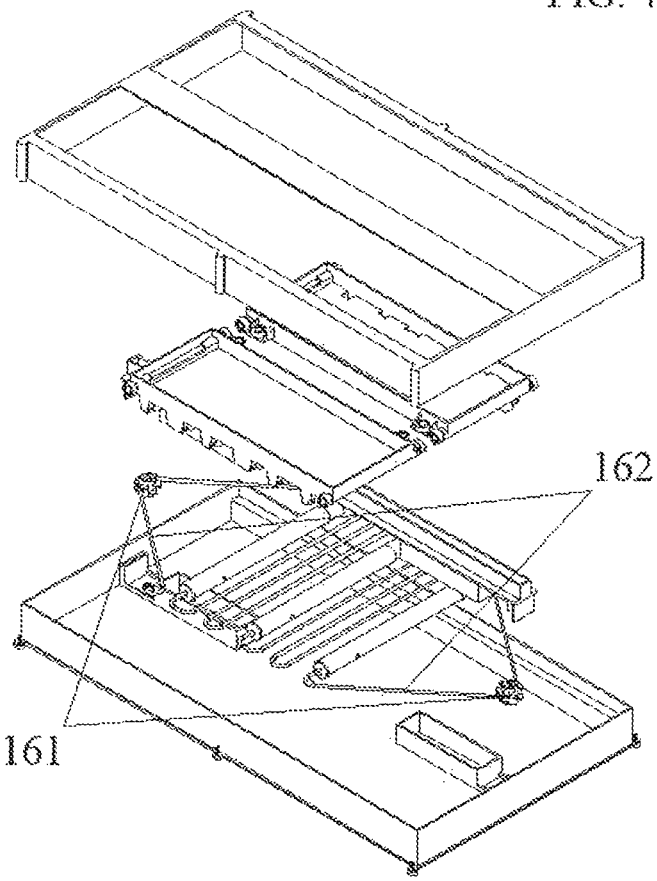
FIG. 49 is an exploded isometric view of a seventh embodiment of an exercise device in accordance with the present invention.

FIG. 49 is an exploded isometric view of a seventh embodiment of the invention showing pulleys 161 and pulley cords 162.

Figure 50:
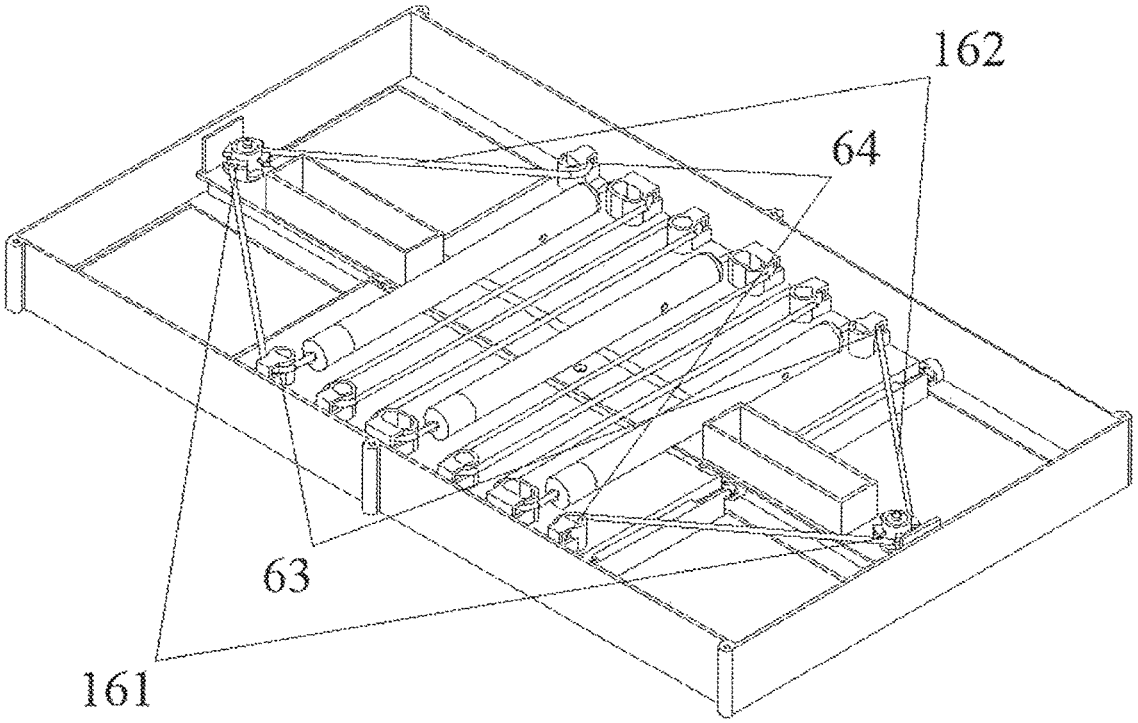
FIG. 50 is an isometric view of the underside of the exercise device of FIG. 49 with the lower frame removed.

FIG. 50 is an isometric view of the underside of the exercise device of FIG. 49 showing the pulleys 161, pulley cords 162, pulley cord anchor holes 64, and shock cord anchor holes 63.

Figure 51:
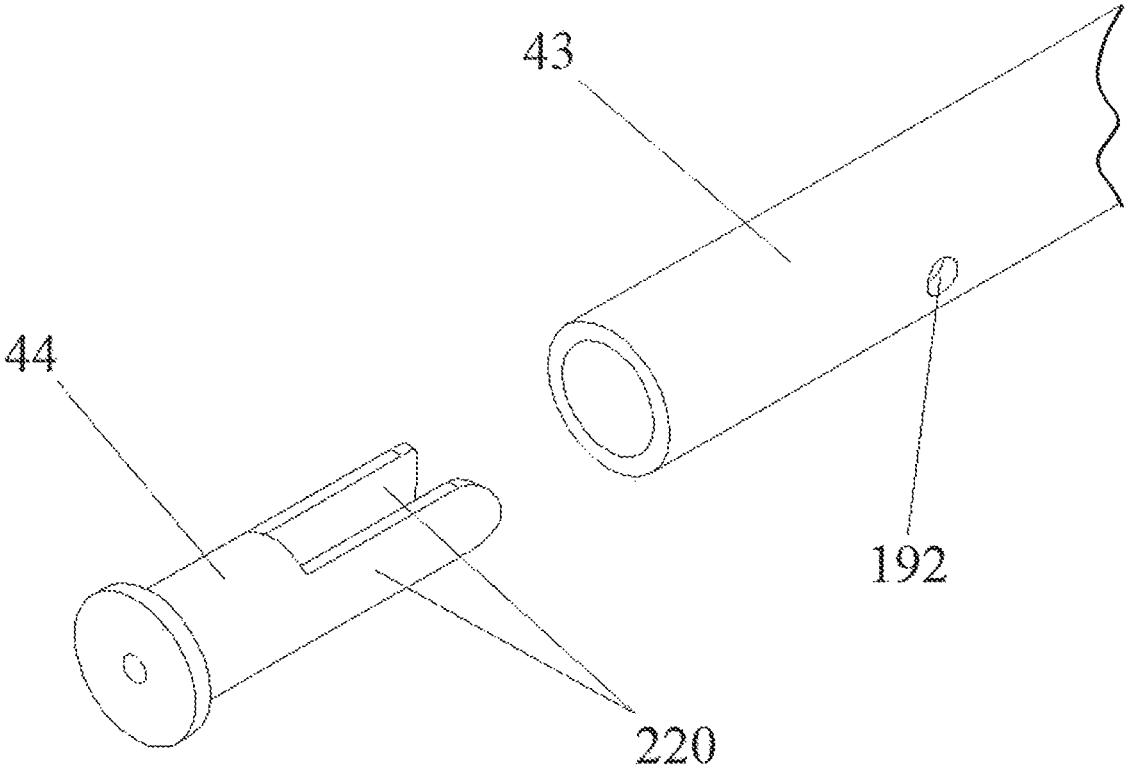
FIG. 51 is a detailed isometric view of one of the outer tube end pieces and outer tubes of the exercise device of FIG. 49.

FIG. 51 is a detailed isometric view of one of the outer tube end pieces 44 and outer tubes 43 of the exercise device of FIG. 49 showing the flap valves 220 and one of the valve openings 192.

Figure 52:
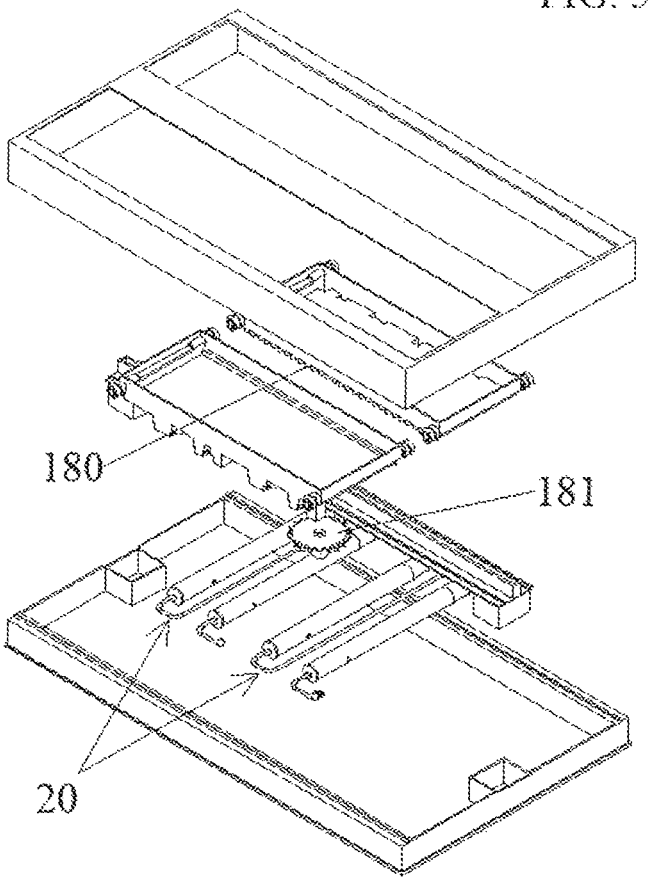
FIG. 52 is an exploded isometric view of an eighth embodiment of an exercise device in accordance with the present invention.

FIG. 52 is an exploded isometric view of an eighth embodiment of the invention showing one of the rack gears 180 integrated into the inside edges of the foot platforms, a spur gear 181, and a spur gear axle 182.

Figure 53:
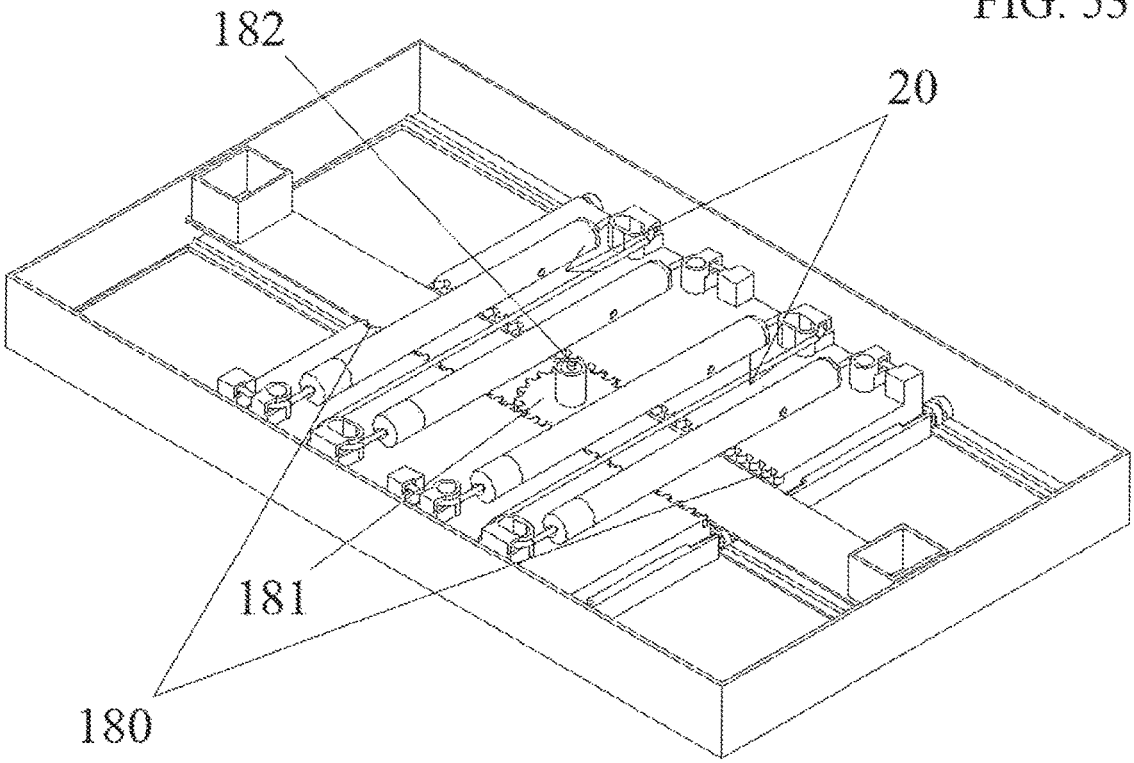
FIG. 53 is an isometric view of the underside of the exercise device of FIG. 52 with the lower frame removed.

FIG. 53 is an isometric view of the underside of the exercise device of FIG. 52 showing the rack gears 180 and spur gear 181.

Figure 54:
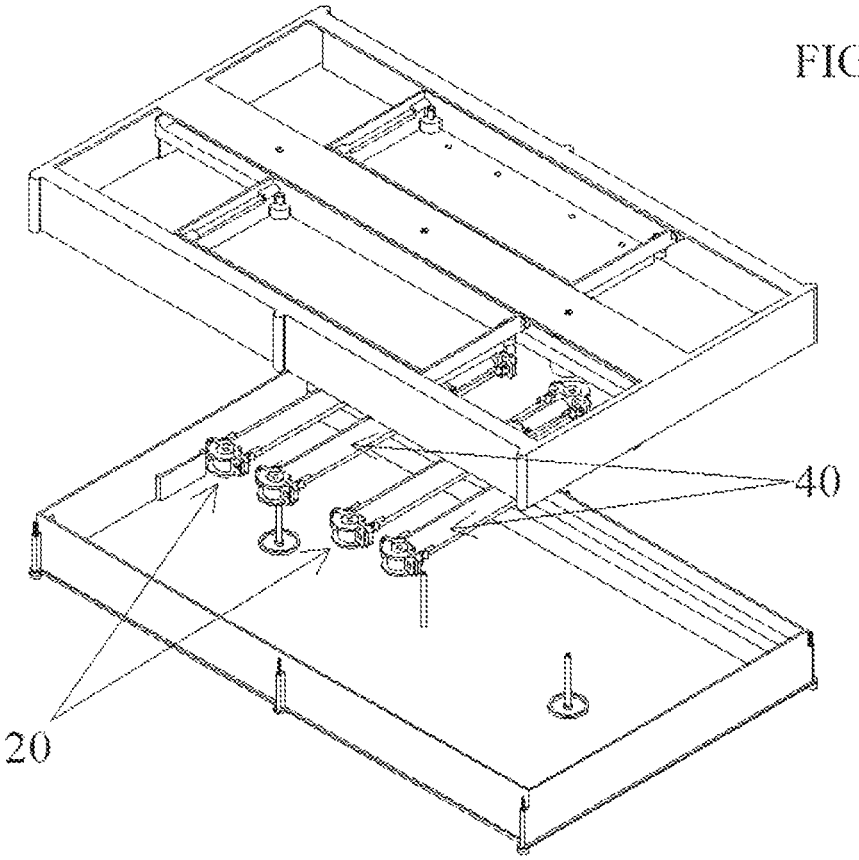
FIG. 54 is a partially exploded isometric view of a ninth embodiment of an exercise device in accordance with the present invention.

FIG. 54 is a partially exploded isometric view of a ninth embodiment of an exercise device in accordance with the present invention showing the resistance mechanisms 20 and dashpots 40.

Figure 55:
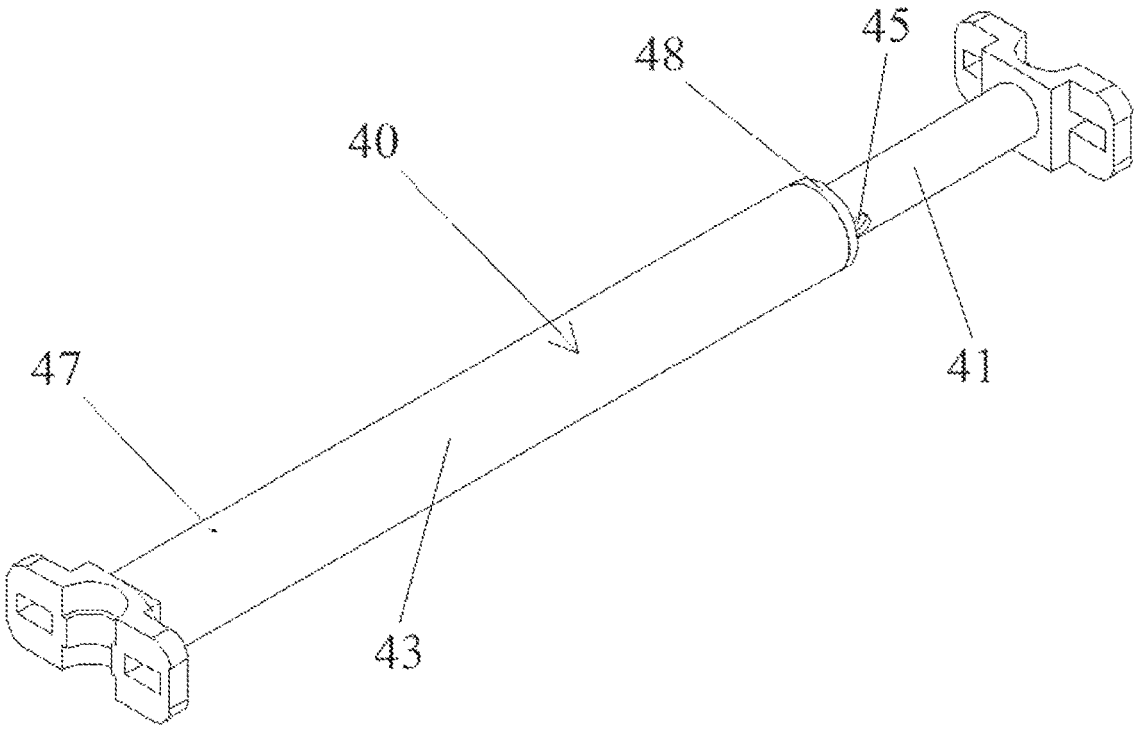
FIG. 55 is an isometric view of the underside of one of the dashpots of the exercise device of FIG. 54.

FIG. 55 is an isometric view of the underside of one of the dashpots 40 of the exercise device of FIG. 54 showing the inner tube 41, inner tube air inlet 45, outer tube 43, outer tube air outlet 47, and dashpot sleeve 48.

Figure 56:
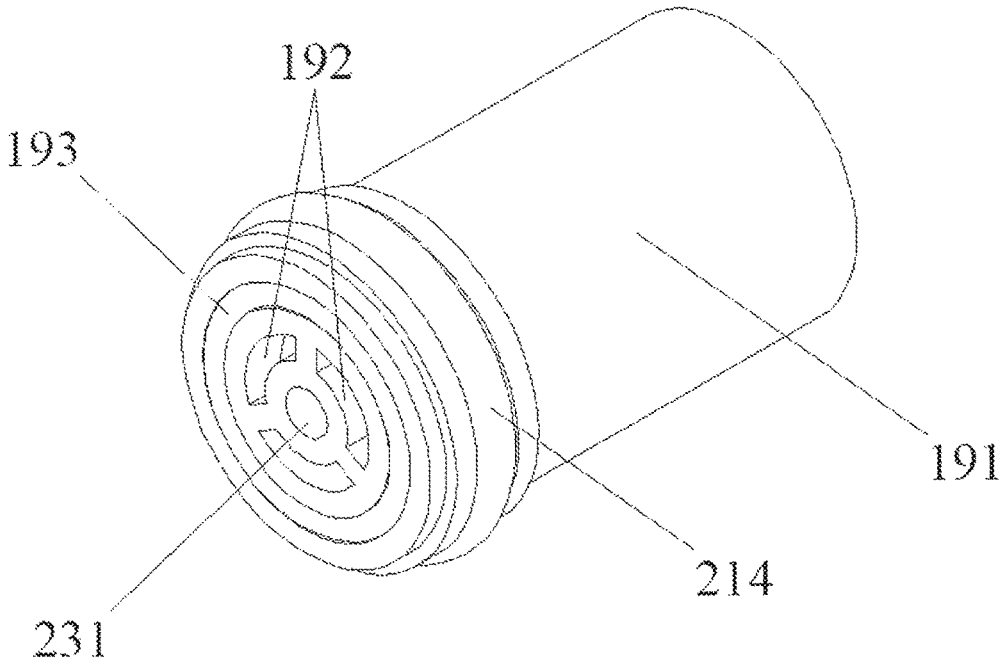
FIG. 56 is an isometric view of one of the valve bodies of the exercise device of FIG. 54.

FIG. 56 is an isometric view of one of the valve bodies 191 of the exercise device of FIG. 54 showing the valve opening 192, valve seal 193, O-ring 214, and valve shock cord opening 231.

Figure 57:
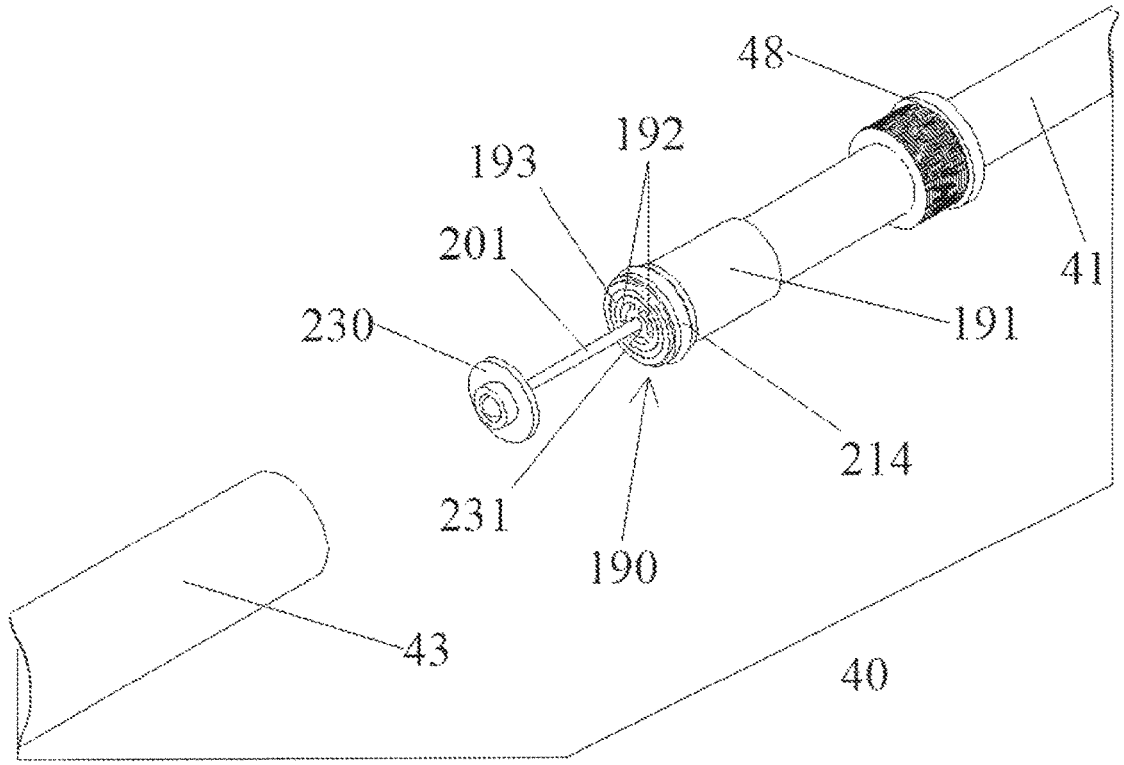
FIG. 57 is an enlarged partially exploded isometric view of one of the dashpots and one of the valves of the exercise device of FIG. 54.

FIG. 57 is an enlarged partially exploded isometric view of one of the dashpots 40 and one of the valves 190 of the exercise device of FIG. 54 showing the inner tube 41, outer tube 43, dashpot sleeve 48, valve body 191, valve opening 192, valve seal 193, O-ring 214, disk shaped valve member 230, valve shock cord 201, and valve shock cord opening 231.

Figure 58:
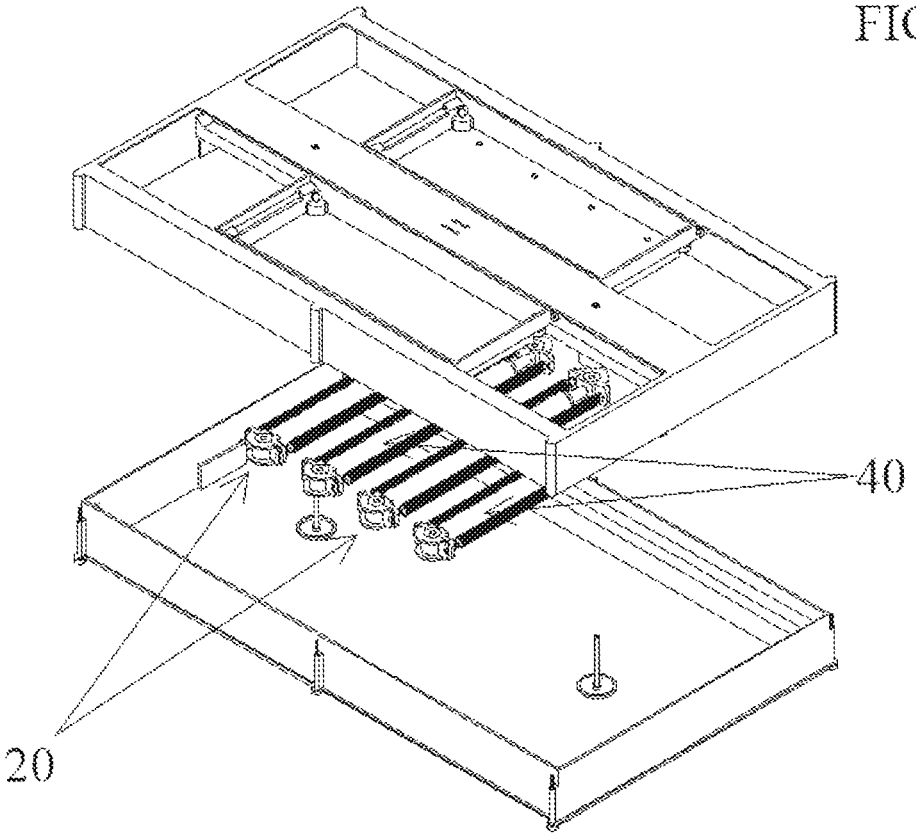
FIG. 58 is a partially exploded isometric view of a tenth embodiment of an exercise device in accordance with the present invention.

FIG. 58 is a partially exploded isometric view of a tenth embodiment of an exercise device in accordance with the present invention showing the resistance mechanisms 20 and dashpots 40.

Figure 59:
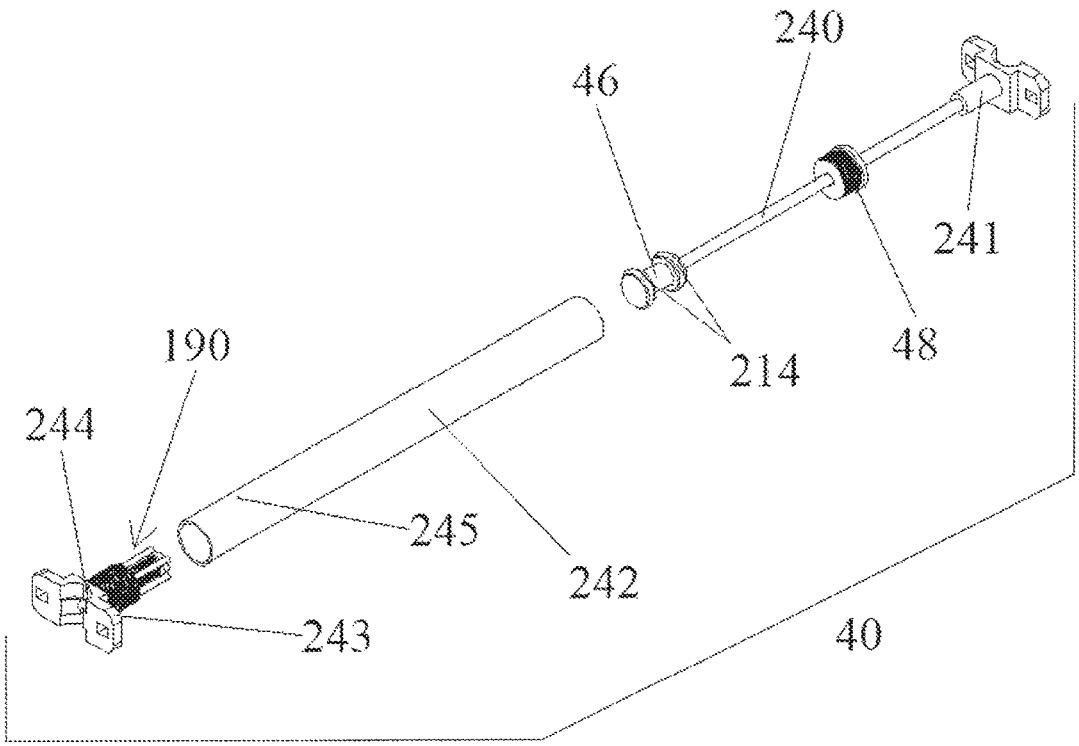
FIG. 59 is a partially exploded isometric view of the underside of one of the dashpots of the exercise device of FIG. 58.

FIG. 59 is a partially exploded isometric view of the underside of one of the dashpots 20 of the exercise device of FIG. 58 showing the rod 240, rod end piece 241, tube 242, tube end piece 243, tube end piece air inlet 244, tube air outlet 245, piston 46, O-rings 214, dashpot sleeve 48, and valve 190.

Figure 60:
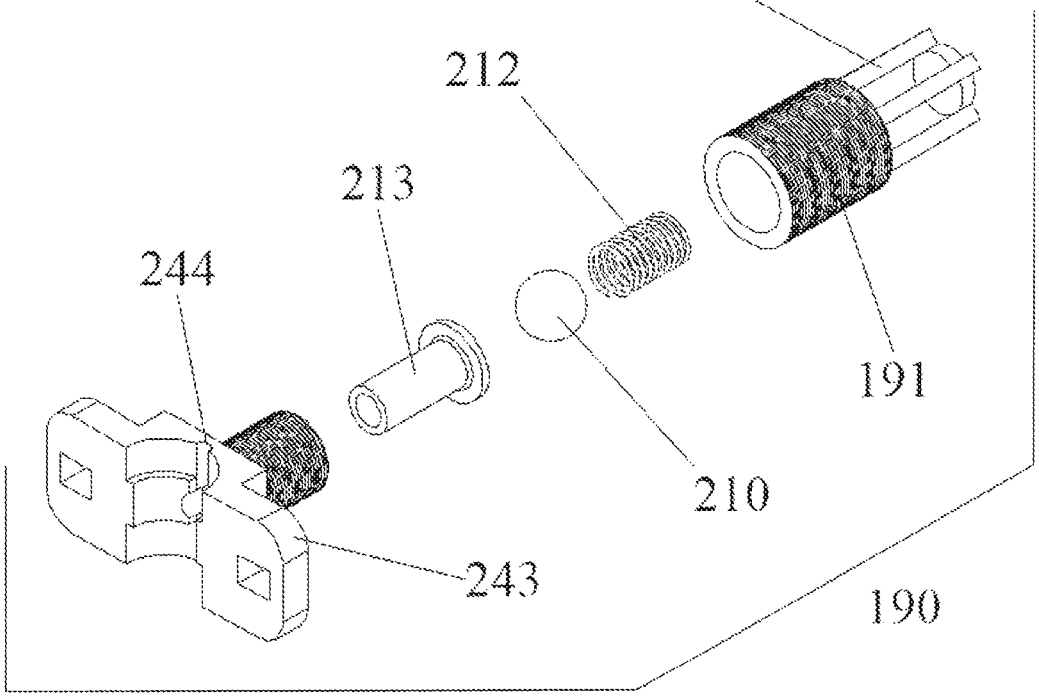
FIG. 60 is an exploded isometric view of one of the valves of the exercise device of FIG. 58.

FIG. 60 is an exploded isometric view of one of the valves 190 of the exercise device of FIG. 58 showing the valve body 191, spherical valve member 210, valve body cage 211, compression spring 212, valve inner sleeve 213, tube end piece 243, and tube end piece air inlet 244.

Figure 61:
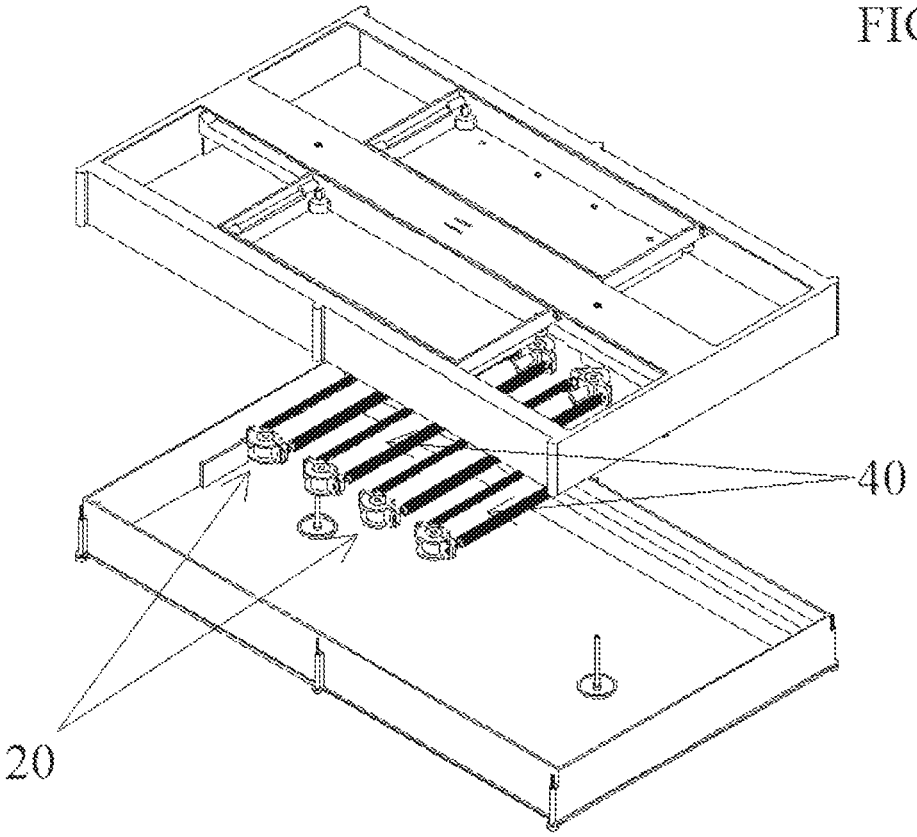
FIG. 61 is a partially exploded isometric view of an eleventh embodiment of an exercise device in accordance with the present invention.

FIG. 61 is a partially exploded isometric view of an eleventh embodiment of an exercise device in accordance with the present invention showing the resistance mechanisms 20 and dashpots 40.

Figure 62:
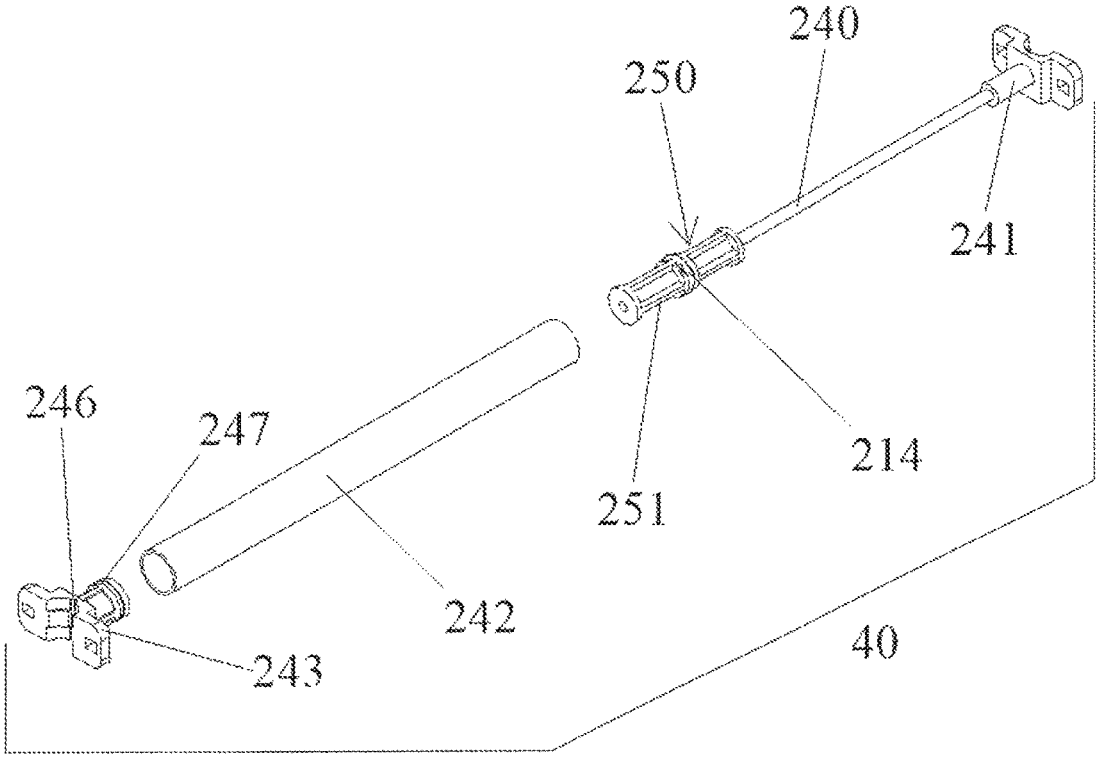
FIG. 62 is a partially exploded isometric view of one of the dashpots of the exercise device of FIG. 61.

FIG. 62 is a partially exploded isometric view of one of the dashpots 40 of the exercise device of FIG. 61 showing the piston/valve 250, channeled piston 251, O-ring 214, rod 240, rod end piece, 241, tube 242, tube end piece 243, tube end piece air outlet 246, and tube end piece O-ring 247.

Figure 63:
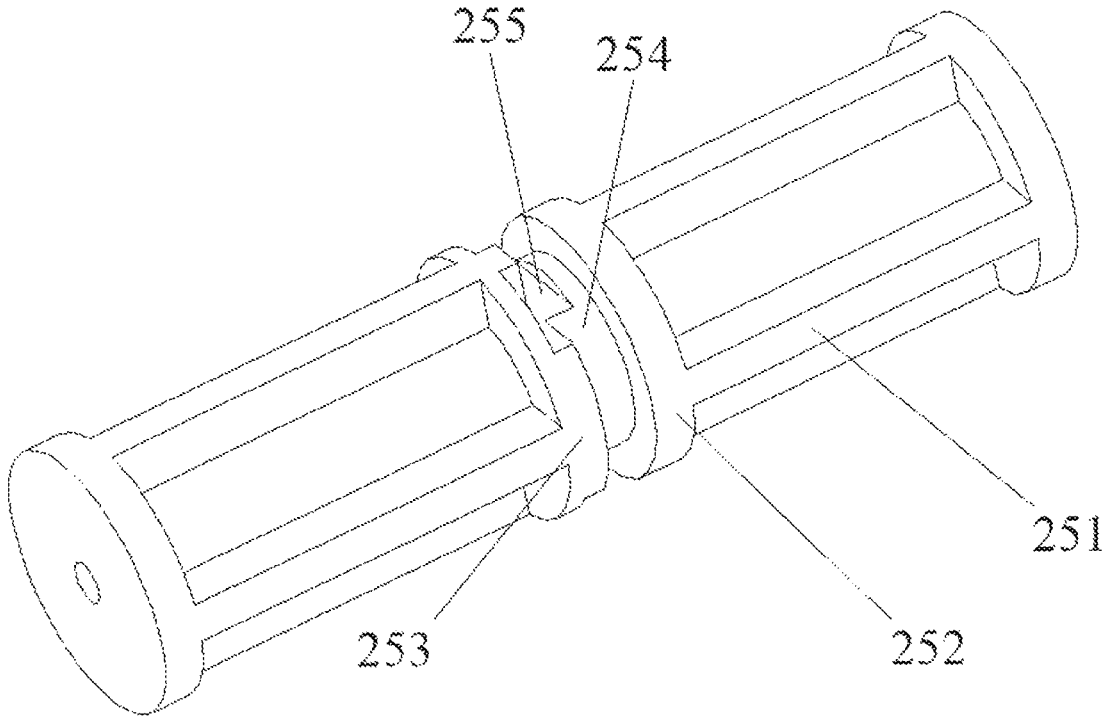
FIG. 63 is an isometric view of one of the channeled pistons of the exercise device of FIG. 61.

FIG. 63 is an isometric view of one of the channeled pistons 251 of the exercise device of FIG. 61 showing the channeled piston inner wall 252, channeled piston outer wall 253, channeled piston O-ring support surface 254, and channel 255.

Figure 64A:
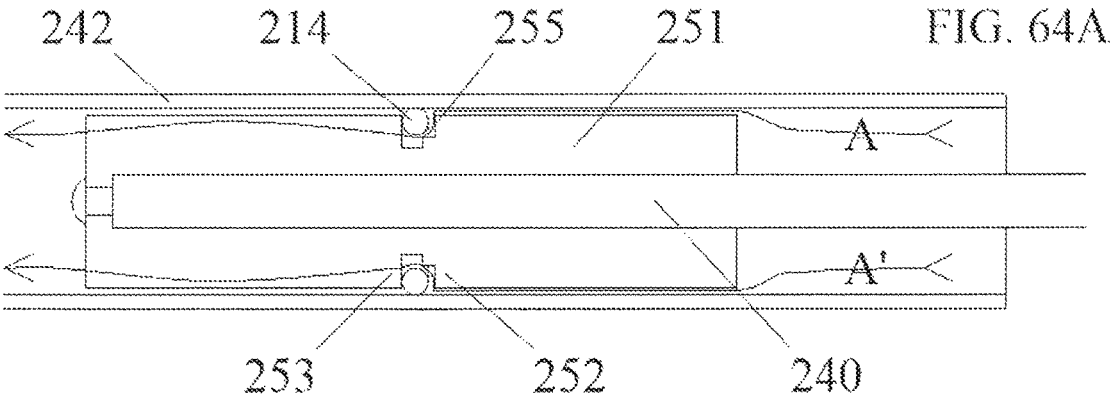
FIG. 64A is an enlarged sectional view of one of the piston/valves of the exercise device of FIG. 61 in an open position.

FIG. 64A is an enlarged sectional view of one of the piston/valves of the exercise device of FIG. 61 in an open position showing the O-ring 214, channeled piston 251, channeled piston inner wall 252, channeled piston outer wall 253, channel 255, tube 242, and rod 240. Also shown are lines A and A' which show the path of the air as it flows into the tube.

Figure 64B:
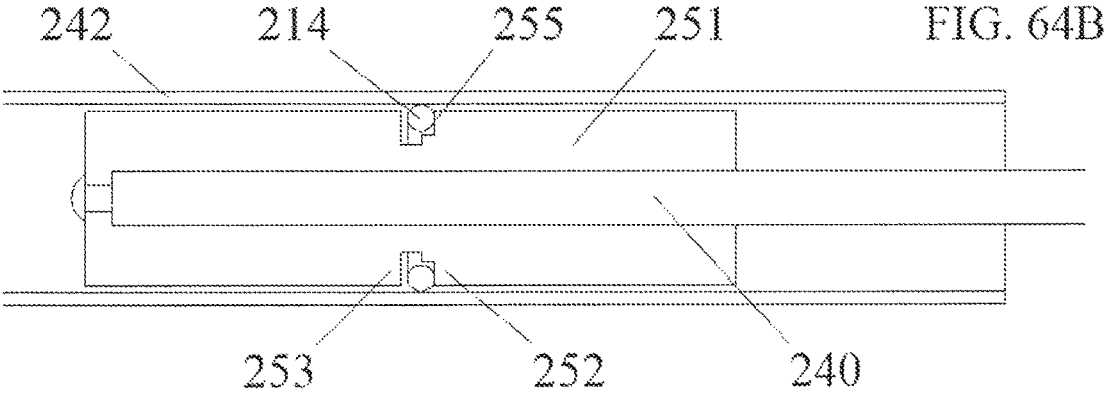
FIG. 64B is an enlarged sectional view of one of the piston/valves of the exercise device of FIG. 61 in a closed position.

FIG. 64B is an enlarged sectional view of one of the piston/valves of the exercise device of FIG. 61 in a closed position showing the O-ring 214, channeled piston 251, channeled piston inner wall 252, channeled piston outer wall 253, channel 255, tube 242, and rod 240.

REFERENCE NUMERALS

5 user
10 oscillating exerciser
20 resistance mechanism
30 shock cord
31 shock cord stop
32 shock cord inner stop
33 shock cord outer stop
34 extension spring
35 shock cord sleeve
40 dashpot
41 inner tube
42 inner tube end piece
43 outer tube
44 outer tube end piece
45 inner tube air inlet
46 piston
47 outer tube air outlet
48 dashpot sleeve
50 inner tube end piece elongated hole
51 inner tube end piece notch
52 outer tube end piece hole
53 outer tube end piece notch
54 end piece bracket
55 end piece bracket extension
60 foot platform
61 foot platform boss
62 boss sleeve
63 shock cord anchor hole
64 pulley cord anchor hole
65 resistance mechanism axle
66 resistance mechanism bearing
70 axle
71 inner support bearing
72 outer support bearing
73 inner guide bearing
74 outer guide bearing

75 sheath
80 lower frame
81 lower frame horizontal bearing surface
82 lower frame wall extensions
90 middle support
91 middle support horizontal bearing surface
100 upper frame
101 inner vertical bearing surface
102 outer vertical bearing surface
110 inner rail
111 outer rail
112 horizontal bearing surface shelf
113 end support
120 inner roller
121 outer roller
122 groove
130 lower frame ridge
140 middle support ridge
150 retaining ridge
160 pulley assembly
161 pulley
162 pulley cord
163 pulley axle
164 pulley/roller
165 pulley/roller upper half
166 pulley/roller lower half
167 pulley/roller liner
170 bearing surface liner
171 bearing surface liner extension
172 bearing surface liner extension holes
180 rack gear
181 spur gear
182 spur gear axle
190 valve
191 valve body
192 valve opening
193 valve seal
200 conical valve member
201 valve shock cord
210 spherical valve member
211 valve body cage
212 compression spring
213 valve inner sleeve
214 O-ring
215 O-ring groove
216 valve opening air outlet
220 flap valve
221 flap valve rivet
222 flap valve rivet hole
230 disc shaped valve member
231 valve shock cord opening
240 rod
241 rod end piece
242 tube
243 tube end piece
244 tube end piece air inlet
245 tube air outlet
246 tube end piece air outlet
247 tube end piece O-ring
250 piston/valve
251 channeled piston
252 channeled piston inner wall
253 channeled piston outer wall
254 channeled piston O-ring support surface
255 channel An exemplary embodiment of an oscillating exercise device in accordance with the present invention is shown in FIGS. 1-22A. The exemplary device includes two foot platforms 60, each of which is configured to ride within a frame. The exemplary foot platforms 60 are equipped with an axle 70, inner support bearings 71, and outer support bearings 72, FIGS. 2, 3, and 5. The axle permits rolling motion of a respective bearing. The inner support bearings engage the horizontal bearing surfaces 91 of the middle support 90 of the frame, as shown in FIGS. 2, 3, and 12. The outer support bearings engage the horizontal bearing surfaces 81 integrated into the outer edges of a lower frame 80, as shown in FIGS. 2, 3, and 11.

Each foot platform 60 is also equipped with inner guide bearings 73 and outer guide bearings 74, as shown in FIGS. 2, 3, and 5. The inner guide bearings engage the inner vertical bearing surfaces 101 of the upper frame 100. See FIGS. 2, 4, and 13. The outer guide bearings engage the outer vertical bearing surfaces 102 of the upper frame. Both support and guide bearings are preferably covered with a rubber-like sheath 75. Each foot platform 60 also has a plurality of bosses 61 on its underside along the outer edge, as shown in FIGS. 4 and 5.

The foot platforms are connected by one or more resistance mechanisms 20 composed of a resilient member, such as a strand of elastic band or shock cord 30, and a dashpot 40, FIGS. 4-7. The dashpot is made up of an inner tube 41 nested within an outer tube 43, FIGS. 6 and 7. The outer end of each inner tube and outer tube are capped with an inner tube end piece 42 and an outer tube end piece 44, respectively.

A one way valve 190 is fitted to the inner end of the inner tube 41, FIGS. 8-10B. The valve has a valve body 191 that fits over the inner end of the inner tube. The valve body is preferably made of a low-friction material such as acetal or nylon and has an outer diameter that is roughly equivalent to the inner diameter of the outer tube. Furthermore, the valve body has a valve opening 192 at its inner end. The valve also features a conical valve member 200. The tapered end of the cone sits in the valve opening and is held in place by a tensioned strand of valve shock cord 201 which is anchored in the inner tube end piece 42. The inner tube has one or more inner tube air inlets 45 in the tube wall which provide a direct path between the outside air and the valve opening. The air inlet(s) can also be in the inner tube end piece 42.

Each inner tube end piece has an elongated hole 50 on one side and a notch 51 on the other. Furthermore, each outer tube end piece has a non-elongated hole 52 on one side and a notch 53 on the other. A low friction sleeve 62 is fitted around each of the foot platform bosses 61.

A resilient member, such as a strand of elastic band or shock cord 30, has a stop 31 at one end, such as a knot, and is threaded through the inner tube end piece elongated hole 50, FIGS. 4, 6, and 7. The resilient member is then threaded around one of the foot platform bosses 61, stopped/knotted, pulled taut, and inserted in the inner tube end piece notch 51 with the stop towards the inside. The resilient member is then run alongside the dashpot 40, stopped/knotted, and threaded through the outer tube end piece hole 52. These second and third stops are positioned such that the segment of the resilient member running alongside the dashpot is relatively relaxed when the dashpot is collapsed. The elastic is then threaded around the boss 61 of the other foot platform opposite the first boss and again, stopped/knotted, pulled taut, and inserted in the outer tube end piece notch 53 with the stop to the inside. The resilient member is then run alongside the dashpot 40, threaded through the inner tube end piece elongated hole 50 and stopped/knotted. These fourth and fifth stops, as with the second and third stops, are positioned such that the segment of the resilient member running alongside the dashpot is relatively relaxed when the dashpot is collapsed.

Thus, the resilient member and dashpot extend in a generally crosswise direction between the bosses when they are in their most relaxed positions. The resilient member resists translational movement of the platforms. More specifically, relative translational movement of the platforms away from each other causes stretching of the resilient member and the intake of air into the dashpot through the valve opening. The resilient member tends to resile to bias the platforms toward a neutral position in which the resilient member is resiled to the fullest extent possible during normal operation of the device. In the process, the resilient member tends to expel air from the dashpot thereby dissipating energy.

A second embodiment of the present invention uses an inner rail 110 and two outer rails 111 to provide the horizontal and vertical bearing surfaces. Also, rather than shock cord, an extension spring 34 runs along each side of the dashpot 40, FIG. 23. The ends of the springs are hooked into extensions 55 in the end piece brackets 54 thereby securing the springs and dashpot to the bosses, FIG. 24.

The valve 190 of the second embodiment is also different in that it uses a spherical valve member 210 and compression spring 212, FIGS. 25 and 26, rather than a conical valve member and shock cord. The spherical member and spring are encased in a valve body cage 211 at the inner end of the valve body 191. Furthermore, the valve opening 192 is at the flanged end of a valve inner sleeve 213 rather than the valve body itself. This sleeve is inserted inside the inner tube with the inner tube then inserted inside the valve body such that the sleeve and body form a functional unit. The valve inner sleeve can be made from a rubber-like material thereby helping to assure a good seal between the spherical valve member and the edge of the valve opening.

A third embodiment eschews the guide bearings of the previous embodiments. Rather, it employs inner rollers 120 and outer rollers 121 all of which have a central groove 122, FIGS. 27 and 31. The grooves in the inner rollers engage the middle support ridges 140 on each horizontal bearing surface of the middle support. The grooves in the outer rollers engage the lower frame ridges 130 on each of the horizontal bearing surfaces along the outer edge of the lower frame. In addition, the upper frame has a series of retaining ridges 150 along its underside, FIG. 32. These ridges are triangular in cross section. They line up with the ridges on the horizontal bearing surfaces and consequently line up with the grooves in the grooved rollers. However because of their shape and a measure of clearance between the underside of the upper frame and the top of the rollers, these ridges sit inside the grooves of the rollers without actually engaging them during normal operation.

Also the valves used in the aforementioned embodiments are replaced with flap valves 220, FIG. 30. These valves are affixed, via flap valve rivets 221 and flap valve rivet holes 222, to the inside of each outer tube towards the outer end of the tube. In addition, each flap valve covers a valve opening 192 in the wall of the corresponding outer tube. The valves are preferably made of a somewhat stiff but elastic rubber-like material. Alternatively, the valve can be made of a combination of materials, i.e. a spring steel body with a rubber-like pad to cover the valve opening.

Furthermore, rather than having one or more distinct resistance mechanisms, a continuous strand of elastic band or shock cord 30 with intermittent dashpots 40 is run around the platform bosses, FIG. 28. Specifically, the resilient member is knotted/stopped and threaded through one of the shock cord anchor holes 63. The free end of the resilient member is then run through a dashpot 40. The resilient member is fixed to the dashpot by providing inner stops/knots 32 and outer stops/knots 33 on the inside and outside, respectfully, of the inner and outer tube end pieces, FIG. 29. Then the combined resilient member and dashpot is run beneath the middle support 90, FIG. 28. The resilient member is then threaded around the first boss on the opposite platform. The resilient member is then run back under the middle support (without being run through a dashpot) and threaded around the second boss of the opposing platform. The resilient member is then run between the foot platforms twice more (for a total of three times) before being run through, and affixed to, a second dashpot. The combined resilient member and dashpot is again run beneath the middle support. The resilient member is then run between the foot platforms three more times before being run through and affixed to a third dashpot. Lastly, the resilient member is threaded through the shock cord anchor hole 63 at the opposite end of the other foot platform and knotted/stopped.

Thus, the resilient member extends around bosses on respective ones of the platforms in an alternating sequence. This continues until the resilient member runs back and forth between the bosses thereby connecting the platforms. Additionally, dashpots are affixed to the resilient member at various locations along its length. More specifically, as shown in the figures, when the foot platforms are aligned laterally in a fore/aft direction the resilient member and dashpots run primarily in a crosswise direction (transversely to the direction of elongation of the frame and direction of motion of the platforms) between respective bosses on respective ones of said pair of platforms (i.e., between bosses on two different platforms), and further extend in a generally longitudinal direction between respective bosses on a single one of said pair of platforms (i.e., between different bosses on a single platform). The bosses can be arranged and the resilient member can be routed so that it follows a crossing pattern, or any of myriad other configurations that extend in a generally crosswise direction.

A fourth embodiment is similar to the aforementioned embodiments but adds a pulley assembly 160 further connecting the foot platforms, as will be appreciated from FIGS. 33, 34, and 35. Specifically, this embodiment features two pulleys 161 supported toward opposite ends of the exercise device. In this embodiment, the pulleys are mounted horizontally on axles 163 extending downward from the underside of the middle support. This embodiment includes two pulley cords 162 just above the level of the shock cord. Each of the pulley cords passes from one end connected to one of the foot platforms, around a respective one of the pulleys, to an opposite end that is connected to the other foot platform. The cords are connected to the foot platforms by being threaded through the pulley cord anchor holes 64 and stopped/knotted at each end. The pulley cords can also be two segments of a continuous length of cord threaded through the anchor holes and knotted towards the middle and at each end. Furthermore, the pulley cords can either be relatively elastic or relatively inelastic.

The fourth embodiment also features bearing surface liners 170 rather than individual bearing sheaths, as best shown in FIG. 33. The liners 170 have a rubber-like consistency and downward extensions 171 along their undersides. These extensions line up with bearing liner extension holes 172 in the lower frame and middle support.

In addition, the inner and outer guide bearings are cantilevered rather than paired as they are in the first and second embodiments. Furthermore the lower frame has been modified by adding vertical wall extensions 82, as shown in FIG. 33.

A fifth embodiment is similar to the fourth embodiment, as will be appreciated from FIGS. 36-42. However, rather than have the inner guide bearings 73 and outer guide bearings 74 roughly even with the inner support bearings 71 and outer support bearings 72 they are toward the underside of the foot platforms. Conversely, the pulley assembly 160 is roughly even with the support bearings. Furthermore, the vertical bearing surfaces 101, 102 and bearing surface liners 170, rather than extending up from, and towards the outside of, the horizontal bearing surfaces 81, 91 extend downward from, and towards the inside of, the horizontal bearing surfaces. Alternatively, both guide and support bearings could be on the same level with the pulley assembly above.

In addition, rather than connect to the foot platforms via bosses, the resistance mechanisms connect to the foot platforms via downward extending resistance mechanism axles 65 and resistance mechanism bearings 66, FIGS. 36-40. In this case, there are two bearings per axle with the inner tube end pieces 42, outer tube end pieces 44, and end piece brackets 54 fashioned accordingly, FIG. 40.

Similar to the second embodiment the resistance mechanism 20 is secured to the resistance mechanism bearings 66 and axles by securing the shock cord 30 to the end piece brackets 54, FIG. 40. Specifically, the shock cord is threaded through one of the end piece bracket extensions 55, looped back on itself, threaded through a shock cord sleeve 35, and knotted.

Also, the fifth embodiment uses flap valves 220 similar to the third embodiment, FIGS. 41-42. However, in this instance, each valve lies along the bottom of the outer tube 43. In addition, the free end of the valve, opposite the flap valve rivets 221 and flap valve rivet holes 222, has been slightly thickened. Furthermore, the inner tube supports a piston 46 which closes off the open end of the tube, FIG. 40.

A sixth embodiment is similar to the fourth embodiment, as will be appreciated from FIGS. 43-48. In this instance, however, the inner and outer guide bearings have been eliminated. Rather, the pulleys function as pulley/rollers 164. Each pulley/roller is divided into an upper half 165 and a lower half 166. An additional pulley/roller has also been added midway between the two outermost pulley/rollers to function purely as a roller. Pulley/roller liners 167, preferably made of a rubber-like material, are installed along the inner sides of the foot platforms. Also, the horizontal bearing surfaces include shelves 112 that run along the outside of the support bearings. In addition, the support bearings are individually sheathed.

As with the fifth embodiment, the resistance mechanisms 20 connect to the foot platforms via resistance mechanism axles 65 and resistance mechanism bearings 66, FIGS. 43-47. However, in this instance, there is only one bearing per axle with the inner tube end pieces 42, outer tube end pieces 44, and end piece brackets 54 fashioned accordingly, FIG. 47.

Furthermore, the valve features O-rings, FIG. 48. The O-rings are installed in O-ring grooves 215 around the outer circumference of the valve body 191. They thereby maintain a dynamic seal between the valve body and the inside of the outer tube 43. The valve opening 192 features valve opening air outlets 216 to allow a predetermined amount of air to escape the outer tube when the valve is closed. Although in this instance O-rings are used with a valve using a spherical member and compression spring, O-rings are equally applicable to other valve configurations.

A seventh embodiment is similar to the fourth embodiment, as will be appreciated from FIGS. 49-51. However, rather than use a distinct pulley assembly, this fifth embodiment incorporates the pulleys 161 and pulley cords 162 into the resistance mechanism. Specifically, the shock cord is threaded through the shock cord anchor holes 63 and stopped/knotted at each end but with an extensive length of cord extending beyond each knot. Each of these lengths is then used as a pulley cord by threading it around the corresponding pulley, through the corresponding pulley cord anchor hole 64, and stopping/knotting it. The pulley cords are preferably at a higher tension than the shock cord forming part of the resistance mechanism.

Also, as with the third embodiment, the dashpots are equipped with flap valves 220, FIG. 51. However, in this instance, the flap valves are incorporated into the outer tube end piece 44 rather than being separate components.

An eighth embodiment is similar to the fourth embodiment, but employs a geared mechanism rather than pulleys and cords, as will be appreciated from FIGS. 52 and 53. Specifically, an inward-facing rack gear 180 is incorporated into each foot platform along the platform's inner edge. These rack gears mesh with a spur gear 181 mounted horizontally along the underside of the middle support. The spur gear is connected to the middle support via the spur gear axle 182.

A ninth embodiment is similar to the fourth embodiment, as will be appreciated from FIGS. 54-57. However, there are some differences in the resistance mechanisms, which in this case is a dashpot 40, as best shown in FIG. 55. Specifically, unlike earlier embodiments, this embodiment uses a valve 190 with a valve body 191 and disk-shaped valve member 230, as shown in FIGS. 56 and 57. In addition, the valve body, as well as having a valve opening 192, has a valve seal 193 seated in a groove, and a central valve shock cord opening 231 through which the valve shock cord 201 runs. Furthermore, similar to the sixth embodiment, an O-ring 214 seals the gap between the valve body and the inside of the outer tube.

The dashpot 40 is designed to accommodate the valve 190, FIGS. 55 and 57. Specifically, as with the fourth embodiment, the inner tube 41 features an inner tube air inlet 45, FIG. 55. However, the outer tube 43 also has a smaller outer tube air outlet 47, FIG. 55. Furthermore, the dashpot 40 is fitted with a dashpot sleeve 48, FIGS. 55 and 57. The inner diameter of this sleeve is roughly equivalent to the outer diameter of the inner tube whereas the outer diameter, not including the lip, is roughly equivalent to the inner diameter of the outer tube.

A tenth embodiment is similar to the fourth embodiment, as will be appreciated from FIGS. 58-60. However, as with the ninth embodiment, there are some differences in the resistance mechanisms. Specifically, the dashpot 40 features a rod 240 and tube 242 rather than the inner and outer tubes of earlier embodiments, as best shown in FIG. 57. Similar to the outer tube in the ninth embodiment, the tube has a tube air outlet 245, as shown in FIG. 59. The tube end piece 243 is also similar in structure to the outer tube end pieces of earlier embodiments. However, a valve 190 has been connected to the tube end piece which accordingly has a tube end piece air inlet 244, as shown in FIG. 59.

In this instance, the valve 190 is similar to the valves supported by the inner tube in the second and sixth embodiments. Referring now to FIG. 60, it will be appreciate that the valve has a spherical valve member 210 and compression spring 212 inside the valve body cage 211 of the valve body 191. The valve inner sleeve 213 is inserted between the valve body and the tube end piece 243. The tube end piece air inlet 244 provides an unobstructed channel between the outside air and the valve.

As with the inner tube in the fifth embodiment, the rod supports a piston 46, as shown in FIG. 59. However, in this instance, the piston in turn supports a pair of O-rings 214. Furthermore, rather than accommodate an inner tube, the rod end piece 241 and dashpot sleeve 48 accommodate the rod.

An eleventh embodiment is similar to the fourth embodiment, as will be appreciated from FIGS. 61-64. However, in this embodiment the valve is not a distinct mechanism. Rather, it is incorporated into a single piston/valve 250 made up of a channeled piston 251 and O-ring 214, FIG. 62. The modified piston has a portion of the channeled piston O-ring support surface 254 and a portion of the channeled piston inner wall 252 cut away, as shown in FIG. 63. Consequently, when the O-ring 214 is against the inner wall there is a channel 255 that runs between the O-ring and the piston, as will be appreciated from FIGS. 63 and 64A. Conversely, when the O-ring is against the channeled piston outer wall 253 this channel is closed off, as will be appreciated from FIGS. 63 and 64B.

Furthermore, the piston is elongated with an overall diameter slightly smaller than the inner diameter of the tube, as shown in FIGS. 62-64. In this embodiment, there's one O-ring, along with the associated piston features, located midway along the piston. However, there can be more than one and they can be located at various positions along the piston.

Also, rather than have an air outlet located along the surface of the tube 242, the tube end piece 243 has a tube end piece air outlet 246, as shown in FIG. 62. In addition, a tube end piece O-ring 247 has been fitted between the end piece and the tube.

Each of the embodiments described above provides for a low-profile compact device. Consequently, the present invention can be left under a desk or table when not in use without getting in the way of the user's feet and legs during normal desk use. The low profile compact design of the present invention also makes it easy to store, transport, etc.

Operation

In use, an exercise device 10 in accordance with the present invention is laid on the ground at the feet of a user 5 while the user sits on standalone seating, as shown in FIG. 1. The user then places his feet on the foot platforms 60 so as to engage in exercise while seated.

The foot platforms 60 are free to move forward and backward on the middle support horizontal bearing surfaces 91 and the lower frame horizontal bearing surfaces 81 via the inner support bearings 71 and outer support bearings 72 respectively, FIGS. 2, 3, 5, 11, and 12, within raceways defined by the frame.

One or more resilient members, such as a strand of elastic band or shock cord 30, connecting the foot platforms via the foot platform bosses 61, cause the foot platforms to oscillate forward and backward once the resilient members are initially stretched. One or more dashpots 40 dampen these oscillations. It's the input of energy by the user that acts to overcome this damping, thus maintaining the oscillation of the foot platforms, which provides exercise.

Specifically, moving the platforms apart requires that the user primarily overcome the resistance of the resilient members, FIGS. 4, 6, and 7. As the platforms are forced further apart, the resistance increases. Consequently, no external regulation of the resistance is necessary. At the same time, in pushing the foot platforms apart, the user also extends the dashpots 40 creating negative air pressure inside the outer tube 43. This in turn pulls the conical valve member 200 away from the valve opening 192 against the elasticity of the valve shock cord 201, FIGS. 8, 9, 10A. Consequently, air is allowed to flow, via the inner tube air inlet 45, through the valve opening and into the outer tube 43 as illustrated by lines A and A'. Consequently, negative air pressure doesn't build up in the outer tube which would otherwise provide a reactive force. In other words, the valve assures the dashpot functions as a pneumatic damper rather than a pneumatic spring.

Conversely, in pulling the foot platforms together, the resilient members collapse the dashpots 40 creating positive air pressure inside the outer tube 43. This forces the conical valve member 200 against the rim of the valve opening 192, FIGS. 8, 9, 10B. Consequently air is forced to flow through the constricted gap between the outside of the valve body 191 and the inside of the outer tube 43 as illustrated by lines B and B'. The size of this gap, along with the volume of the dashpot, determines the amount of damping provided. The valve shock cord 201 establishes the initially seal allowing the build-up of positive air pressure.

Consequently, pulling the platforms together requires that the resilient member, i.e. shock cord 30, primarily overcome the resistance of the dashpot 40, FIGS. 4, 6, and 7. Thus, the energy expended by the user to force the platforms apart is not fully returned by the resilient member. As a result, continuously overcoming the resistance of the resilient members requires the continuous exertion of the user rather than resulting from the energy return of the resilient members.

Because the resistance is primarily between the freely-moving platforms, rather than between the platforms and the static frame, there are essentially no opposing forces to cause the seat and/or the exercise device to move around, even when exercising at high intensities. The boss sleeve 62 allows the resistance mechanism 20 to freely rotate horizontally about the foot platform boss 61, FIGS. 5, 6, and 7.

The natural rate of oscillation of the foot platforms can be changed by altering the strength and/or tension of the resilient members. For instance, a higher strength and/or tension will tend to increase the rate of oscillation whereas a lower strength and/or tension will tend to decrease the rate of oscillation. Also, a lower mass carried by the foot platforms will tend to speed up the oscillations whereas a higher mass carried by the foot platforms will tend to slow down the oscillations.

The resistance provided by the resilient members acts generally longitudinally of the device, along an axis of reciprocation of the foot platforms. However, it also provides an inward, crosswise force. In the case of the resilient members, this force increases as the platforms are moved farther apart. The inner guide bearings 73 engage the inner vertical bearing surfaces 101 of the upper frame 100 thereby assuring that the fore/aft movement of the platforms remains smooth and consistent in spite of this inward, crosswise force component and its variability, FIGS. 2, 4, 5, and 13.

As the foot platforms are moved farther apart, the inward crosswise force tends to be increasingly concentrated near the innermost ends of the foot platforms. The outer guide bearings 74 engage the outer vertical bearing surfaces 102 of the upper frame 100 so that as the platforms are moved farther apart, the outermost ends of the foot platforms don't swing outward, FIGS. 2, 4, 5, and 13. Also, there may be instances where the user supplements the resilient members in overcoming the dashpots in pulling the platforms towards one another. Under these conditions, the dashpots exert an outward crosswise force. The outer guide bearings and outer vertical bearing surfaces function to constrain this crosswise force as well.

Each of the support and guide bearings is encased in a rubber-like sheath 75, FIG. 5. This reduces slippage between the bearings and the bearing surfaces, thus reducing noise and wear. Alternatively, this could be achieved by covering the rollers and rails with a tooth-like surface similar to that found on gears.

To exercise, a user contracts the quadriceps and related muscles of one leg (in this case the right) while simultaneously contracting the hamstrings and related muscles of the other leg (in this case the left), FIGS. 14, 15, and 16. This has the effect of forcing the foot platforms apart, thereby extending the resilient members and the dashpots connecting them, FIGS. 14A, 15A, and 16A. Initially, the resilient members are extended relatively little compared to the lengthwise separation of the platforms. However, the amount of extension increases rapidly as the platforms are forced farther apart. Furthermore, the angle of the resilient members relative to the lengthwise travel of the foot platforms increases as the foot platforms are forced farther apart. Consequently, the lengthwise resistance provided by the resilient members is initially rather low but then increases rapidly as the platforms are forced farther apart.

When the desired level of resistance is achieved, the user relaxes his/her muscles, FIGS. 17 and 18. This allows the resilient members to resile and, overcoming the resistance of the dashpots, pull the platforms back in line with one another, FIGS. 17A and 18A. Contrary to the situation above, as the resilient members pull the platforms together the amount of stretch in the cord initially decreases rapidly but then more gradually. Furthermore, the angle of the resilient members relative to the lengthwise travel of the foot platforms decreases as the resilient members pull the platforms more in line with one another. Consequently, both the lengthwise force exerted by the resilient members, and the damping provided by the dashpots, is initially rather high but then decreases rapidly as the resilient members pull the platforms more in line with one another.

The user then contracts the quadriceps and related muscles of the left leg while simultaneously contracting the hamstrings and related muscles of the right, FIGS. 19 and 20. This has the effect of again separating the foot platforms but in the opposite direction, FIGS. 19A and 20A. As previously the lengthwise resistance provided by the resilient members is initially rather low compared to the lengthwise separation of the platforms but then increases rapidly as the platforms are forced farther apart.

When the desired level of resistance is achieved, the user again relaxes his/her muscles, FIGS. 21 and 22. This again allows the resilient members to resile, and overcoming the resistance of the dashpots, pull the platforms back in line with one another, FIGS. 21A and 22A. As previously, the lengthwise force exerted by the resilient members and the damping provided by the dashpots is initially rather high but then decreases rapidly as the resilient members pull the platforms more in line with one another.

By repeatedly contracting and relaxing the user's muscles in the aforementioned way, the user moves the platforms in a reciprocating motion against the resistance of the resilient members. This provides the user with exercise and its accompanying benefits.

Furthermore, because of the orientation of the resilient members the lengthwise resistance provided by the resilient members is initially rather low but then increases rapidly as the platforms are forced farther apart. Conversely, as the resilient members overcome the resistance of the dashpots and pull the platforms more in line with one another the lengthwise force exerted by the resilient members and the damping of the dashpots is initially rather high but then decreases rapidly. Consequently, the present invention provides for a smooth and even motion as the user scissors their feet and lower legs back and forth. In addition, it's easy to start and restart the movement of the foot platforms. Furthermore, a sizable range of usable resistances is provided for using a single piece of exercise equipment and a single setup.

The second and third embodiments of the exercise device function in a manner similar to that of the first embodiment. However, in the second embodiment the spherical valve member 210 and compression spring 212, FIGS. 25 and 26, function similarly to the conical valve member and valve shock cord of the first embodiment.

In the third embodiment, the grooves 122 in the inner rollers 120 and outer rollers 121 engage the middle support ridges 140 and lower frame ridges 130 respectively, as shown in FIGS. 27 and 31. Consequently, they fulfill the same function as the guide bearings and vertical bearing surfaces in the first embodiment. Specifically, they maintain the alignment of the foot platforms in opposition to crosswise forces. The retaining ridges 150 on the underside of the upper frame keep the grooves in line with the ridges in the event the grooves and ridges become disengaged, as shown in FIG. 32.

Furthermore, since the dashpots 40 do not continuously engage the foot platform bosses, the resilient member is relied upon to pull the platforms back in line with one another without any supplemental input from the user, FIGS. 28 and 29.

The flap valves 220 work by flexing inwardly, thereby clearing the valve openings 192, when negative air pressure builds up in the dashpot 40 during extension. When the extension is halted, the air pressure inside and outside the dashpot equalizes causing the flap valves to relax thereby closing off the valve openings 192.

The fourth embodiment functions in a manner similar to that of the aforementioned embodiments. However, the pulley assembly 160 keeps the foot platforms as a unit centered in the fore/aft direction while still allowing for oscillating motion, as will be appreciated from FIGS. 33, 34, and 35. Specifically, when either foot platform is moved away from either pulley 161 it pulls the cord 162 threaded around that pulley. This, in turn, pulls the other platform towards that pulley. Consequently, any movement of either foot platform away from either pulley is offset by an equal movement of the other foot platform towards that pulley. This allows the user to devote their attention to working at a desk, watching TV, reading, etc. rather than to the positions of the foot platforms.

The pulley assembly may be arranged so the foot platforms are midway between the ends of the frame when they are side by side. However, the pulley assembly can also be set up with pulley cords of unequal length, thereby shifting the foot platforms towards either end of the frame. This may make the exercise device more user friendly for someone with shorter legs. If a continuous length of cord divided into two segments is used for the pulley cords, shifting the position of the foot platforms can be achieved by retying the middle knot(s) toward either end of the cord or otherwise moving the stops.

The bearing surface liners 170, similar to the bearing sheaths of the first and second embodiments, reduce slippage between the bearings and the bearing surfaces, thus reducing noise and wear. The bearing surface liner extensions 171 fit into the bearing surface liner extension holes 172 in the lower frame and middle support, thereby keeping the liners in place, as shown in FIG. 33. The cross-wise vertical ends of the liners are slightly thickened to act as bumpers in the event the support bearings bump up against the ends of the frame.

The vertical wall extensions 82 of the lower frame increase the rigidity of the exerciser, as will be appreciated from FIG. 33. Thus, they make the exerciser more durable while also reducing vibration and noise.

The fifth embodiment functions in a manner similar to that of the fourth embodiment, as will be appreciated from FIGS. 36-42. However, by flipping the vertical position of the inner 73 and outer 74 guide bearings and pulley assembly 160 the vertical distance between the guide bearings and resistance mechanism(s) 20 is minimized. Thus, any tendency of the edges of the foot platforms to pop up in response to elevated crosswise forces is reduced.

The resistance mechanism bearings 66 and resistance mechanism axles 65 minimize friction as the resistance mechanisms pivot relative to the foot platforms during operation of the exerciser, FIGS. 36-40. Thus, they reduce lateral forces between the inner tubes 41 and outer tubes 43, FIG. 40. This in turn reduces noise and wear.

Placing the flap valve 220 along the inside bottom of the outer tube 43 allows gravity to help establish and maintain the seal between the valve and the valve opening 192, FIGS. 41 and 42. The thickened end of the flap valve adds a bit of weight, thereby further helping in this regard.

By closing off the open end of the inner tube 41, the piston 46 increases the volume of air moved in and out of the resistance mechanism to the travel of the resistance mechanism times the inner cross section of the outer tube 43, FIG. 40. Consequently, for a resistance mechanism of a given size, the piston increases the damping effect of the mechanism. Also, since no air flows through the inner tube the tube can be replaced with a solid rod.

Looping the shock cord 30 through the end piece bracket extensions 55 and attaching it to itself via the shock cord sleeves 35 provides a more secure and compact connection than simply tying the shock cord to itself, FIG. 40.

The sixth embodiment functions in a manner similar to that of the fourth embodiment, as will be appreciated from FIGS. 43-48. In this instance, however, the foot platforms are guided by the pulley/rollers 164 installed in the frame rather than guide bearings, FIGS. 43-45. The division of the pulleys/rollers into an upper half 165 and lower half 166 ease their manufacture and the installation of the pulley cord 162. Similar to the fifth embodiment, this configuration minimizes the vertical distance between the resistance mechanism(s) 20 and the crosswise support elements (in this case the rollers). Thus, the inside edges of the foot platforms are less likely to pop up in response to elevated crosswise forces.

The pulley/roller liners 167, similar to the bearing liners in the fourth embodiment, minimize noise and wear, FIGS. 43-45. The shelves 112 in the horizontal bearing surfaces further help keep the support bearings 71, 72 and thus the platforms properly aligned, FIG. 46. The shelves also keep the bearing sheaths 75 (which in this case are open to the inside for ease of manufacture and installation) from slipping off the bearings. For more robust resistance to outward crosswise forces additional rollers can be installed in the frame along the outside edges of the platforms.

The O-rings 214 provide a fuller seal between the valve body 191 and the inside of the outer tube of the dashpot, FIG. 48. The valve opening air outlets 216 provide an outlet for the air in the outer tube during damping. The same end can be achieved by any of numerous other ways for a constricted air flow to escape the outer tube.

The seventh embodiment functions in a manner similar to that of the fourth embodiment, as will be appreciated from FIGS. 49-51. However, since the strands of the pulley cords 162 are angled, the pull of the platforms on each other diminishes as the platforms are moved farther apart. Another consequence of this arrangement is that as the platforms are moved farther apart their far ends are pulled inward toward the middle support. Furthermore, as with the third embodiment, the dashpots don't continuously engage the platform bosses. Thus, the outer guide bearings are unnecessary. Since both ends of each pulley cord are affixed to the foot platforms, the pulley cords can be maintained at a relatively high tension, thus minimizing their tendency to stretch, while still allowing for sufficient stretch of the shock cord forming part of the resistance mechanism.

The eighth embodiment functions in a manner similar to that of the fourth embodiment, as will be appreciated from FIGS. 52 and 53. However, in this embodiment, whenever one of the foot platforms is moved the rack gear 180 incorporated into the foot platform turns the spur gear 181. The spur gear then drives movement of the other foot platform, via the rack gear incorporated into that platform, an equal distance but in the opposite direction. Furthermore, the resistance mechanism 20 is a continuous cord with intermittent dashpots, similar to the third and seventh embodiments, but divided into two sections, one to the front and one to the rear of the spur gear.

The ninth embodiment functions in a manner similar to that of the fourth embodiment, as will be appreciated from FIGS. 54-57. However, in this embodiment the disk-shaped valve member 230 is aligned with the valve seal 193 and valve opening 192 via the valve shock cord 201 and valve shock cord opening 231, as shown in FIGS. 56 and 57. Consequently, a good seal between the valve member and seal is assured.

In addition, the dashpot sleeve 48 keeps the inner tube 41 and outer tube 43 of the dashpot 40 properly aligned, as will be appreciated from FIGS. 55 and 57. This helps maintain the integrity of the seal between the O-ring 214 and the inside of the outer tube 43, as shown in FIGS. 56 and 57. The small outer tube air outlet 47, similar to the valve opening air outlets in the sixth embodiment, provides an outlet for the air in the outer tube during damping, as shown in FIG. 55.

The tenth embodiment functions in a manner similar to that of the fourth embodiment, as will be appreciated from FIGS. 58-60. However in this instance the rod 240, rather than an inner tube, slides against the dashpot sleeve 48 as the dashpot 40 extends and collapses, as will be appreciated from FIG. 59. Consequently, the exerciser tends to be quieter during operation. Since there is no hollow inner tube the valve 190 has been relocated to the tube end piece 243, as shown in FIGS. 59 and 60. The tube end piece air inlet 244 allows air to flow into the tube 242 via the valve. As with the fifth embodiment, the piston 46 moves air in and out of the dashpot, as will be appreciated from FIG. 59. The O-rings 214, similar to those supported by valve bodies in earlier embodiments, help maintain a good seal between the piston and the inside of the tube As with the outer tube air outlet of the ninth embodiment, the tube air outlet 245 provides an outlet for the air in the tube during damping.

The eleventh embodiment functions in a manner similar to that of the fourth embodiment, as will be appreciated from FIGS. 61-64. However in this instance, rather than having the piston and valve as distinct components, the channeled piston 251 and O-ring 214 function as a valve when the dashpot 40 is extended, and as a piston when the dashpot is collapsed, as will be appreciated from FIGS. 63, 64A and 64B. Specifically, when the dashpot is extended the O-ring is pulled against the channeled piston inner wall 252, as will be appreciated from FIGS. 63 and 64A. This allows air to flow, via the channel 255, between the O-ring and channeled piston and past the piston inner wall into the tube 242. Conversely, when the dashpot is collapsed the O-ring is pushed against the channeled piston outer wall 253, as will be appreciated from FIGS. 63 and 64B. This seals the gap between the channeled piston and the inside of the tube 242 forcing air out of the tube through the tube end piece air outlet 246 in the tube end piece 243, as will be appreciated from FIGS. 62 and 64B. The tube end piece O-ring 247 prevents unwanted leakage of air between the end piece and tube, as shown in FIG. 62. The outward force of the O-ring against the inside of the tube can also be used to secure the components together.

The length of the channeled piston 251 allows the diameter of the piston to be relatively reduced while keeping the piston and O-ring 214 substantially perpendicular to the walls of the tube 242. This thereby assures a good seal between the piston and the tube, as will be appreciated from FIGS. 62-64, without resorting to a dashpot sleeve. At the same time it allows the piston to move freely within the tube and allows air to move freely past the piston when the piston/valve 250 opens upon extension of the dashpot 40.

While there have been described herein the principles of the invention, it is to be understood by those skilled in the art that this description is made only by way of example and not as a limitation to the scope of the invention, and that various changes in detail may be effected therein without departing from the spirit and scope of the invention as defined by the claims.

What is claimed is:

1. An oscillating exercise device comprising:

a rigid frame extending in a longitudinal direction, and defining a pair of adjacent and longitudinally-extending raceways;

a pair of platforms supported on the frame, each of said pair of platforms being supported for translational movement within a respective one of said pair of raceways;

at least one resilient member having first and second ends, the first end being joined to one of said pair of platforms, and the second end being joined to the other of said pair of platforms to resist translational movement of said pair of platforms, said at least one resilient member being stretched taut to extend linearly between said pair of platforms, said at least one elastic resilient member biasing said pair of platforms toward a neutral position in which said at least one elastic resilient member is minimally stretched; and at least one damper having first and second ends, the first end being joined to one of said pair of platforms, the second end being joined to the other of said pair of platforms to resist resiling of said resilient member;

whereby forcible movement of said platforms of said pair of platforms in opposite directions further stretches said at least one resilient member, said at least one resilient member resisting such movement in opposite directions.

2. The oscillating exercise device of claim 1, wherein each of said pair of platforms comprise bearings supported to ride on bearing surfaces of the rigid frame.

3. The oscillating exercise device of claim 2, wherein each of said bearings is supported on an axle permitting rolling motion of a respective bearing.

4. The oscillating exercise device of claim 1, wherein said frame comprises both horizontal and vertical bearing surfaces, and wherein each of said pair of platforms comprises bearings supported to ride on said horizontal and vertical bearing surfaces.

5. The oscillating exercise device of claim 4, wherein said vertical bearing surfaces and said bearings supported to ride on said vertical bearing surfaces are disposed between said horizontal bearing surfaces and said bearings supported to ride on said horizontal bearing surfaces and said resilient member.

6. The oscillating exercise device of claim 4, wherein each said bearing supported to ride on said horizontal bearing surface comprises a roller having a groove, the horizontal bearing surfaces having ridges configured to mate with the grooves of the rollers.

7. The oscillating exercise device of claim 4, wherein at least one of said horizontal bearing surfaces comprises a shelf.

8. The oscillating exercise device of claim 1, wherein each of said pair of platforms comprises a boss, and said first and second ends of said resilient member and said first and second ends of said damper are supported on said bosses.

9. The oscillating exercise device of claim 8, wherein said resilient member and said damper extend in a generally crosswise direction between said bosses.

10. The oscillating exercise device of claim 8, wherein said bosses support at least one boss sleeve, said at least one boss sleeve supporting said first and second ends of said resilient member and said first and second ends of said damper.

11. The oscillating exercise device of claim 8, wherein said bosses comprise resistance mechanism axles, said axles supporting at least one resistance mechanism bearing, said bearings supporting said first and second ends of said resilient member and said first and second ends of said damper.

12. The oscillating exercise device of claim 8, wherein said first and second ends of said resilient member are attached to resistance mechanism brackets, said brackets supporting first and second ends of said damper and partially encircling said bosses.

13. The oscillating exercise device of claim 1, wherein each of said pair of platforms comprises a plurality of bosses.

14. The oscillating exercise device of claim 13, wherein said at least one resilient member and said at least one damper extend in a generally crosswise direction between respective bosses on respective ones of said pair of platforms.

15. The oscillating exercise device of claim 13, wherein said at least one resilient member extends in a generally longitudinal direction between respective bosses on a single one of said pair of platforms.

16. The oscillating exercise device of claim 13, wherein said at least one resilient member extends around bosses on respective ones of said pair of platforms in an alternating sequence.

17. The oscillating exercise device of claim 14, wherein the outermost ends of said damper are fixed to and supported by said resilient member.

18. The oscillating exercise device of claim 1, wherein said at least one resilient member comprises an elastic band.

19. The oscillating exercise device of claim 1, wherein said at least one resilient member comprises a shock cord.

20. The oscillating exercise device of claim 1, wherein said at least one resilient member comprises a coil spring.

21. The oscillating exercise device of claim 1, wherein said at least one damper comprises a dashpot and a valve.

22. The oscillating exercise device of claim 1, wherein said frame supports a pulley axle at each of its ends, each said axle supporting a pulley, each said pulley supporting a pulley cord connecting said pair of platforms.

23. The oscillating exercise device of claim 22, wherein said pulley cords are extensions of said resilient members.

24. The oscillating exercise device of claim 1, wherein inner edges of each of said pair of platforms are supported by horizontal rollers, said rollers being supported by axles along a centerline of said frame.

25. The oscillating exercise device of claim 24, wherein said at least one roller defines a groove supporting a pulley cord connecting said pair of platforms.

26. The oscillating exercise device of claim 1, wherein at least one horizontal spur gear is supported by an axle along a centerline of said frame, said spur gear engaging a pair of rack gears, a respective one of each of said pair of rack gears being disposed along a respective inner edge of each said pair of platforms.

27. An oscillating exercise device comprising:

a rigid frame extending in a longitudinal direction, and defining a pair of adjacent and longitudinally-extending raceways;

a pair of platforms supported on the frame, each of said pair of platforms being supported for translational movement within a respective one of said pair of raceways;

at least one resilient member having first and second ends, the first end being joined to one of said pair of platforms, and the second end being joined to the other of said pair of platforms to resiliently bias said pair of platforms toward a neutral position, said at least one resilient member extending linearly between said pair of platforms; and at least one damper having first and second ends, the first end being joined to one of said pair of platforms, and the second end being joined to the other of said pair of platforms to resist resiling of the at least one resilient member when said platforms of said pair of platforms are moved in opposite directions to stretch said at least one resilient member.

28. An oscillating exercise device comprising:

a rigid frame extending in a longitudinal direction, and defining a pair of adjacent and longitudinally-extending raceways;

a pair of platforms supported on the frame, each of said pair of platforms being supported for translational movement within a respective one of said pair of raceways;

at least one resilient member having first and second ends, the first end being joined to one of said pair of platforms, and the second end being joined to the other of said pair of platforms, each said resilient member extending generally transversely to said frame, whereby translational movement of said pair of platforms in opposite directions causes stretching of said at least one resilient member that is opposed by the at least one resilient member, the at least one resilient member resiliently biasing said pair of platforms toward a neutral position; and at least one damper having first and second ends, the first end being joined to one of said pair of platforms, and the second end being joined to the other of said pair of platforms to resist resiling of the at least one resilient member.

* * * * *